US007494453B2

(12) United States Patent
Wehrell

(10) Patent No.: US 7,494,453 B2
(45) Date of Patent: Feb. 24, 2009

(54) PHYSICAL TRAINING APPARATUS AND METHOD

(75) Inventor: Michael Al Wehrell, Tampa, FL (US)

(73) Assignee: Michael A. Wehrell, Tampa, FL (US)

( * ) Notice: Subject to any disclaimer, the term of this patent is extended or adjusted under 35 U.S.C. 154(b) by 522 days.

(21) Appl. No.: 10/892,568

(22) Filed: Jul. 16, 2004

(65) Prior Publication Data

US 2005/0032613 A1 Feb. 10, 2005

Related U.S. Application Data

(60) Provisional application No. 60/487,227, filed on Jul. 16, 2003.

(51) Int. Cl.
*A63B 21/02* (2006.01)
*A63B 21/04* (2006.01)

(52) U.S. Cl. ..... 482/124; 482/129

(58) Field of Classification Search ..... 482/92, 482/123–124, 69; 434/252; 473/207, 215–216
See application file for complete search history.

(56) References Cited

U.S. PATENT DOCUMENTS 4,863,163 A * 9/1989 Wehrell ..... 482/123
5,050,871 A 9/1991 Douglas et al.
5,451,194 A * 9/1995 Harrigan ..... 482/70
5,540,642 A * 7/1996 Sprague ..... 482/123
5,653,665 A * 8/1997 Neeley ..... 482/106
5,803,822 A * 9/1998 Pursell ..... 473/216
5,941,807 A * 8/1999 Cassidy et al. ..... 482/146
6,220,994 B1 * 4/2001 Rich ..... 482/123
6,554,747 B1 * 4/2003 Rempe ..... 482/38
6,612,845 B1 * 9/2003 Macri et al. ..... 434/247
6,634,998 B2 * 10/2003 Siaperas ..... 482/142

* cited by examiner

*Primary Examiner*—Fenn C Mathew
(74) *Attorney, Agent, or Firm*—Duane Morris, LLP

(57) ABSTRACT

A physical training apparatus and method for providing forces opposing the motion of a trainee through the range of motion of the trainee while performing various movements. The apparatus includes means for providing resistance forces to multiple body parts of the trainee for training multiple muscle groups of the trainee simultaneously. The apparatus may provide forces of relatively constant magnitude or varying magnitude to various parts of the body through a predetermined range of motion of the body performing sports specific or therapeutic body movements. In one aspect, the resistive forces are provided training modules that are easily attached and detached from the apparatus. The apparatus may also provide resistive forces originating from various lateral and vertical positions relative to the trainee.

49 Claims, 58 Drawing Sheets

4 Vector Innovation (Side Views)

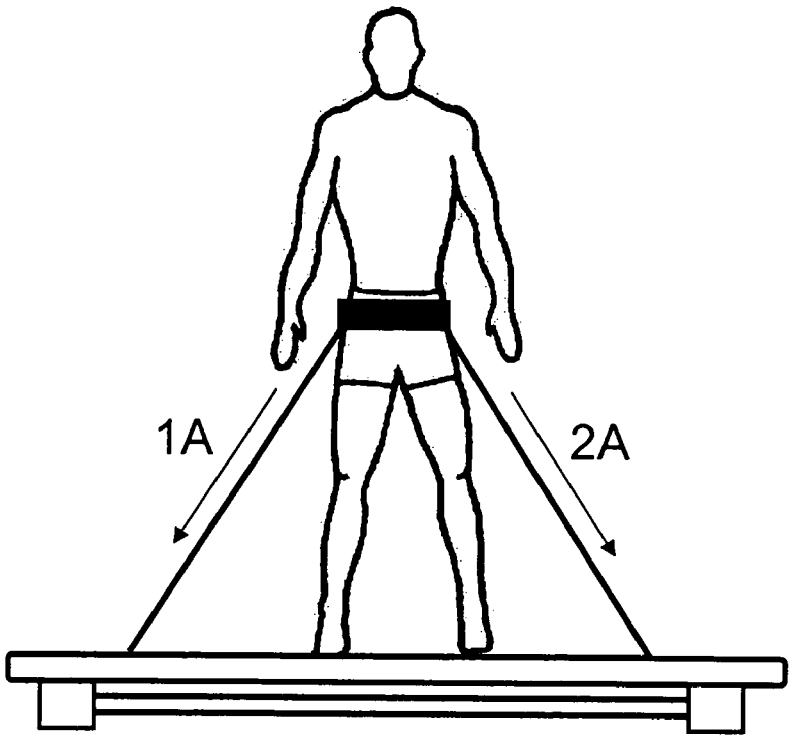
Figure 1 - Front View
PRIOR ART
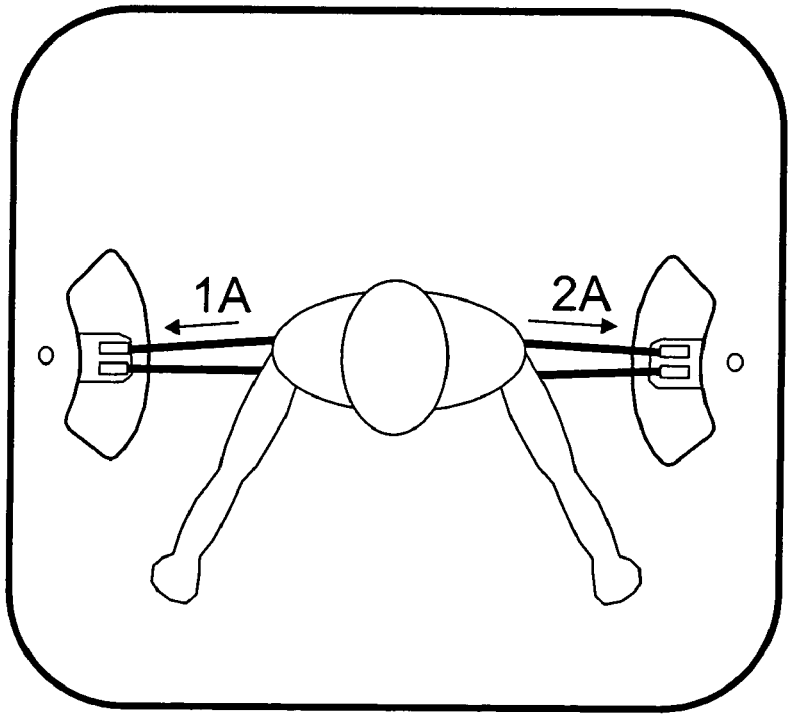
Figure 2 - Top View
PRIOR ART

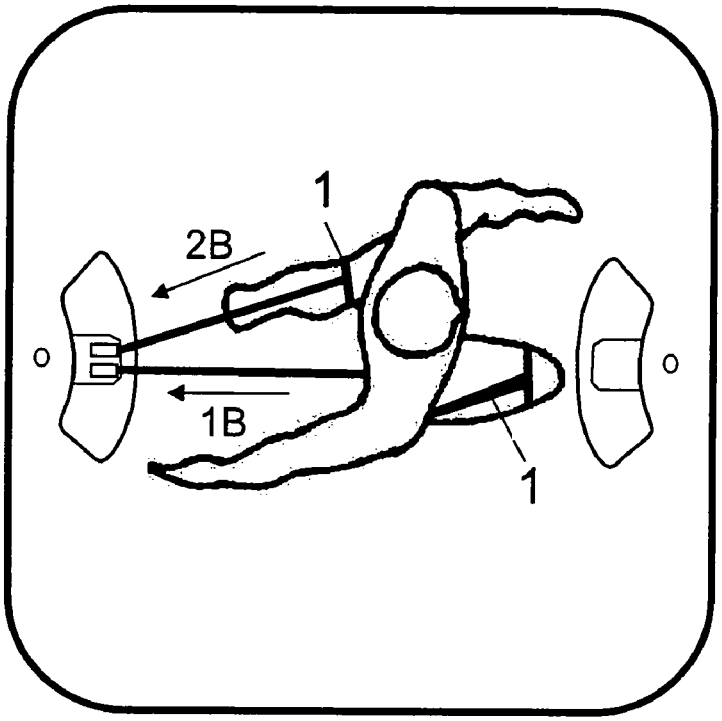
Figure 5 - Top View
PRIOR ART
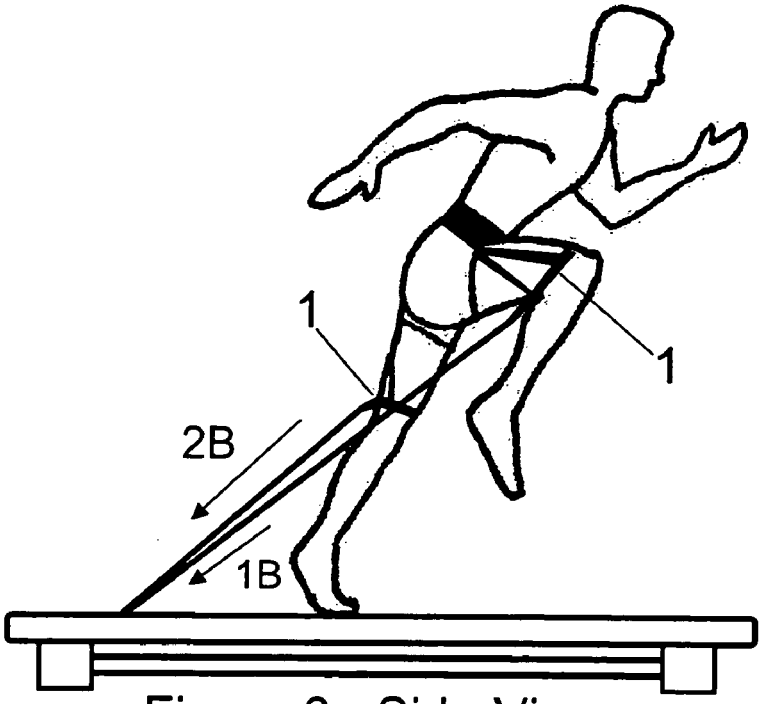
Figure 6 - Side View
PRIOR ART 4 Vector Innovation (Side Views)

6 Vector Innovation (Side & Top Views)

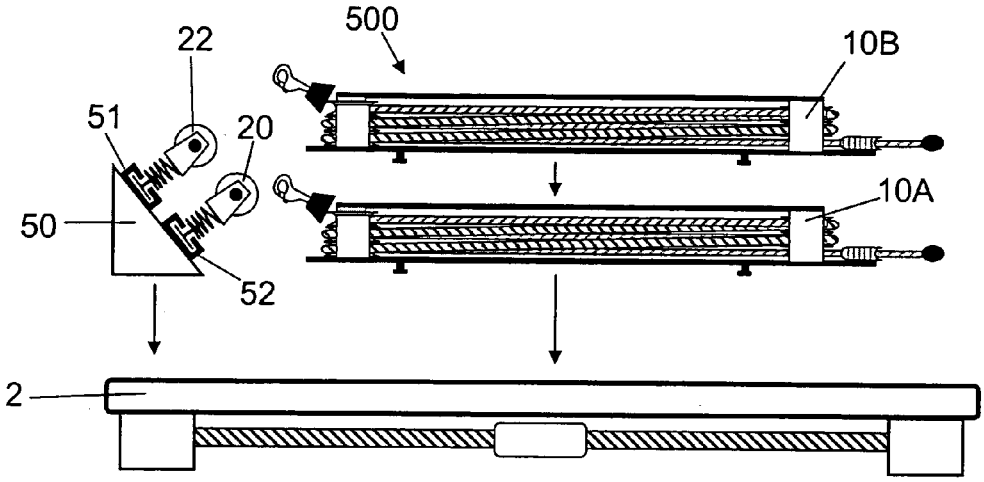
Figure 25 (Side View)
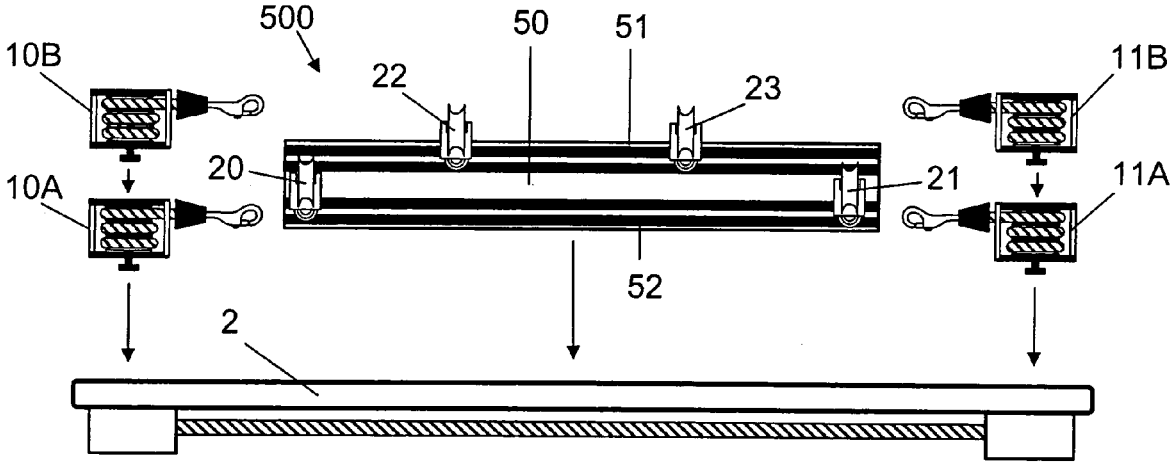
Figure 26 (Front View)

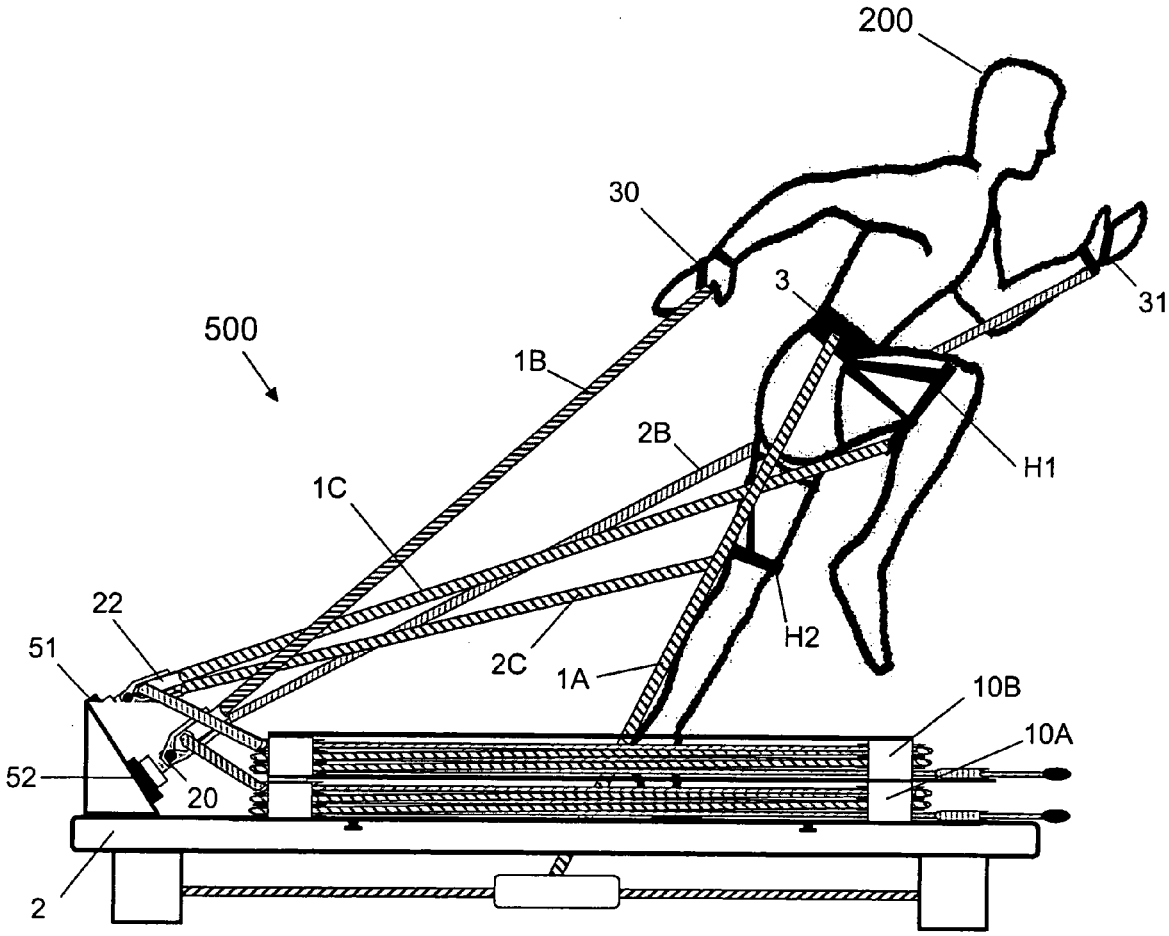
Figure 27 (Side View)

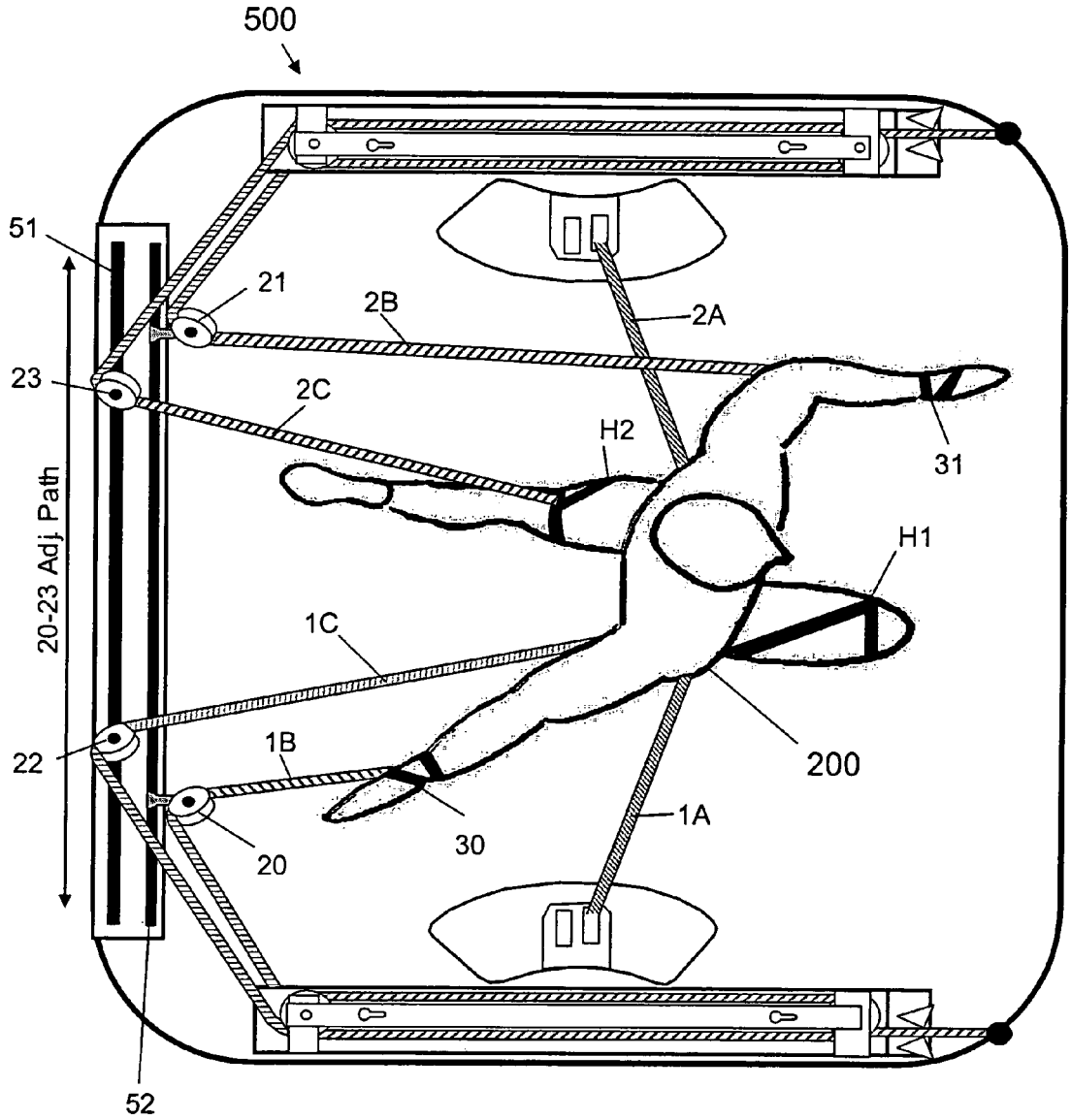
Figure 28 (Top View)

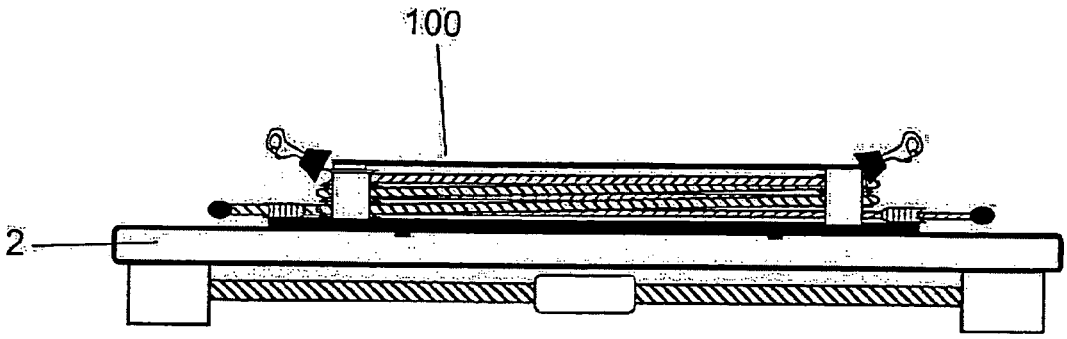
FIGURE 68 (Side View)
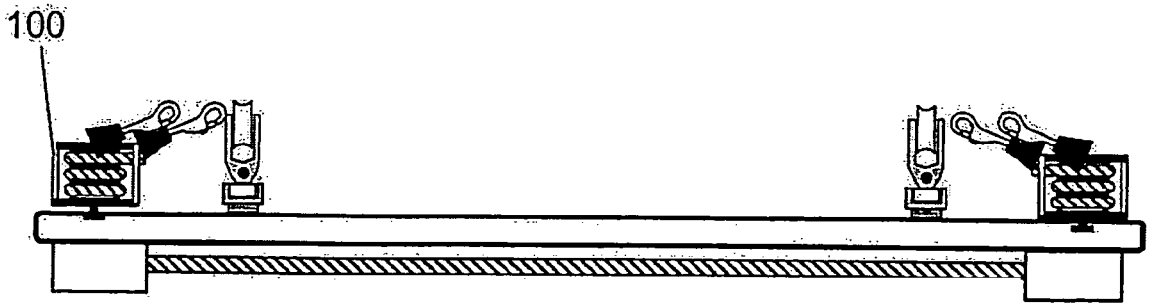
FIGURE 69 (Front View)

Figure 82 – V8 Physical Therapy Configuration

Slideable Pulley Assemblies A-D slide/lock on Fixed Tracks
Slidable Tracks 1 and 2 slide/lock on Fixed Tracks Figure 83 – V8 Physical Therapy Configuration Figure 84 – V8 Physical Therapy Configuration Figure 85 – V8 Physical Therapy Configuration Figure 86 – V8 Physical Therapy Configuration – Light Hand Resistance

Figure 87 – V8 Sport Configuration

Slideable Pulley Assemblies A-D slide/lock on Fixed Tracks – Each pulley assembly slidably remains on its respective fixed track.

Figure 88 – V8 Sport Configuration

Figure 89 – V8 Sport Configuration

PHYSICAL TRAINING APPARATUS AND METHOD

CLAIM OF PRIORITY

This application claims the priority of U.S. Provisional Patent Application No. 60/487,227 filed Jul. 16, 2003.

RELATED APPLICATIONS

This application is related to U.S. patent application Ser. No. 10/892,196 entitled "Swing Training Apparatus And Method" filed Jul. 16, 2004, by the inventor hereof, the contents of which is incorporated by reference herein.

BACKGROUND OF THE INVENTION

The present invention relates to a physical training apparatus and method for training persons such as athletes or physical therapy patients to improve various motor skills. More particularly, it relates to a physical training apparatus and method for providing forces of either constant or varying magnitude opposing the motion of a single or multiple points on the body of the trainee while performing slow or high speed movements.

Physical training and conditioning have long been recognized as desirable for improving various motor skills to thereby improve the performance of an athlete, the rehabilitation of a physical therapy patient, or the overall physical well-being of the trainee. Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

For example, if an athlete wants to run faster it has been found to be more beneficial to apply light resistance to the leg muscles while running than by performing a press with the legs with heavy weights. Both of these training methods will strengthen the leg muscles of the athlete, however, the high-speed training by providing light resistance while running allows the athlete to generate more power at high speeds since the muscle is conditioned with resistance at high speeds. Training the muscles using slow movement with resistance promotes power generation at slow speeds since the muscle is conditioned at slow speeds. Both training methods are important to most athletes. However, for athletic performance optimization at high speeds the muscles must be physically and neurologically trained at high speeds. The term "training vector" as used herein shall mean a force opposing the motion of a portion of a trainee through a predetermined range of motion. The magnitude and direction of a training vector may be relatively constant or may vary through the predetermined range of motion.

U.S. Pat. Nos. 4,968,028 and 4,863,163 entitled "Vertical Jump Exercise Apparatus" issued to the inventor of the present invention each disclose resistance training apparatus for vertical jump training and conditioning. The prior art system disclosed in the Wehrell patents illustrated in FIG. 1 through FIG. 6, applies two training vectors having relatively constant magnitude to the hips of the trainee (see FIG. 1 through FIG. 4 showing training vectors 1A and 2A) for applying resistance to the legs while performing the jumping motion.

A later modification of the exercise apparatus disclosed in the Wehrell patents is shown in FIG. 5 and FIG. 6. In this embodiment, the training vectors 1B and 2B provide relatively constant resistance to the back of the knees of a trainee performing a running motion by attaching the elastic members of the exercise apparatus to detachable leg harnesses 1 worn by the trainee. This embodiment provided resistance for training the hip flexors of the trainee at high speeds.

Many sports related movements involve multiple muscle groups moving multiple body parts simultaneously to perform the specific movement. For example, when an athlete jumps he or she uses the legs, back and arms simultaneously. To optimize training for a particular movement it is beneficial to train using a natural jumping motion while applying resistance to the legs, back and arms simultaneously. Such an exercise method would be more effective methods where resistance is only applied to the legs because it allows major muscle groups used in jumping to be fired in the proper neurological sequence with applied resistance.

While it was possible in the embodiment of the prior art exercise apparatus shown in FIG. 5 and FIG. 6 to apply the training vectors 1A and 2A as well as 1B and 2B to the trainee performing a running motion, there remains a need for a physical training apparatus that applies training vectors to the hands and other points on the trainee's body for providing resistance to multiple muscle groups while performing complex sports specific movements such as jumping and running.

Accordingly, it is an object of the present invention to obviate many of the deficiencies in the prior art and to provide a novel physical training apparatus and method.

It is another object of the present invention to provide a novel physical training apparatus and method for providing training vectors of relatively constant magnitude to the hands of a trainee.

It is still another object of the present invention to provide a novel physical training apparatus and method for providing training vectors to multiple muscle groups of a trainee.

It is yet another object of the present invention to provide a novel physical training apparatus and method for providing training vectors to the hands of a trainee in combination with providing training vectors to the thighs or hips of the trainee.

It is another object of the present invention to provide a novel physical training apparatus and method for providing at least six training vectors to a trainee.

It is still another object of the present invention to provide a novel physical training apparatus and method for providing multiple training vectors to a trainee wherein two or more of the training vectors originate at different elevations above the surface supporting the trainee.

It is a further object of the present invention to provide a novel physical training apparatus and method for providing a training vector to a trainee wherein the origin of the training vector is variable in three dimensions.

It is yet a further object of the present invention to provide a novel physical training apparatus and method for providing a training vector using modules.

It is still a further object of the present invention to provide a novel physical training apparatus and method wherein a modular change of the magnitude of a training vector may be achieved.

It is an additional object of the present invention to provide a novel physical training apparatus and method for providing multiple training vectors of relatively constant magnitude.

It is yet an additional object of the present invention to provide a novel

It is still an additional object of the present invention to provide a novel It is a further additional object of the present invention to provide a novel These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIG. 1 is a front view of a prior art exercise apparatus with a user in a standing position showing a restraining means providing a specified resistance with reference to the user.

FIG. 2 is a top plan view of the prior art exercise apparatus of FIG. 1.

FIG. 5 is a top plan view of a prior art exercise apparatus with a user performing a running motion showing a restraining means providing a specified resistance with reference to the user.

FIG. 6 is a side view of the prior art exercise apparatus of FIG. 5.

FIG. 25 is a side view of another embodiment of the present invention for providing at least six training vectors showing training modules, pulley assemblies and a base.

FIG. 26 is a front view of the embodiment of FIG. 25.

FIG. 27 is a side view of an embodiment of the present invention with a user performing a running motion showing a restraining means providing at least six training vectors to the user.

FIG. 28 is a top plan view of the embodiment of FIG. 27.

FIG. 68 is a side view of an alternative embodiment of the present invention depicting multiple pulley assemblies for providing multiple training vectors originating from in front of and behind a user.

FIG. 69 is a front view of the embodiment of FIG. 68.

DESCRIPTION OF PREFERRED EMBODIMENTS

Figure 3:
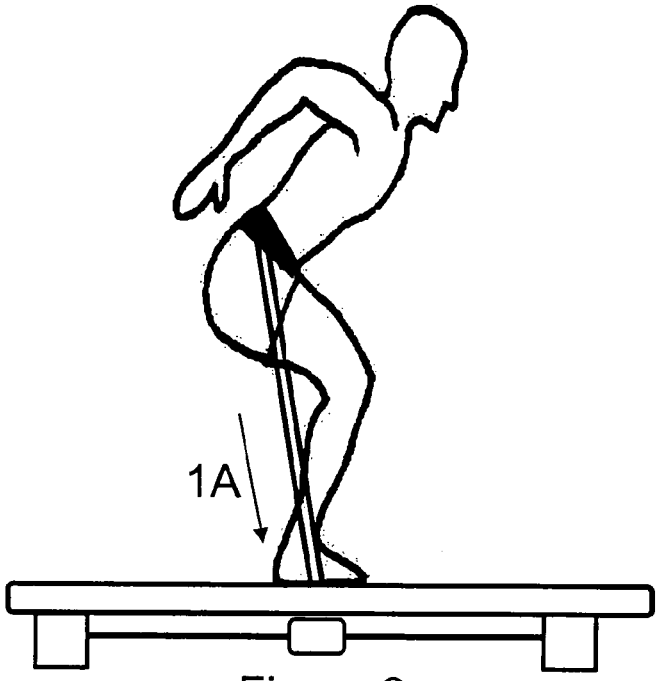
Figure 3 PRIOR ART
FIG. 3 is a side view of the prior art exercise apparatus of FIG. 1 with the user preparing to jump, showing the restraining means providing a specified resistance in a retracted position with reference to the user.
Figure 4:
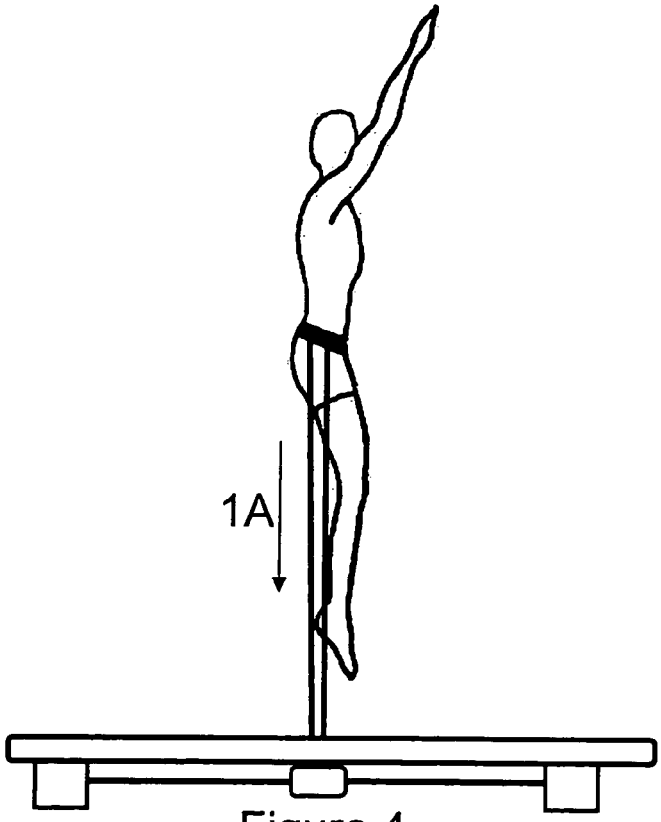
Figure 4 PRIOR ART
FIG. 4 is a side view of the prior art exercise apparatus of FIG. 1 with the user at the peak of a jump, showing the restraining means in an extended position.
Figure 7:
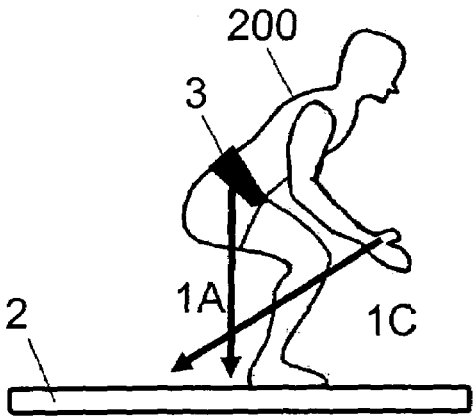
FIG. 7 is an illustration of the training vectors associated with an embodiment of the present invention showing a user preparing to jump.
Figure 8:
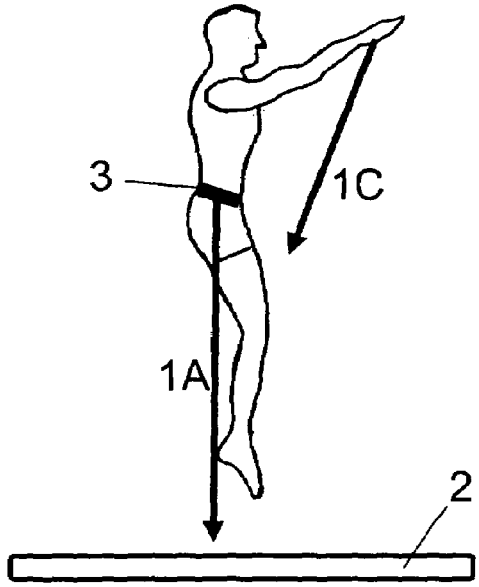
FIG. 8 is an illustration of the training vectors associated with an embodiment of the present invention showing a user at the peak of a jump.
Figure 9:
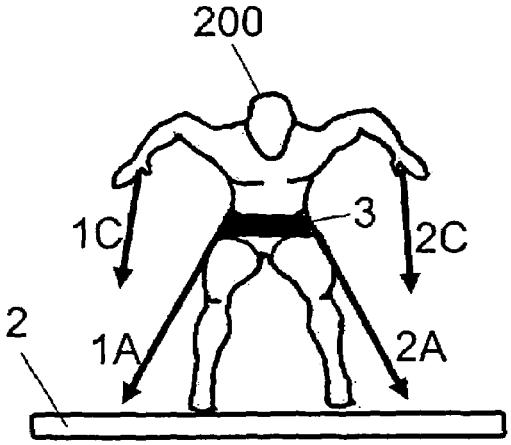
FIG. 9 is a front view of the embodiment of FIG. 7.
Figure 10:
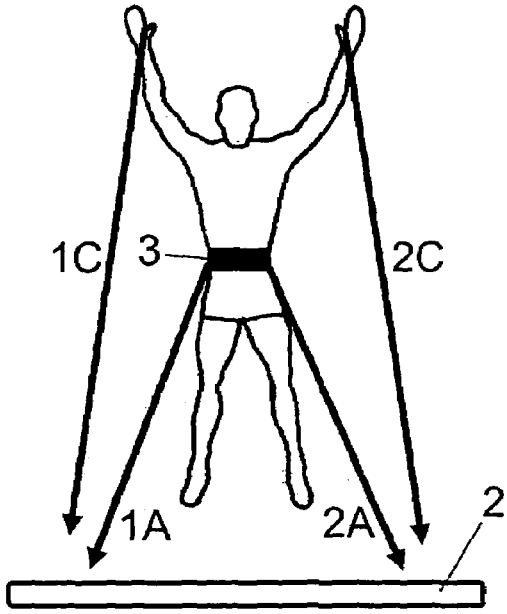
FIG. 10 is a front view of the embodiment of FIG. 8.
Figure 11:
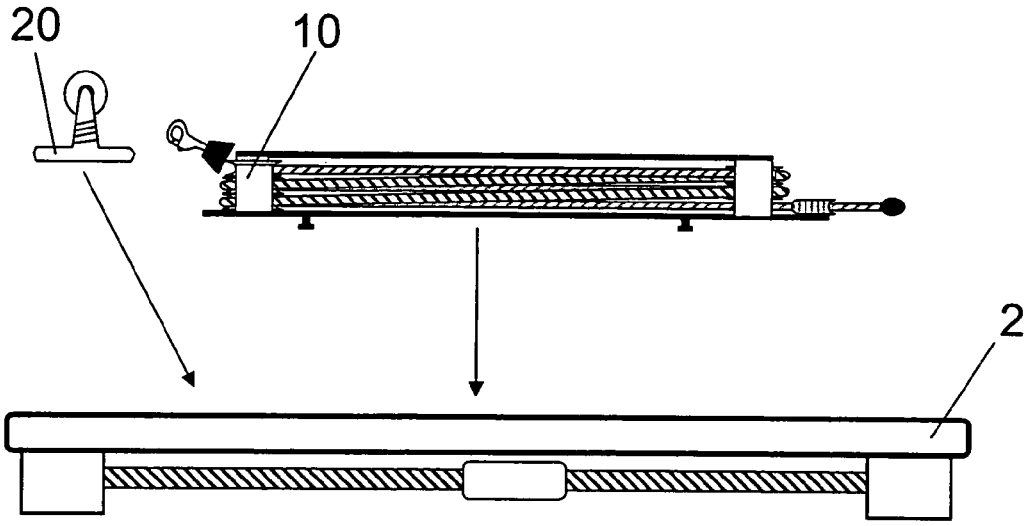
FIG. 11 is a side view of one embodiment of the present invention showing a training module, pulley assembly and base.

With reference to the figures where like elements have been given like numerical designations to facilitate an understanding of the present invention, the various embodiments of the physical training apparatus of the present invention are described.

According to one aspect of the present invention, a physical training apparatus and method are provided for providing multiple training vectors to a trainee while performing various athletic or therapeutic movements such as jumping, running or walking. The physical training apparatus may provide up to six or more training vectors so that multiple muscle groups of the trainee may be trained simultaneously. FIGS. 7-10 illustrate side and front views of one embodiment of the physical training apparatus for providing training vectors to the hands and hips during vertical jump training. With reference to FIGS. 7-10, the physical training apparatus comprises a jumping platform or base 2 and means (not shown) for applying the training vectors 1A and 2A to the hips of the trainee 200 and the training vectors 1C and 2C to the hands or wrists of the trainee 200. The training vectors 1A and 2A apply resistance to the legs of the trainee by applying resistance to the harness 3 worn around the waist of the trainee while the training vectors 1C and 2C apply resistance to the arms, shoulders and lower back by applying resistance to a harness (not shown) worn on the hands or wrists of the trainee. As illustrated in FIGS. 7-10, the physical training apparatus according to this aspect of the present invention applies resistance to the legs, back and arms of the trainee simultaneously while performing the vertical jumping motion. The physical training apparatus of the present invention provides a more efficient jump training system than the exercise apparatus disclosed in the prior Wehrell patents an further embodiments thereof because it stresses, in addition to the legs, several important muscle groups affecting the vertical jump performance of a trainee, i.e., the back, shoulders, and arms.

FIGS. 11, 12, 13 and 14 illustrate one embodiment of the physical training apparatus according to the present invention for providing at least four training vectors to a trainee. With reference to FIGS. 11-14, the training modules 10,11 and pulley assemblies 20,21 may be removably attached to the base 2 of the physical training apparatus. The training modules 10,11 each include an elastic member 12,13 having a connector 32,33 attached at one end. The elastic members 12,13 are routed between a series of tracking mechanisms such as pulleys to an anchor (not shown) attached to the module 10,11 or the base 2. The elastic members 12,13 have a length whereby the magnitude of the training vector provided by each elastic member 12,13 is relatively constant through the range of motion of the hands of the trainee performing vertical jump training. The elastic members 12,13 are routed through the pulley assemblies 20,21 which provide the point of origin for the training vectors provided by the elastic members 12,13. The pulley assemblies 20,21 may rotate 360 degrees and tilt +/−90 degrees in any direction so that the elastic members 12,13 track smoothly on the pulley assemblies through the entire range of motion of the hands of the trainee. The connectors 32,33 attached to the respective elastic members 12,13 may be connected to harnesses 30,31 that may be worn on the hands or wrists of the trainee 200.

Figure 14:
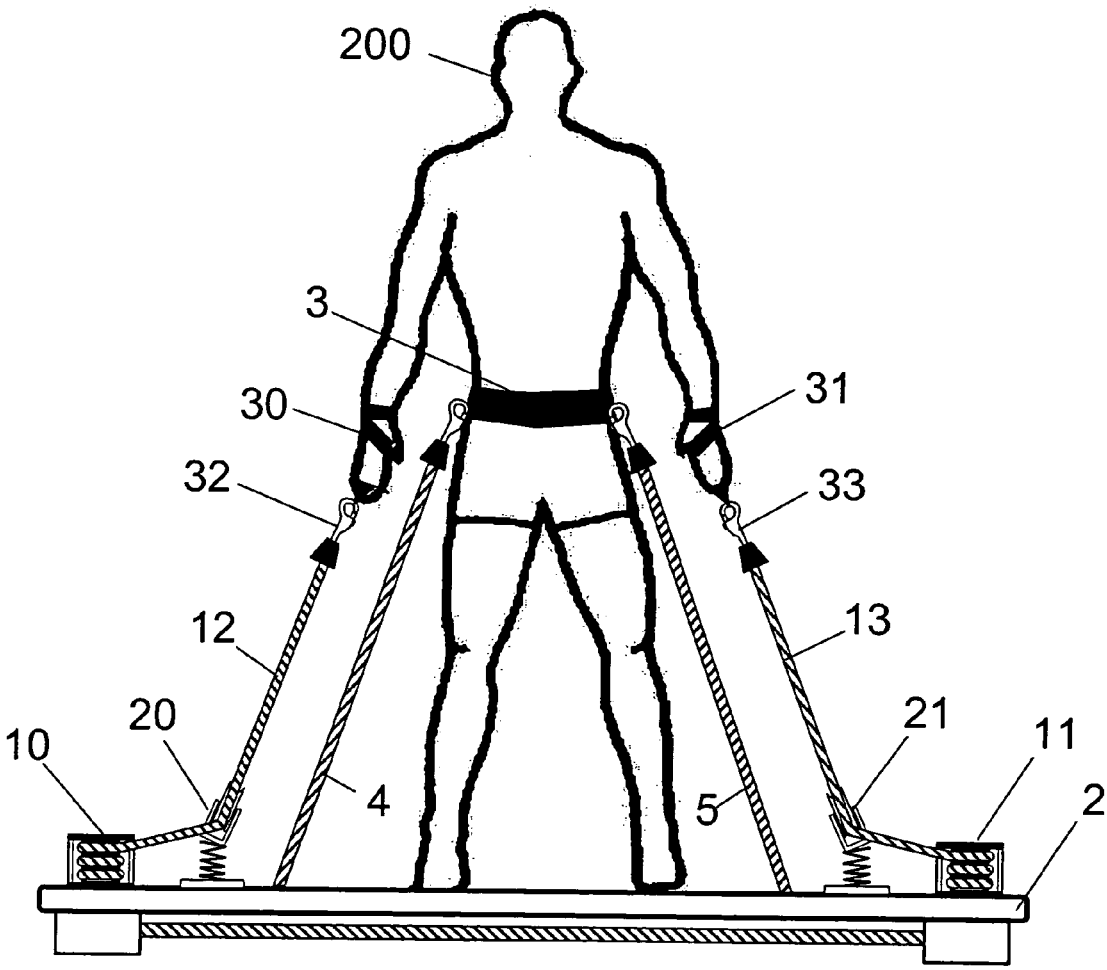
FIG. 14 is a front view of one embodiment of the present invention with a user in a standing position showing the restraining means for providing at least four training vectors to the user.

Further as illustrated in FIG. 14, training vectors may be provided to the hips of the trainee by elastic members 4,5 as disclosed in the prior Wehrell patents. The elastic members 4,5 may be attached to a harness 3 worn around the waist by the trainee 200.

Figure 12:
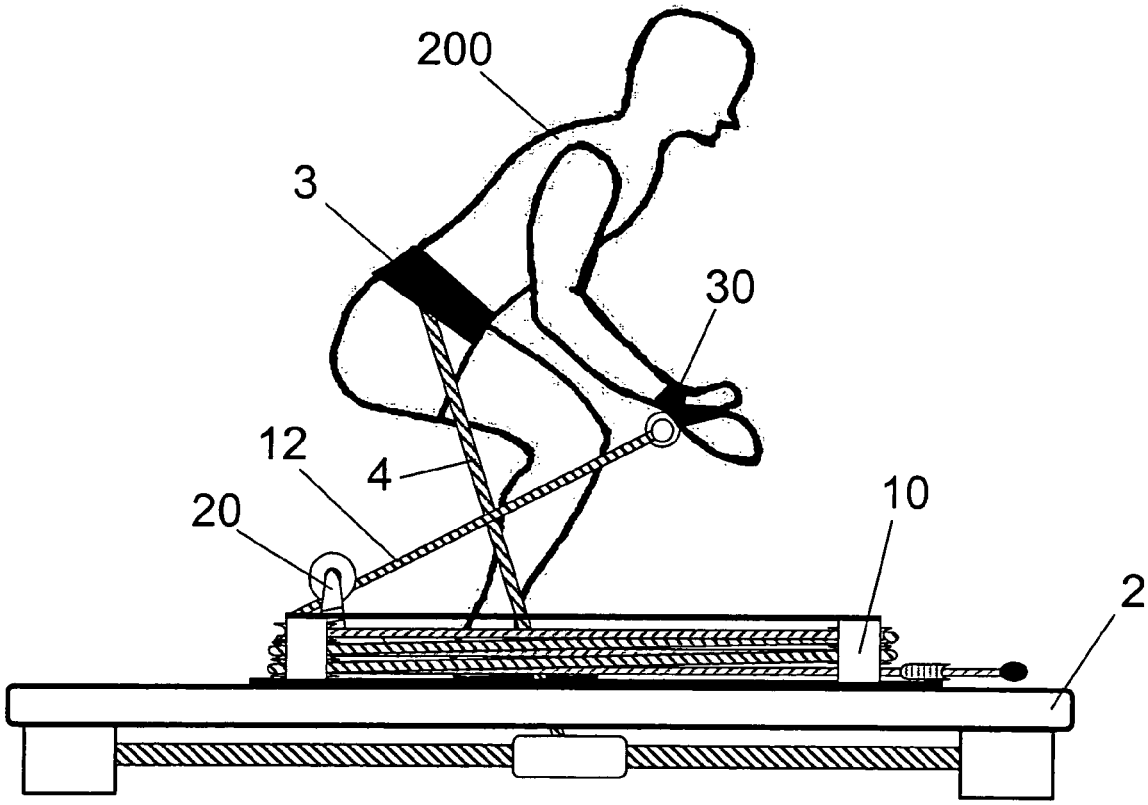
FIG. 12 is a side view of one embodiment of the present invention with a user preparing to jump showing the restraining means for providing at least four training vectors to the user.
Figure 13:
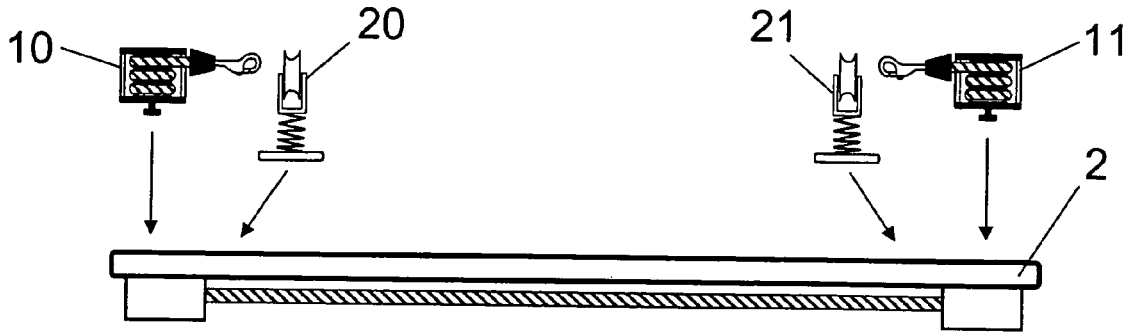
FIG. 13 is a front view of the embodiment of FIG. 11.
Figure 15:
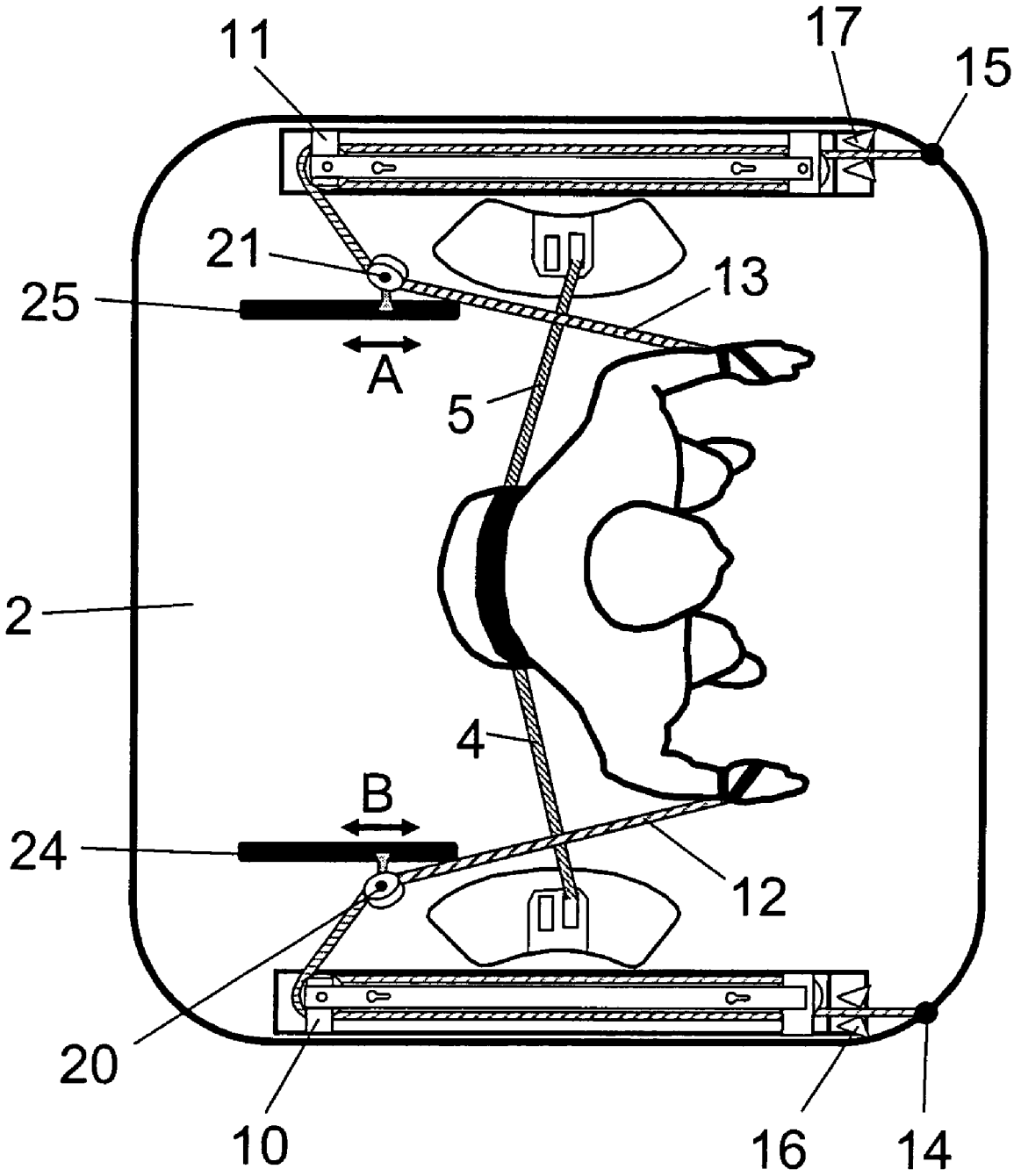
FIG. 15 is a top plan view of the embodiment shown in FIGS. 12 and 14 with a user in a crouched position showing the restraining means for providing at least four training vectors to the user.
Figure 16:
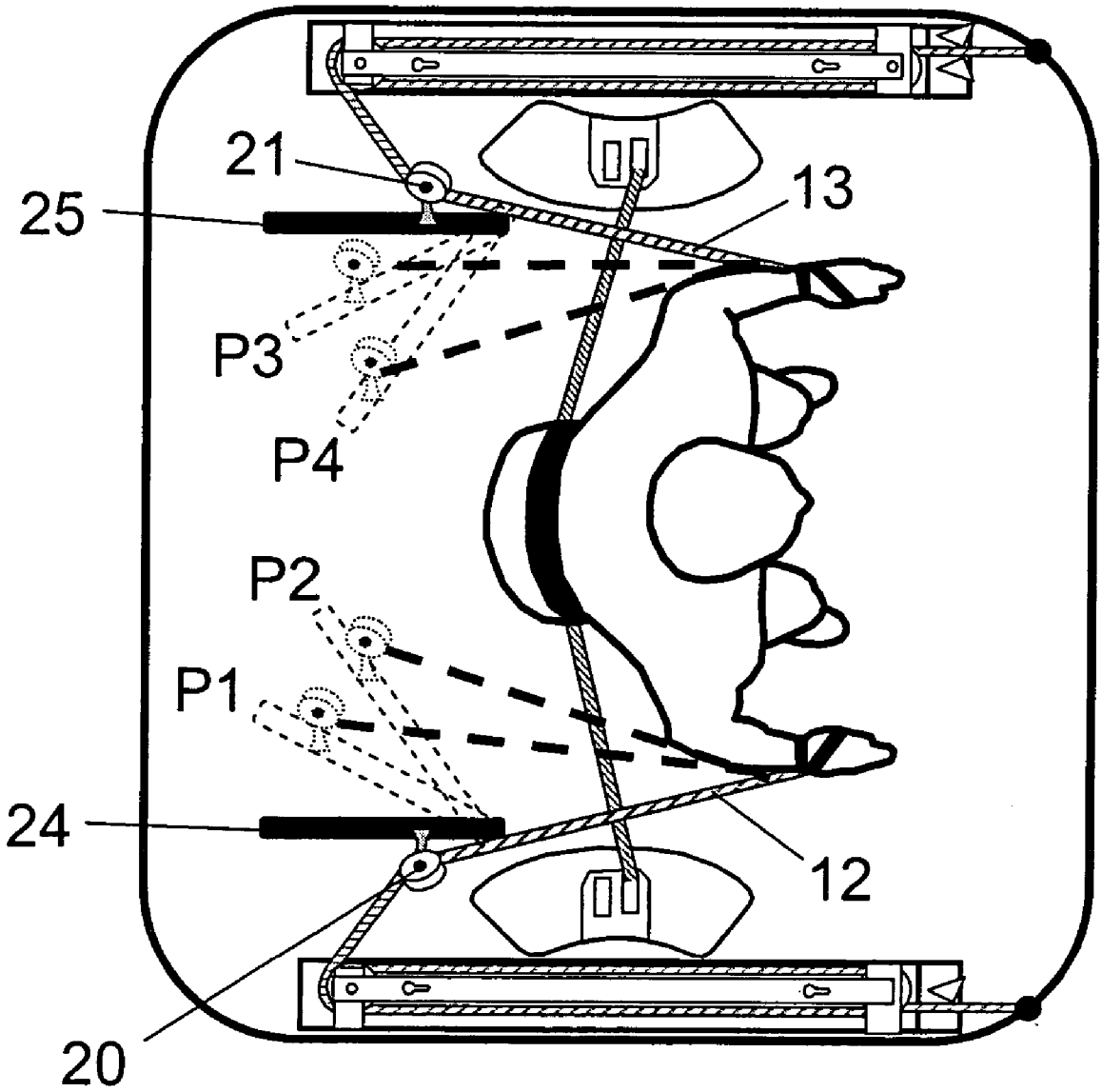
FIG. 16 is a top plan view of another embodiment of the present invention illustrating various positions of the rail assemblies thereby varying the training vectors provided to the hands of a user.

FIG. 15 illustrates a top view of the physical training apparatus shown in FIGS. 12 and 14. The pulley assemblies 20,21 may be fixed on the upper surface of the base 2 or have a flanged base allowing their position to be set anywhere along a rail assembly 24,25 as illustrated by arrows A and B. Thus the point of origin of the training vectors may be moved along the rails 24,25. FIG. 16 illustrates yet another embodiment wherein the rail assemblies 24,25 may be positioned at various angles relative to the modules 10,11 as shown by positions referenced P1, P2 and P3, P4. Thus the origin of the training vectors from modules 10,11 provided to the hands of the trainee 200 may be varied in two dimensions along the training surface provided by the base 2.

The elastic members 12,13 have ends 14,15 that may be extracted through the anchors 16,17 respectfully so that the magnitude of the training vectors provided thereby may be selectively increased by shortening the effective length of the elastic members 12,13. Alternatively, the magnitude of the training vectors may be decreased by increasing the effective length of the elastic members 12,13 by releasing the anchors 16, 17 and allowing the members to retract into the modules 10,11 respectfully. The anchors 16,17 may comprise any means suitable for securing the elastic members such as cleats or cam cleats. The "effective" length of the elastic members is the length of the elastic member between the anchor and the end of the member attached to a harness connector.

Figure 17:
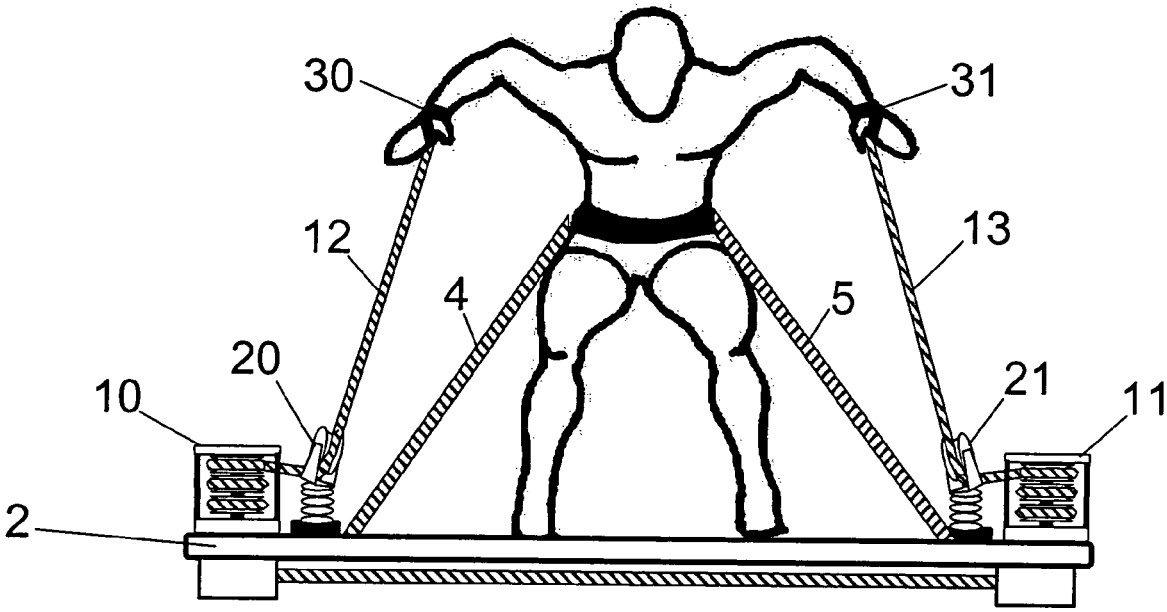
FIG. 17 is a front view of an embodiment of the present invention with a user in a crouched position showing the restraining means in a retracted position.
Figure 18:
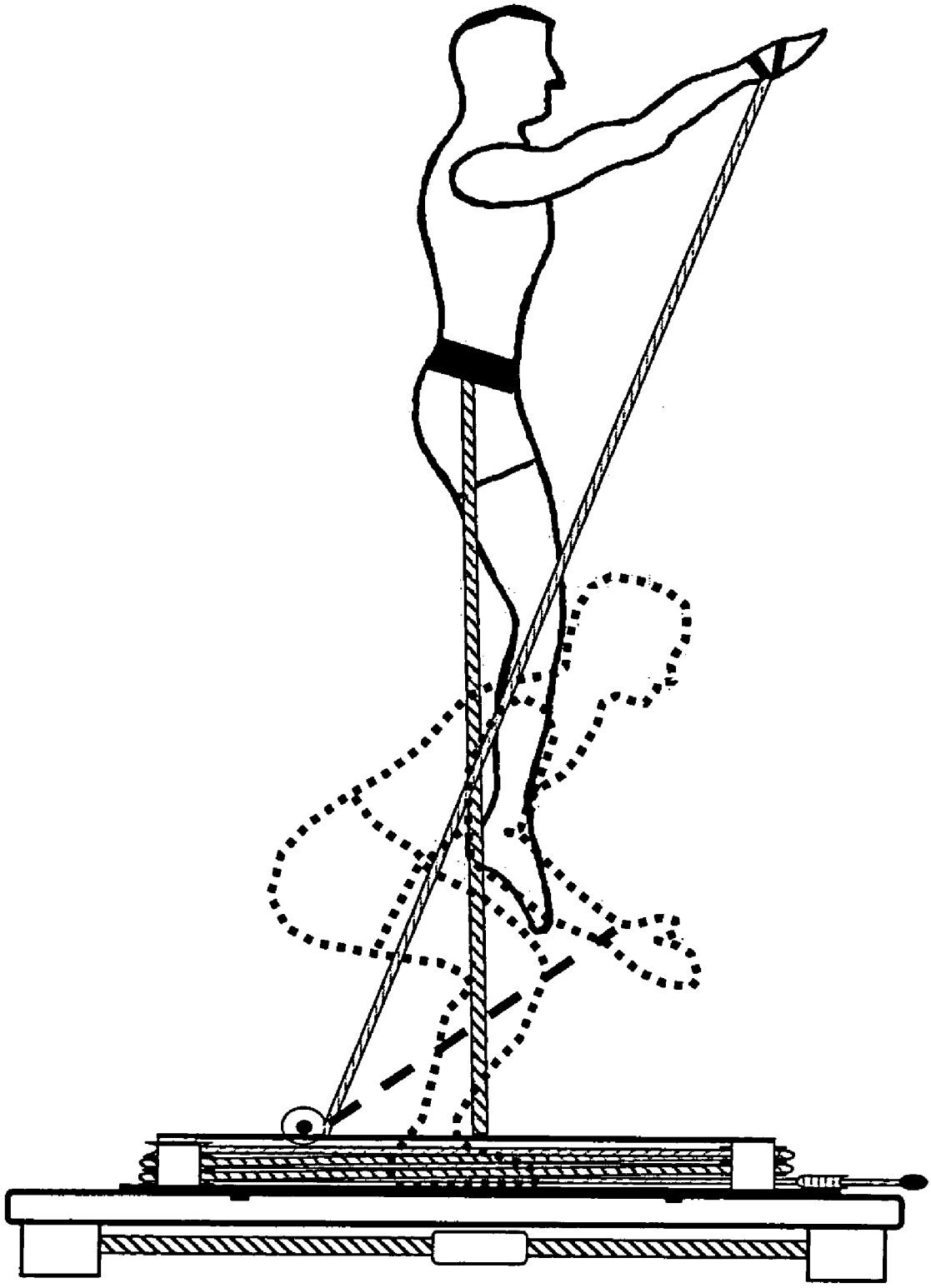
FIG. 18 is a side view of an embodiment of the present invention with a user at the peak of a jump showing the restraining means in an extended position.

FIG. 17 shows a front view of a trainee 200 in a crouched position preparing to perform a vertical jump. FIG. 18 shows the trainee 200 in an extended position. The physical training apparatus provides training vectors to the hips and hands of the trainee through the entire range of motion of the trainee performing vertical jump training. The physical training apparatus as illustrated thus provides resistance to the legs, back, shoulders, and arms during the jump training.

Figure 19:
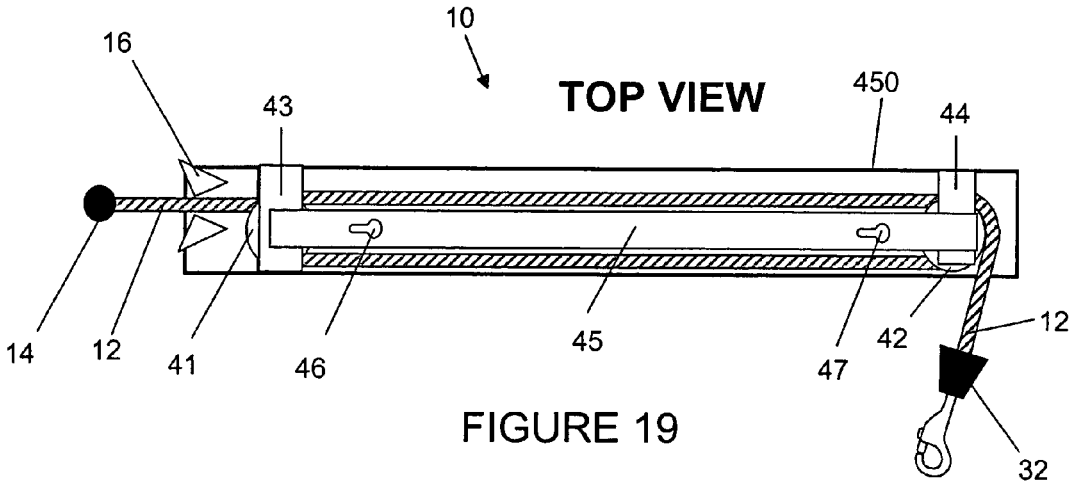
FIG. 19 is a top plan view of a training module of the present invention.
Figure 20:
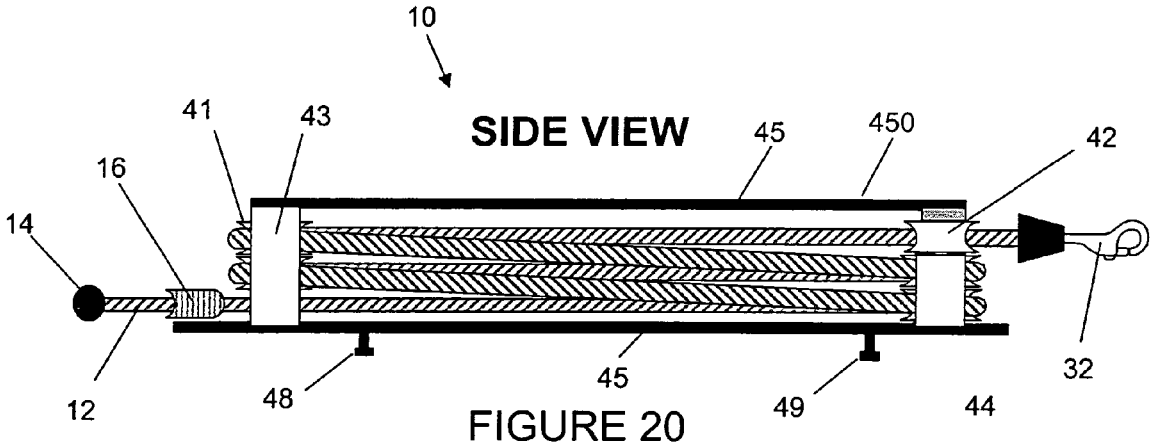
FIG. 20 is a side view of the training module of FIG. 19.

FIG. 19 and FIG. 20 illustrate the top and side views of the training module 10. With reference to FIG. 19 and FIG. 20, the training module 10 comprises a rigid frame 450 that carries two stacked pulley assemblies 41,42. Each of the stacked pulley assemblies includes one or more stacked pulleys. The rigid frame 450 includes upper and lower elongated members 45 and pulley assembly mounting members 43,44. A suitable anchor 16 such as a cam cleat is mounted on the lower elongated member 45. The spaced pulley assemblies 41,42 provide a path for routing the elastic member 12 therebetween so that an elastic member many times the length of elongated members 45 may be contained within the training module 10. The elastic member 12 is secured near one end by the anchor 16 and is attached to a connector 32 at the other end. The effective length of the elastic member 10, i.e., the length of the member between the anchor 16 and the connector 32, may be selected by extracting the end 14 of the elastic member 12 from the module 10 and then securing the member 12 with the anchor 16. The magnitude of the training vector will vary with the effective length of the elastic member 12. The connector is adapted to be connected to a harness worn by the trainee. The elastic member 12 may have sufficient length so that the magnitude of the training vector provided to the trainee wearing the harness is relatively constant through the range of motion of the harness. A single module may also include two or more elastic members having different diameters for providing a wider range of resistive force.

Figure 21:
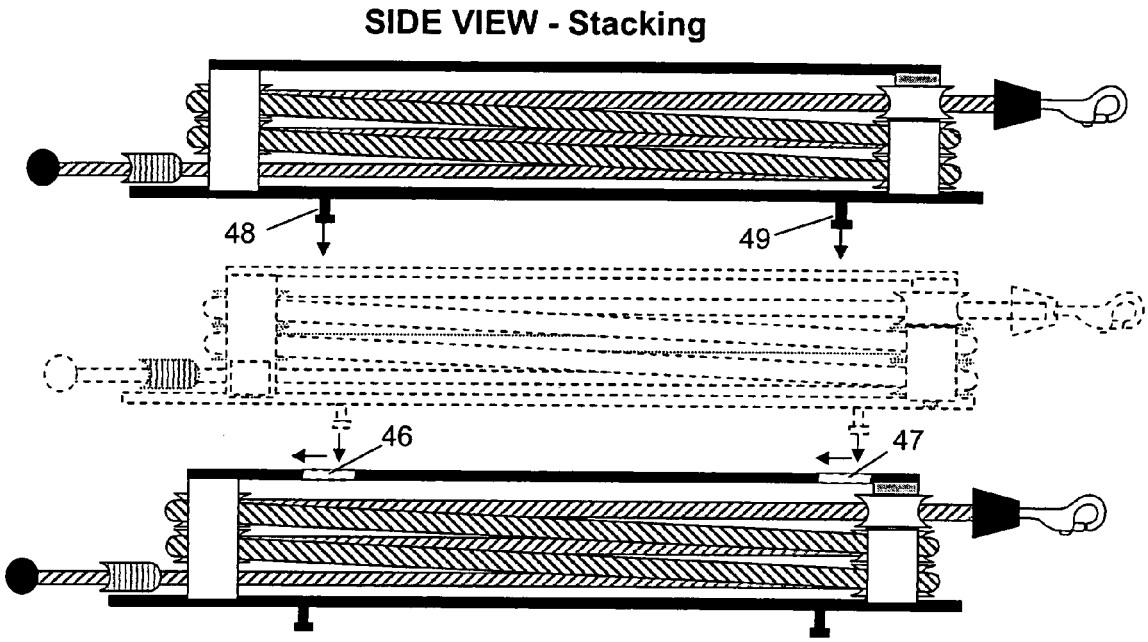
FIG. 21 is a pictorial depiction of a means of stacking at least two training modules of the present invention.
Figure 22:
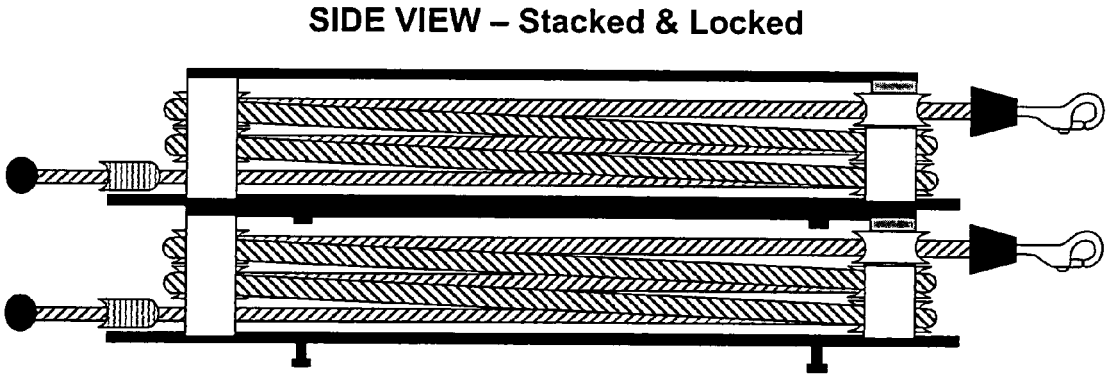
FIG. 22 is a side view of two training modules of the present invention vertically stacked and locked.

FIG. 21 and FIG. 22 illustrate one means of stacking a plurality of training modules. In this embodiment, the upper elongated member 45 includes keyways 46,47 that are adapted to receive the pegs 48,49 extending from the lower elongated member of another module. By inserting and locking the pegs of one module into the keyways of another module, the modules may be securely stacked to provide additional training vectors in the physical training apparatus. The elastic members from each module may also be connected to the same harness or serially connected to each other. The elastic members from each module may be the same or different diameters.

Figure 23:
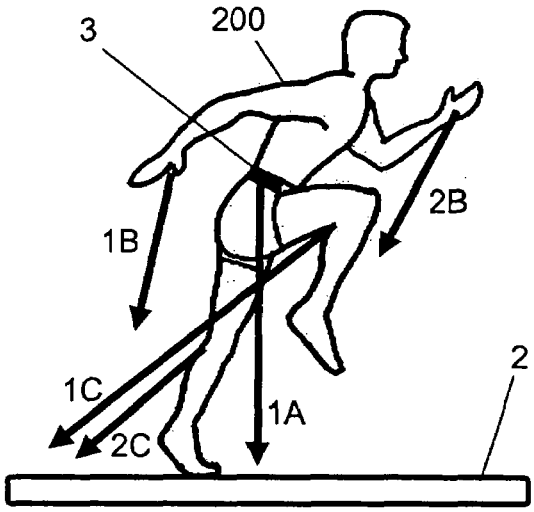
FIG. 23 is an illustration of the training vectors associated with another embodiment of the present invention showing a side view of a user in a running position.
Figure 24:
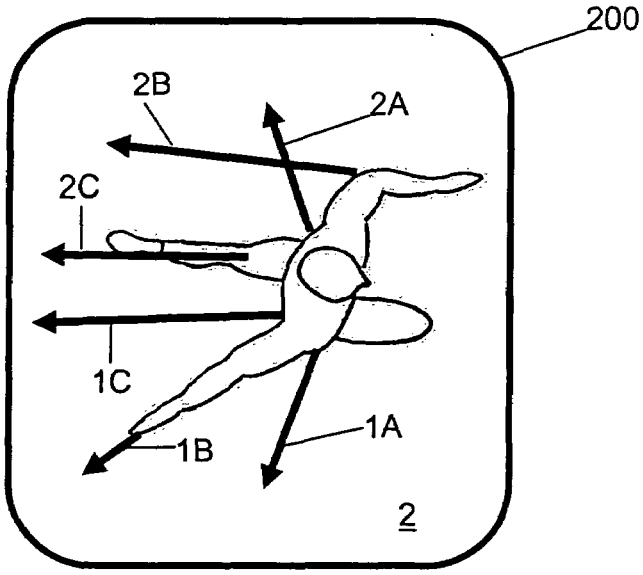
FIG. 24 is an illustration of the training vectors associated with another embodiment of the present invention showing a top plan view of a user in a running position.

FIG. 23 and FIG. 24 illustrate side and top views of another embodiment of the physical training apparatus according to the present invention for providing training vectors to the hands and hips and thighs during running training. With reference to FIGS. 23 and 24, the physical training apparatus comprises a platform or base 2 and means (not shown) for applying training vectors 1A and 2A to the hips of the trainee 200, training vectors 1B and 2B to the hands or wrists of the trainee 200, and training vectors 1C and 2C to the lower thighs or knees of the trainee 200. The training vectors 1A and 2A apply resistance to the quadriceps, buttocks, and calves of the trainee by applying resistance to the harness 3 worn around the waist of the trainee. The training vectors 1B and 2B apply resistance to the arms, shoulders and lower back by applying resistance to harnesses (not shown) worn on the hands or wrists of the trainee. The training vectors 1C and 2C apply resistance to the hip flexors by applying resistance to harnesses (not shown) worn around the lower thighs or knees of the trainee 200. As illustrated in FIG. 22 and FIG. 23, the physical training apparatus according to this aspect of the present invention applies resistance to the quadriceps, buttocks, hip flexors, calves, shoulders, back and arms of the trainee simultaneously while performing a running motion. The physical training apparatus of the present invention provides a more efficient run training system than the prior art because it stresses the multiple muscle groups affecting the running performance of a trainee.

FIGS. 25, 26, 27, 28, and 29 illustrate embodiments of the physical training apparatus according to the present invention for providing at least six training vectors to a trainee. With reference to FIGS. 25-29, the physical training apparatus 500 comprises the base 2 having an upper surface providing a physical training surface supporting the trainee 200. Elastic members 1A and 2A are each attached to the harness 3 worn around the waist of the trainee 200. Elastic members 1A and 2A may be directed away from the training surface by tracking means (not shown) as disclosed in the prior Wehrell patents.

Two sets of stacked training modules (10A & 10B and 11A & 11B) may be mounted on the upper surface of the base 2 along opposite sides of the base to provide a training area therebetween. The modules 10A, 11A include elastic members 1B,2B attached to the harnesses 30,31 that are worn on the hands or wrists of the trainee 200. The modules 10B, 11B include elastic members 1C,2C that are attached to the harnesses H1,H2 worn around the thighs and/or knees of the trainee 200.

The rail assembly 50 may be mounted to upper surface of the base 2 at the front or rear of the training area. In this embodiment for providing resistance to a trainee performing running training, the rail assembly 50 is mounted at the rear of the training area. The rail assembly 50 comprises a pair of rails 51,52 adapted to carry one or more pulley assemblies 20,21,22,23. The rails 51,52 are slotted so that the pulley assemblies 20-23 may be poisoned along the length of the rails. The pulley assemblies 20-23 may be locked in place by any suitable means such as spring loaded locking mechanisms (not shown).

The elastic member 1B extending from the training module 10A is routed through the pulley assembly 20 and then attached to the right hand of the trainee using the harness 30. The elastic member 2B extending from the training module 11A is routed through the pulley assembly 21 and then attached to the left hand of the trainee using the harness 31.

The elastic member 1C extending from the training module 10B is routed through the pulley assembly 22 and then attached to back of the right knee of the trainee using the harness H1. The elastic member 2C extending from the training module 11B is routed through the pulley assembly 23 and then attached to back of the right knee of the trainee using the harness H2. The pulley assemblies 20,21,22,23 provide the points of origin for the training vectors provided by elastic members 1B,1C,2B,2C.

Figure 29:
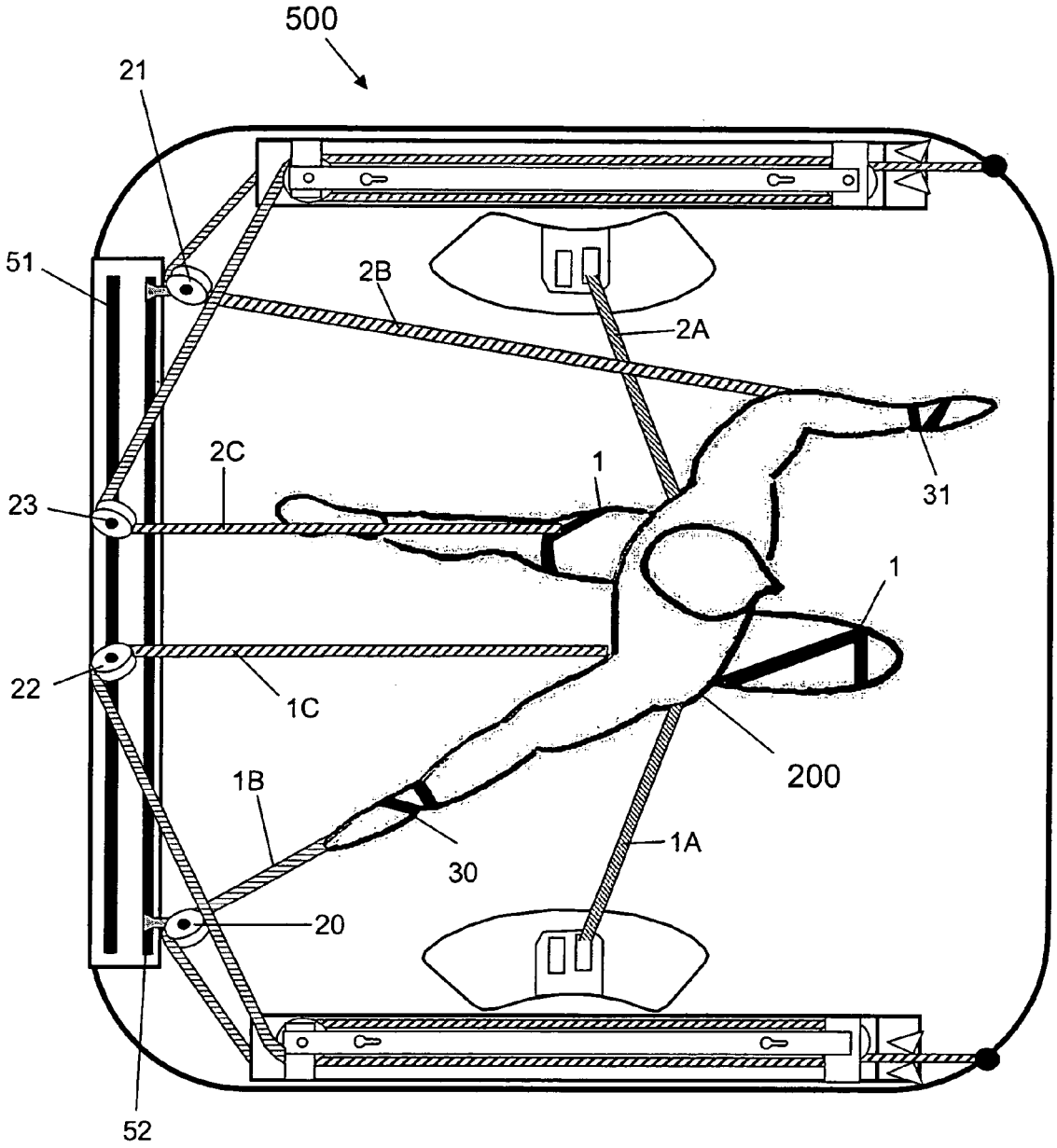
FIG. 29 is a top plan view of another embodiment of the present invention with a user performing a running motion showing a restraining means providing at least six training vectors to the user and showing alternate positions of pulley assemblies.
Figure 30:
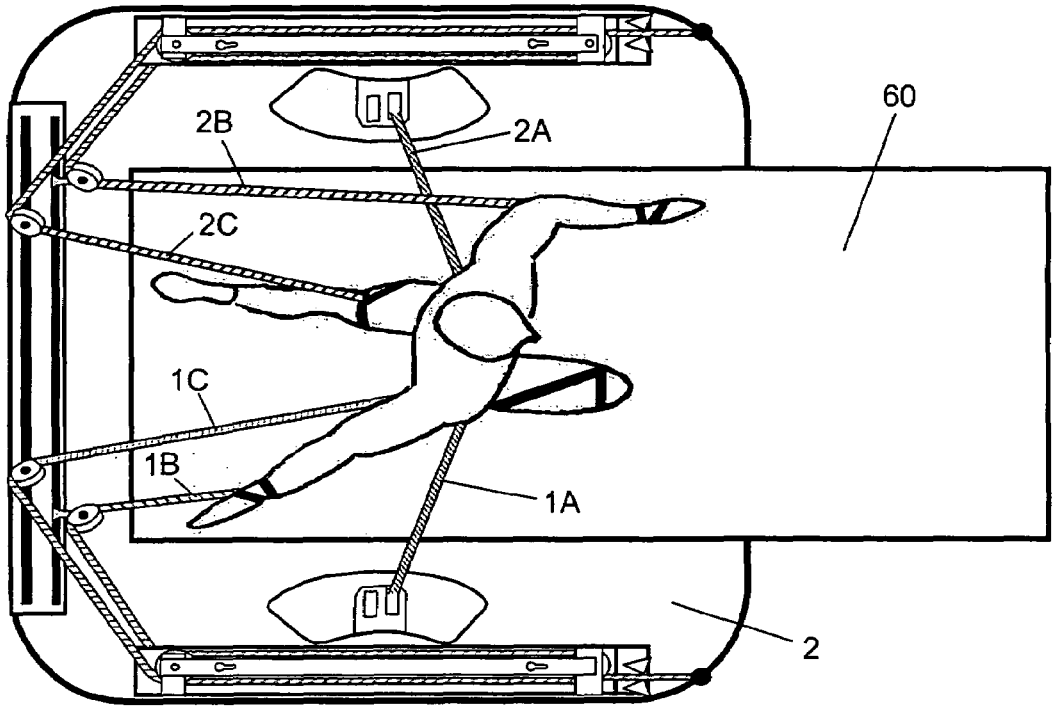
FIG. 30 is a top plan view of a further embodiment of the present invention combined with a treadmill for providing a user with at least six training vectors.

The adjustment path/options of pulley assemblies 20-23 on rails 51 and 52 are illustrated by the length of the arrow labeled 20-23 Adj. Path. FIG. 29 illustrates one of many alternate positions of pulley assemblies 20-23. The ease of adjustment of the position of the pulley assemblies allows the direction of the training vectors applied to the back of the knees and the hands to be varied to suit the trainee's specific needs.

FIGS. 30-35 illustrate embodiments of the physical training apparatus according to the present invention that include a treadmill running surface 60 so that the trainee may run on surface 60 while performing resistance running training. Running on a treadmill running surface provides a more natural running motion for the trainee compared to the running motion of a trainee on a fixed surface.

Figure 31:
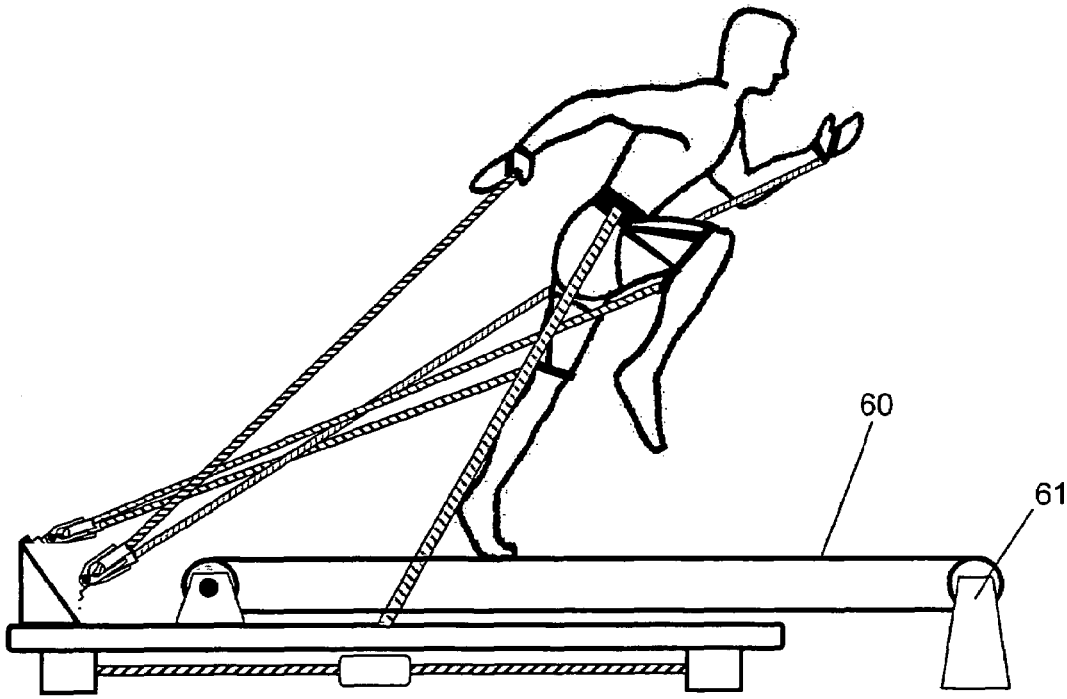
FIG. 31 is a side view of the embodiment of FIG. 30.
Figure 32:
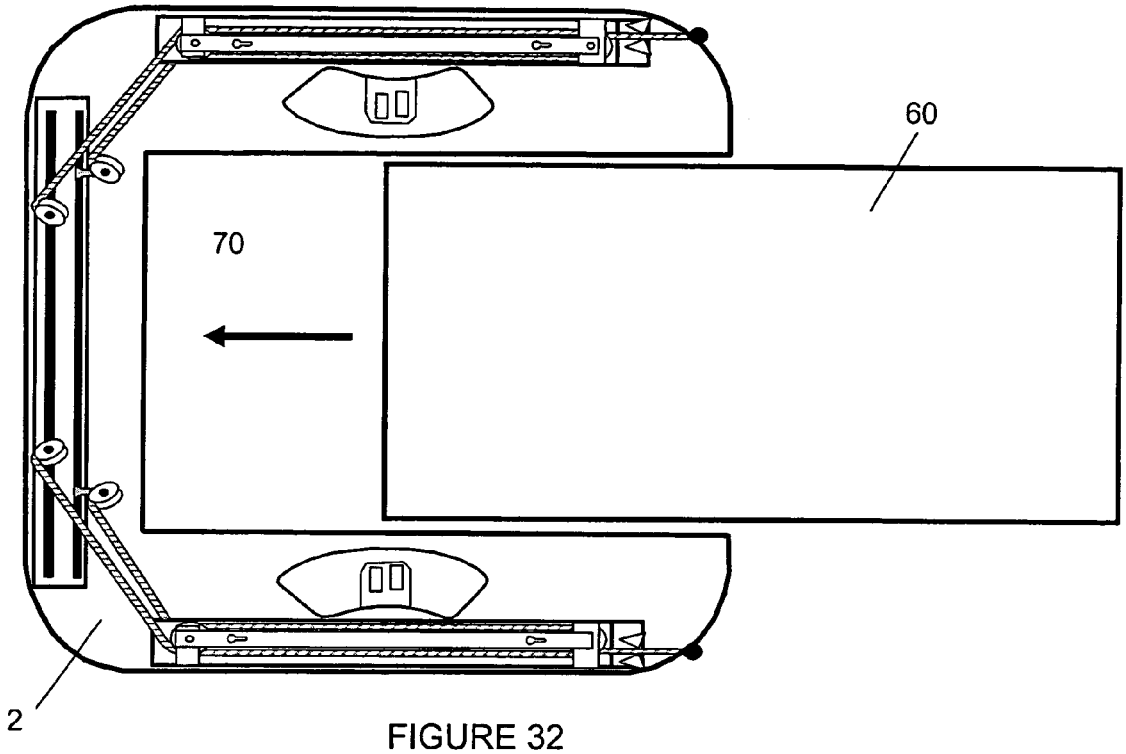
FIG. 32 is top plan view of another embodiment of the present invention combined with a treadmill.
Figure 33:
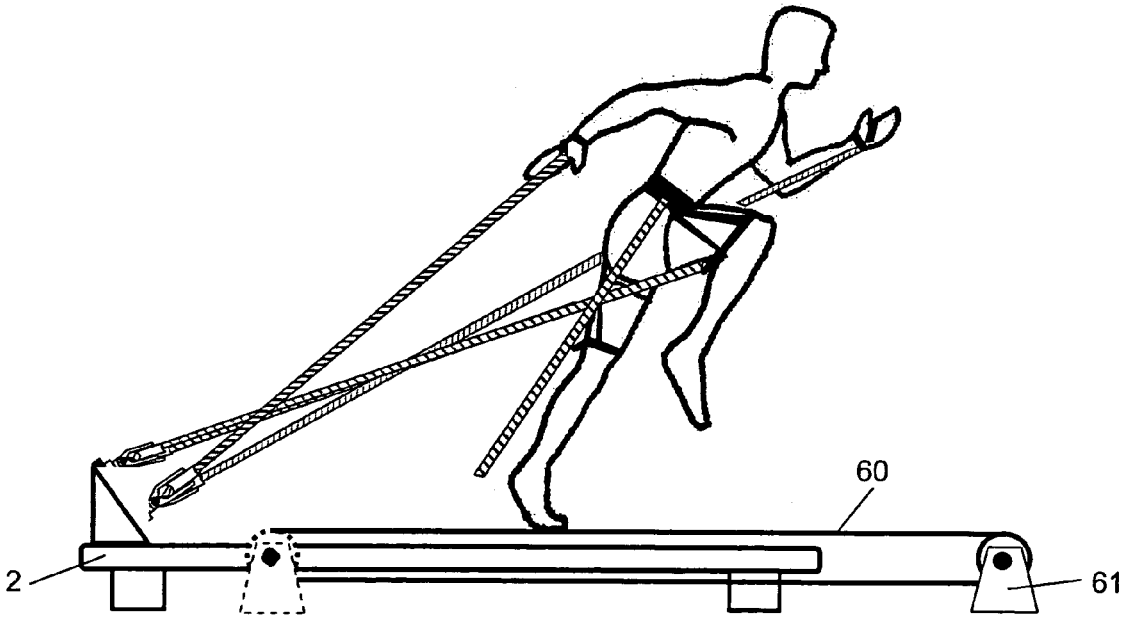
FIG. 33 is a side view of the embodiment of FIG. 32 with a user performing a running motion showing a restraining means providing at least six training vectors to the user.
Figure 34:
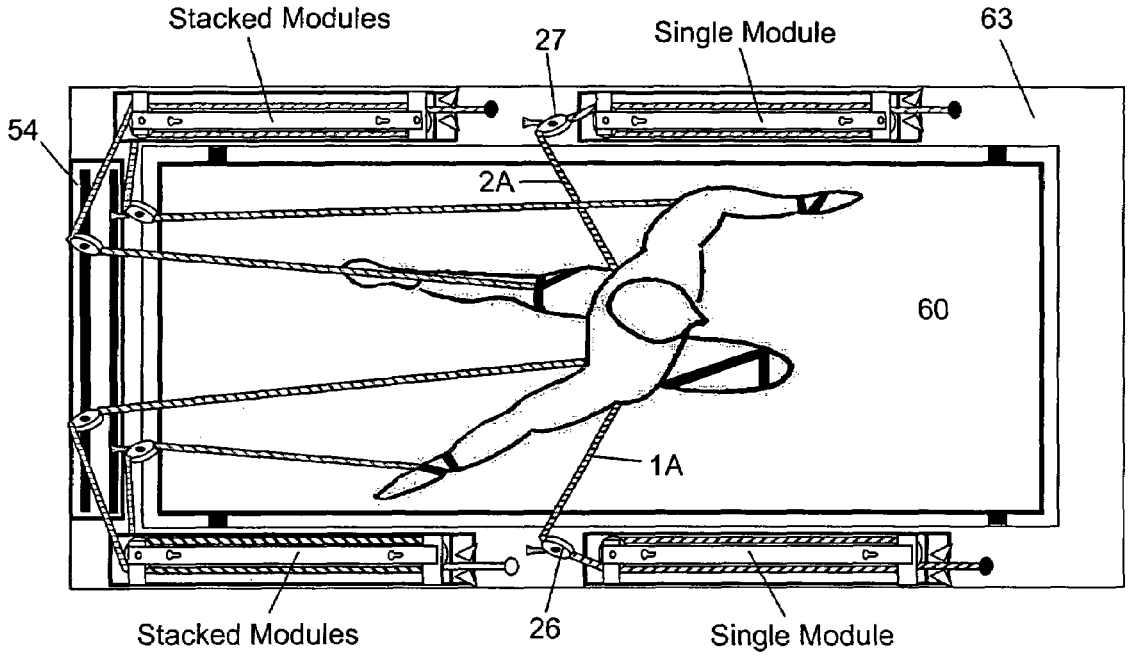
FIG. 34 is a top plan view of another embodiment of the present invention combined with a treadmill showing a user performing a running motion showing a restraining means providing at least six training vectors to the user.
Figure 35:
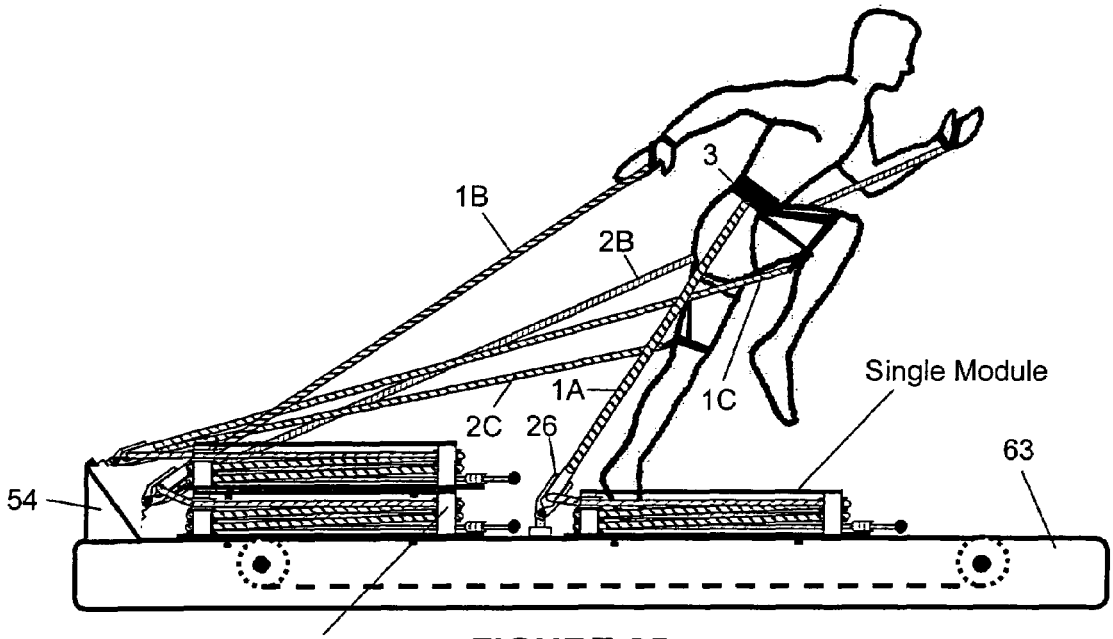
FIG. 35 is a side view of the embodiment of FIG. 34.

FIG. 31 shows a side view of a six training vector physical training apparatus combined with a treadmill 61 with moving surface 60. Note in FIG. 31 that the training modules 10A, 10B, 11A and 11B have been removed to facilitate viewing the treadmill modification. FIG. 32 and FIG. 33 illustrate another embodiment of the physical training apparatus wherein an area 70 is formed by removing a section of the base 2 so that the treadmill 61 can be positioned as illustrated. FIG. 34 and FIG. 35 illustrate yet another embodiment of the physical training apparatus wherein the training modules (stacked and single modules) and an adjustable pulley assembly 54 may be directly attached to any treadmill structure 63. Additional pulley assemblies 26 and 27 may be attached to structure 63 to route the elastic members bands 1A,2A to the waist. This embodiment allows the easy modification of standard commercial treadmills to include up to six or more training vectors.

Figure 36:
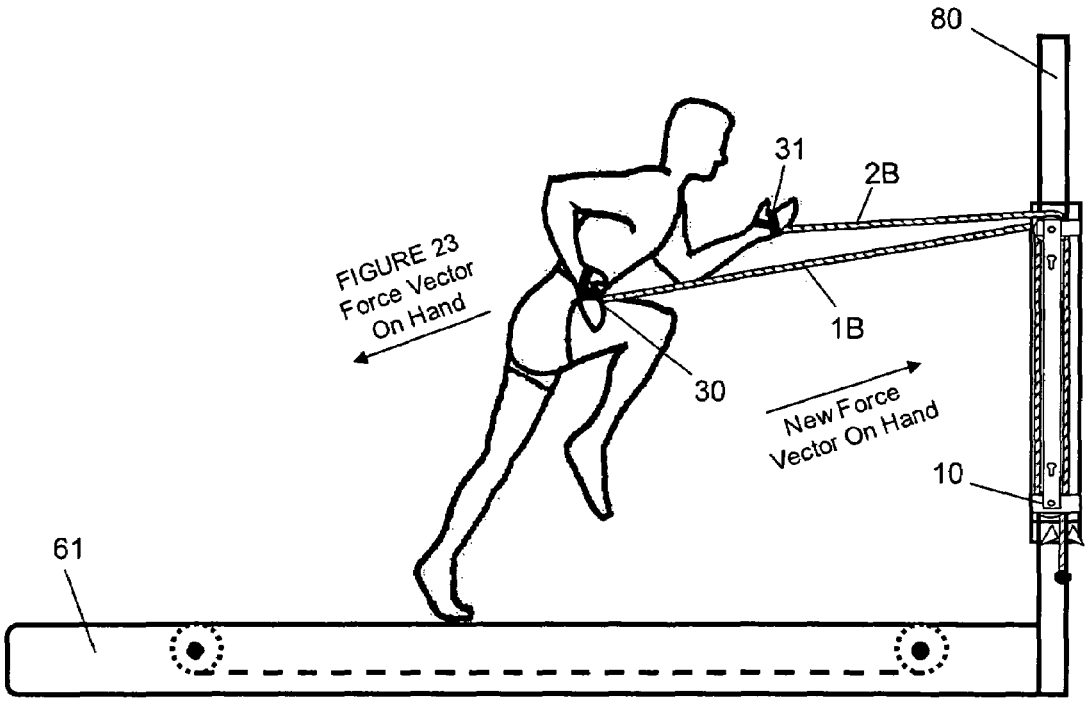
FIG. 36 is a side view of another embodiment of the present invention combined with a treadmill having elastic members originating from the front of a user.

FIG. 36 illustrates another embodiment of the physical training apparatus according to the present invention. In this embodiment, the training vectors provided by elastic members 1B,2B may originate from the front of the trainee for applying resistance to the hands while running so one may improve the arm pumping motion critical to sprinting. In this configuration two training modules 10 may be attached to a vertical support 80 (or wall) in front of the treadmill 61. Elastic members 1B and 2B attached to hand straps 30 and 31 respectively will resist any hand movement away from resistance module 10 while athlete runs on treadmill 61.

Figure 37:
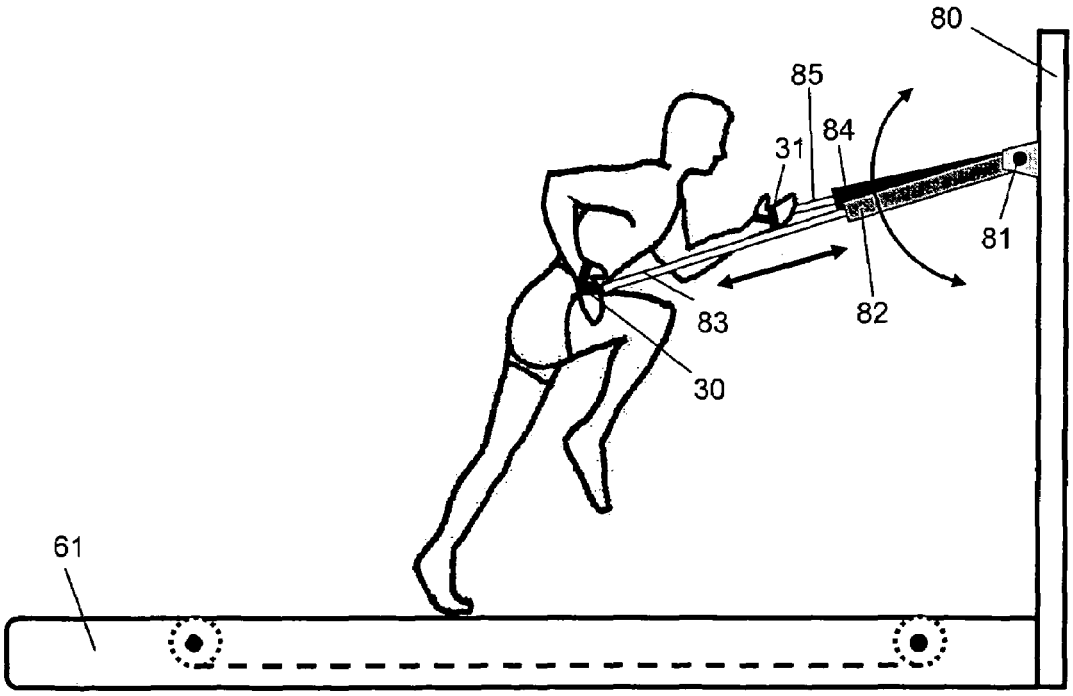
FIG. 37 is a side view of a further embodiment of the present invention combined with a treadmill having a pneumatic means providing training vectors to the hands of a user.

FIG. 37 illustrates another embodiment of the physical training apparatus wherein the training vectors provided to the hands of the trainee are provided by pneumatic means 82 and 84. The shafts 83 and 85 slide into pneumatic cylinders 82 and 84 respectively with very little resistance. However when the trainee moves his hands from a forward to rearward position, resistance is applied to the shafts 83 and 85 during extraction from the cylinders 82 and 84. The cylinders 82 and 84 may rotate freely about the pivot point 81 so that the athlete's hands attached to shafts 83 and 85 (via hand straps 30 and 31) may move up and down freely while running. The pneumatic cylinders 82 and 84 may have an adjustment means so that the force required to insert or extract shafts 83 and 85 may be varied to suit the trainee's specific needs.

Figure 38:
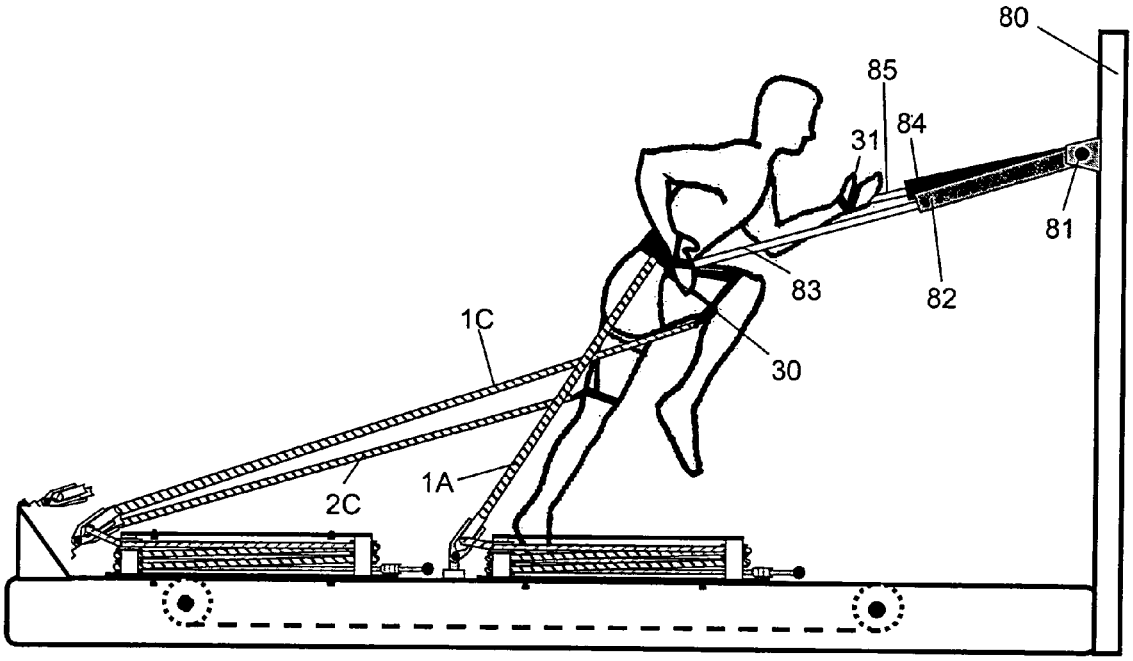
FIG. 38 is a side view of an embodiment of the present invention showing the training vectors applied to the hands and hips and knees of a user originating from the front and rear of the user, respectively.
Figure 39:
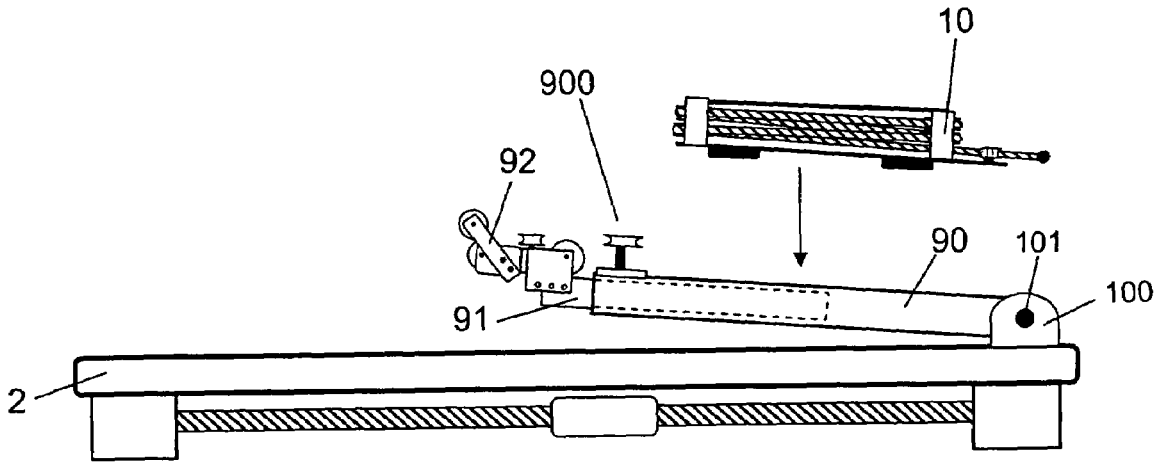
FIG. 39 is a side view of an alternative embodiment of the present invention showing a resistance training assembly.
Figure 40:
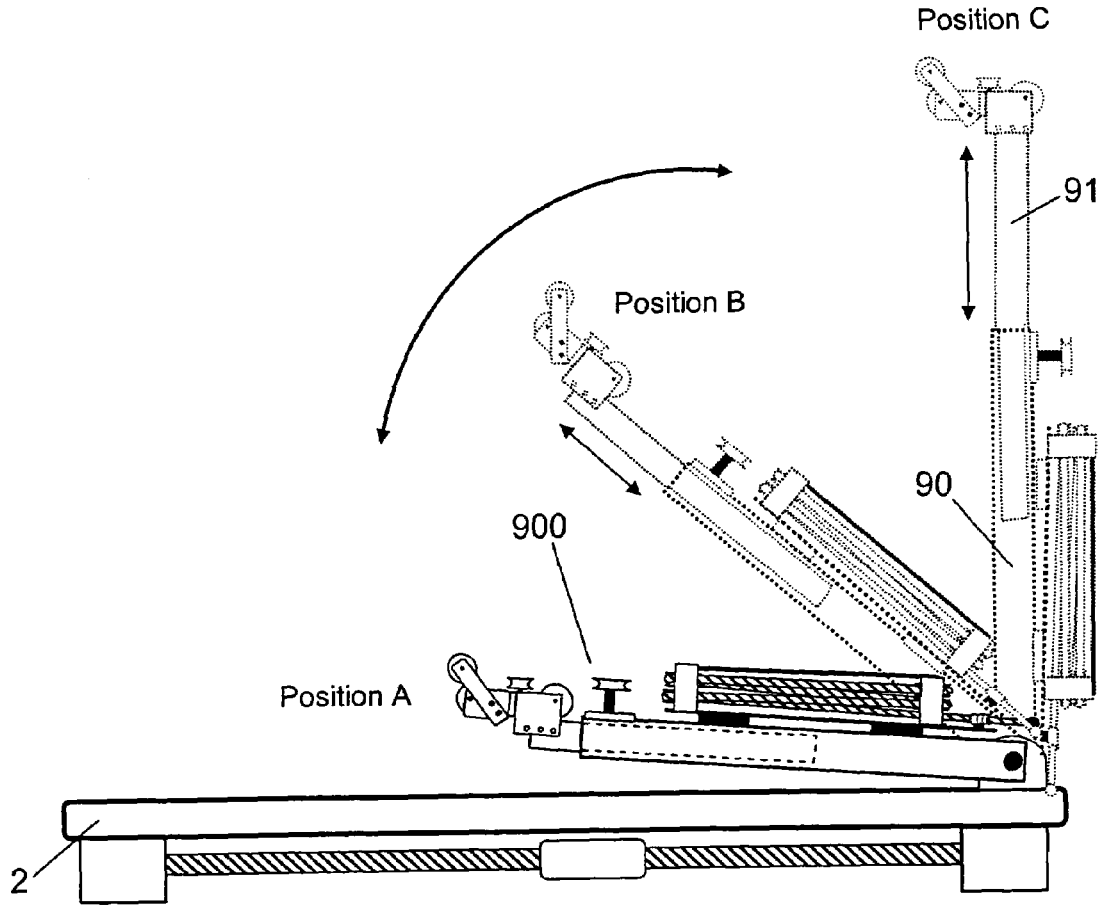
FIG. 40 is a side view of the alternative embodiment of FIG. 39 illustrating various positions of the resistance training assembly.

FIG. 38 illustrates an embodiment of the physical training apparatus according to the present invention wherein the training vectors applied to the hands originate from the front of the trainee while the training vectors provided to the hips and knees of the trainee originate from the rear of the trainee.

FIGS. 39-48 illustrate other embodiments of the physical training apparatus according the present invention. In these embodiments, the origin for one or more training vectors may be selectively varied in three dimensions and the elevation above the training surface of the origins of two or more training vectors may be different. Variability of the position of the origins of the training vectors provide advanced mechanical configurations that enable the physical training apparatus to be used for a variety of movements in addition to running or jumping.

With reference to FIGS. 39-48, a resistance training assembly 900 may be formed by mounting a training module 10 on a ridged frame member 90 and including a telescoping frame member 91 and pivoting cord routing assembly 92. The frame member 90 may be attached at one end to the base 2 or other surface using the base fixture 100. The frame member 90 can pivot in the base 100 about the axis pin 101. The other end of the frame member 90 may be elevated from the base and secured at any angle relative to the surface of the base 2. The positions A, B and C illustrate elevation angles of about five, forty-five and ninety degrees respectively.

The position of telescoping frame member 91 relative to the frame member 90 may be fixed at various positions so that the distance between the base 100 and the routing assembly 92 may vary.

Figure 41:
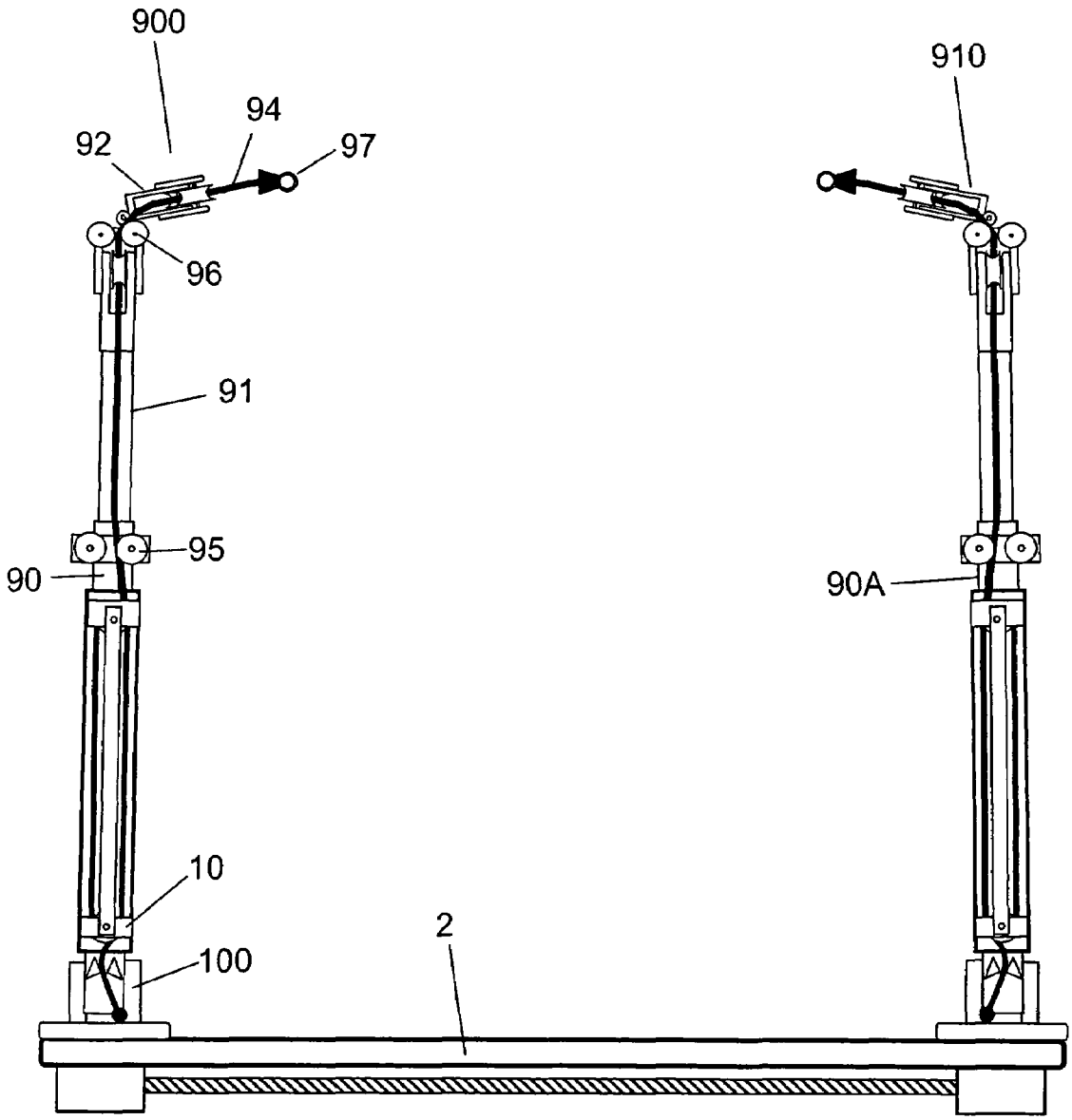
FIG. 41 is a front view of the alternative embodiment of FIG. 39 with the resistance training assemblies elevated at a right angle with the base.

With reference to FIG. 41, the resistance training assemblies 900,910 are elevated to an angle of about 90 degrees relative to the surface of the base 2. The elastic member 94 is directed out of training module 10 through the pulley units 95 and 96 and then through the pivoting pulley assembly 92. The elastic member 94 is attached at one end to the connector 97 for attachment to the selected part of the body of a trainee supported by the base 2.

Figure 42A:
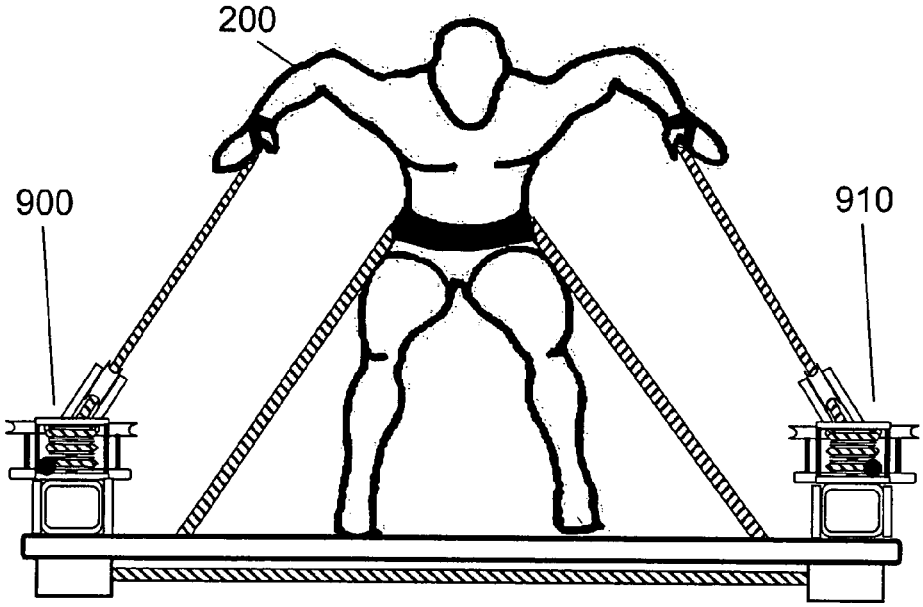
FIG. 42*a* is a front view of an embodiment of the present invention with a user in a crouched position showing a restraining means providing a specified resistance to the user.
Figure 42B:
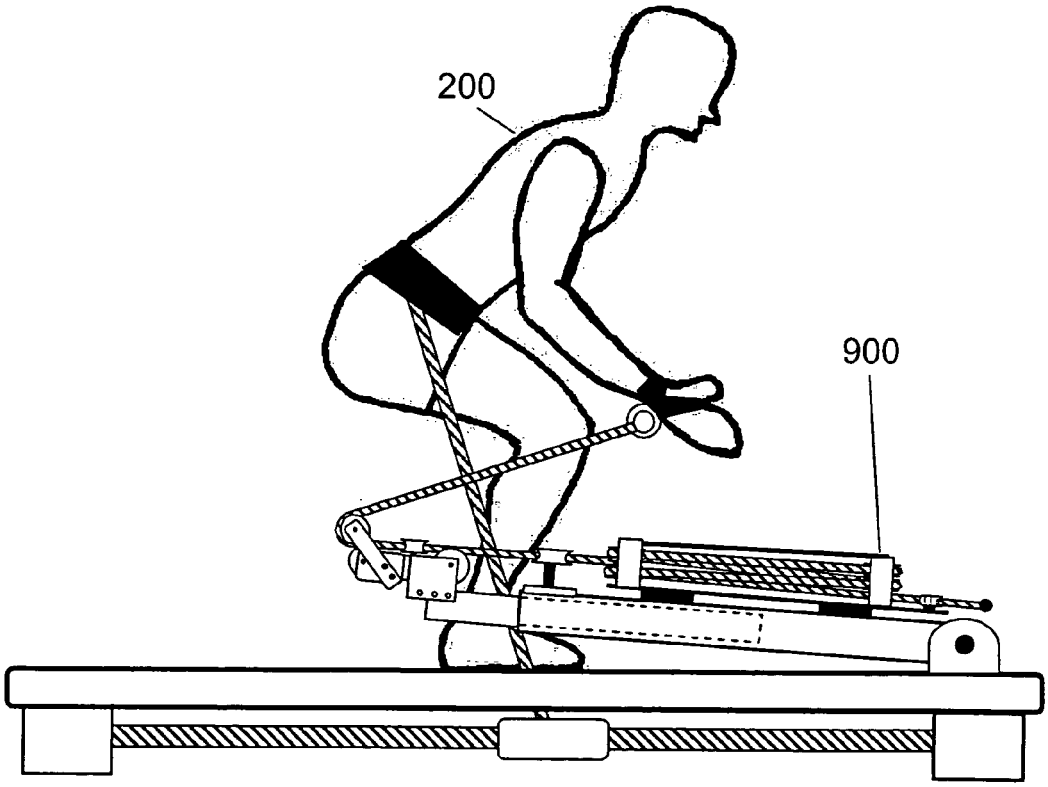
FIG. 42*b* is a side view of FIG. 42*a*.
Figure 43:
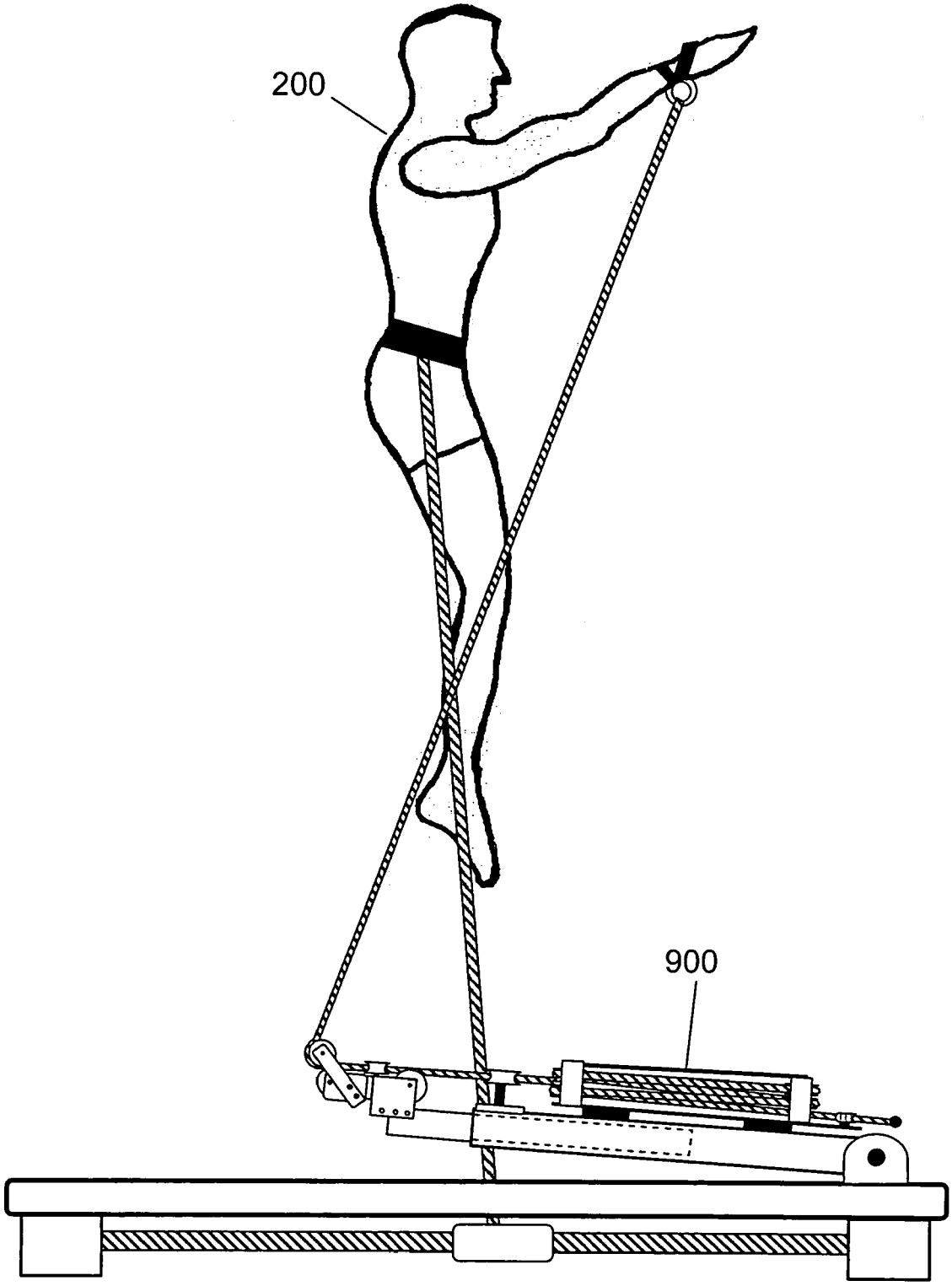
FIG. 43 is a side view of the embodiment of FIGS. 42*a* and 42*b* with the user at the peak of a jump, showing the restraining means in an extended position providing a specified resistance to the user.

FIGS. 42*a* and 42*b* illustrate front and side views of a trainee 200 in a crouched position with training vectors from resistance training assemblies 900 and 910 attached the hands and training vectors attached to the hips as disclosed in the prior Wehrell patents. FIG. 43 illustrates a side view of the trainee 200 in the extended position while performing vertical jump training.

Figure 44:
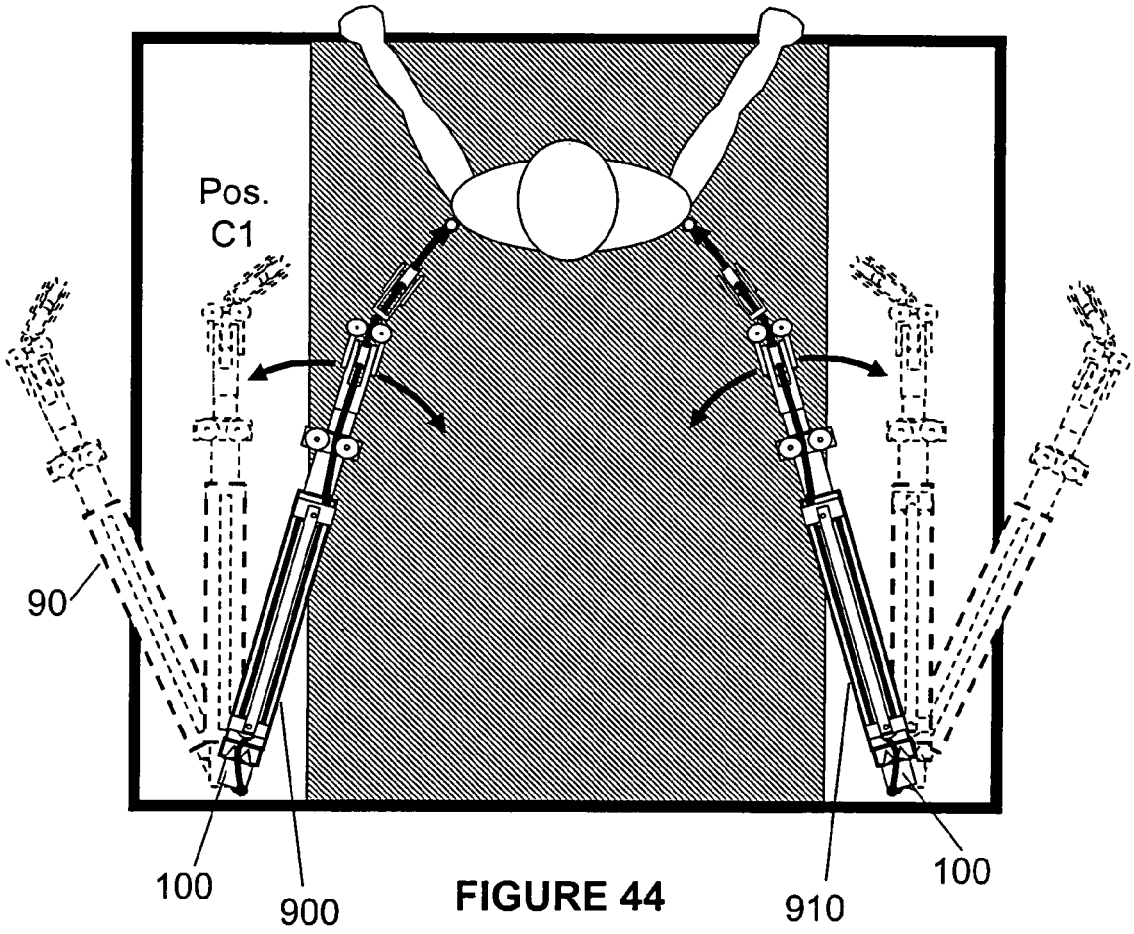
FIG. 44 is a top plan view of another embodiment of the present invention illustrating different positions of the resistance training assemblies.
Figure 45:
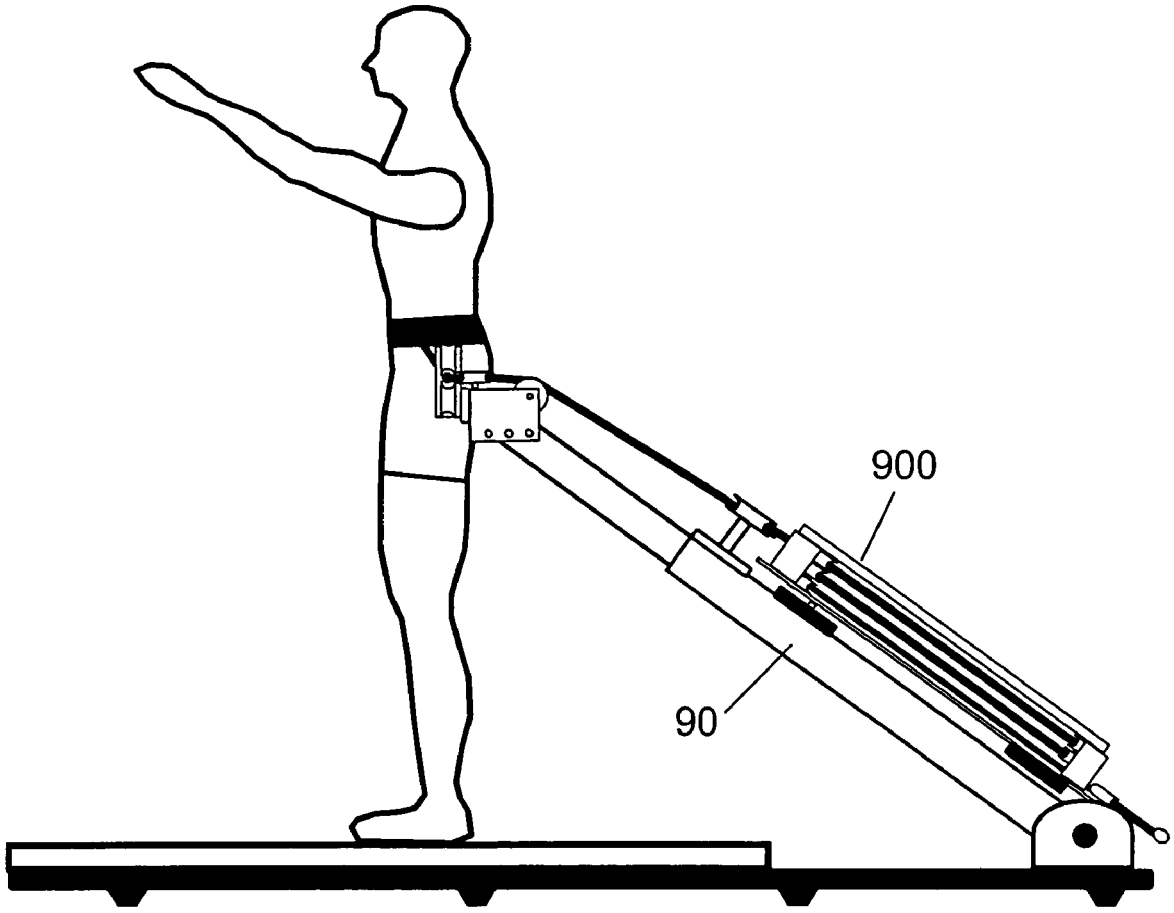
FIG. 45 is a side view of the embodiment of FIG. 44.

With reference to FIG. 44, the base 100 may rotate around an axis perpendicular to the plane of the upper surface of the base so that the resistance training assemblies 900,910 may be fixed at various angles relative to the position C1. An adjustment means (not shown) enables the user to rotate and fix the base 100 at various positions relative to the surface on which the base fixture 100 is attached. Alternatively, the base fixtures 100 may be mounted on a rail (not shown) extending laterally behind the trainee so that the position of the fixtures 100 may be selected. For example, as an alternative to pivoting the resistance training assemblies as illustrated in FIG. 44, the base fixtures 100 may be position a distance apart equally to about should width of the trainee. FIG. 45 illustrates a side view of the physical training apparatus shown in FIG. 44.

Figure 46:
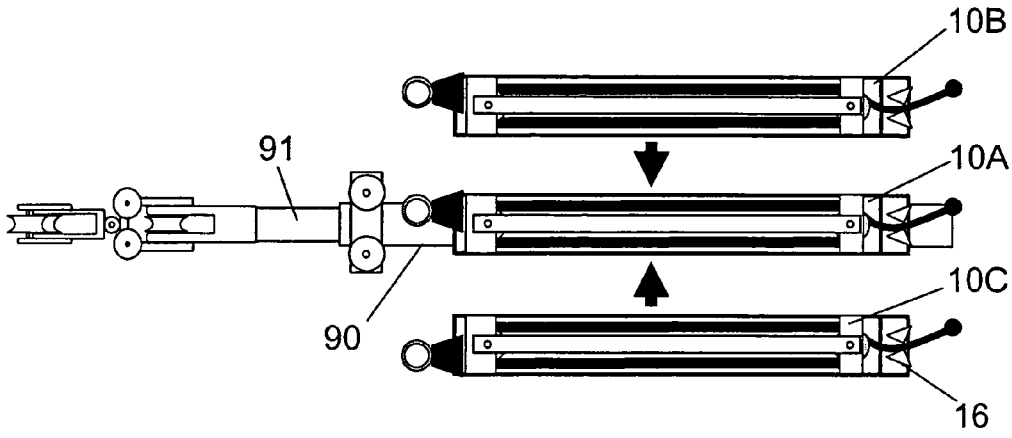
FIG. 46 is a top plan view of an alternative embodiment of the training module of FIG. 19 including an attachment means.
Figure 47:
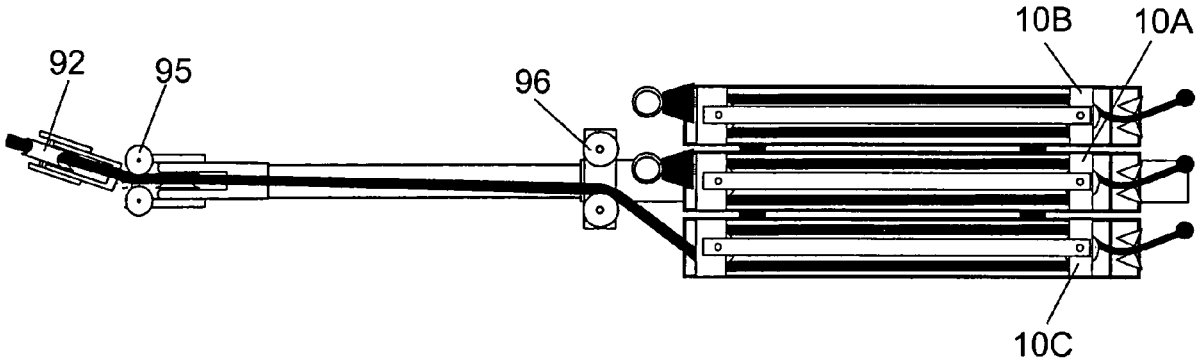
FIG. 47 is a top plan view of an alternative embodiment of the training module of FIG. 19.

FIG. 46 shows the training module 10A including side attachment means so that additional training modules 10B and 10C may be easily attached or detached to the sides of training module 10A. The anchor 16 on each module enables the effective length of the elastic member in the module to be varied to thereby vary the magnitude of the force provided by the member. The range of variance is limited by the diameter of the elastic member. For example, the module 10A may include an elastic member with a diameter of ⅜ inches. The effective length of the elastic member may be varied to thereby vary the force provided by the elastic member in the range between about twenty and about forty pounds. By adding a second module 10B including an elastic member with a smaller diameter resistance band (e.g., a diameter of about 5/16 inches) would provide a useful resistance force range from about four to about twenty pounds. By adding another module 10C including an elastic member with a larger diameter (e.g., a diameter of ½ inches) would provide a useful resistance force range from about thirty-five to about sixty pounds. Thus, by adding the modules 10B and 10C the effective range of resistance forces is expanded to the range between about four pounds to about sixty pounds. Without the ability to attach and detach additional modules, one would have to remove and then completely replace the resistance band to provide a lower or higher range of training resistances.

Figure 48:
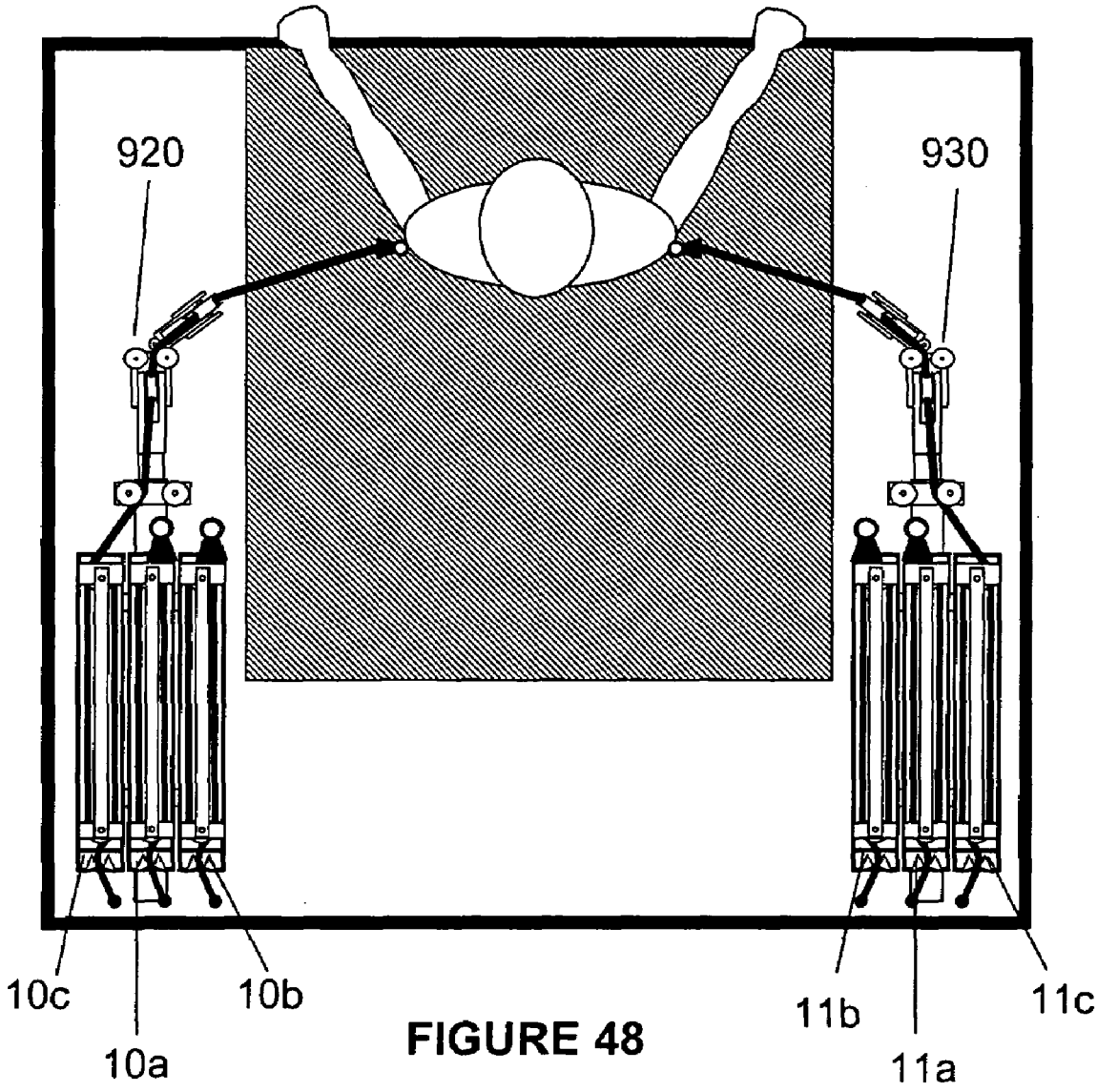
FIG. 48 is a top plan view of a further embodiment of the present invention with a user in a standing position showing an alternative resistance training assembly providing a specified resistance with reference to the user.

FIG. 48 illustrates resistance training assemblies 920 and 930 comprising training modules 10A,10B,10C and 11A, 11B,11C respectively.

Figure 49:
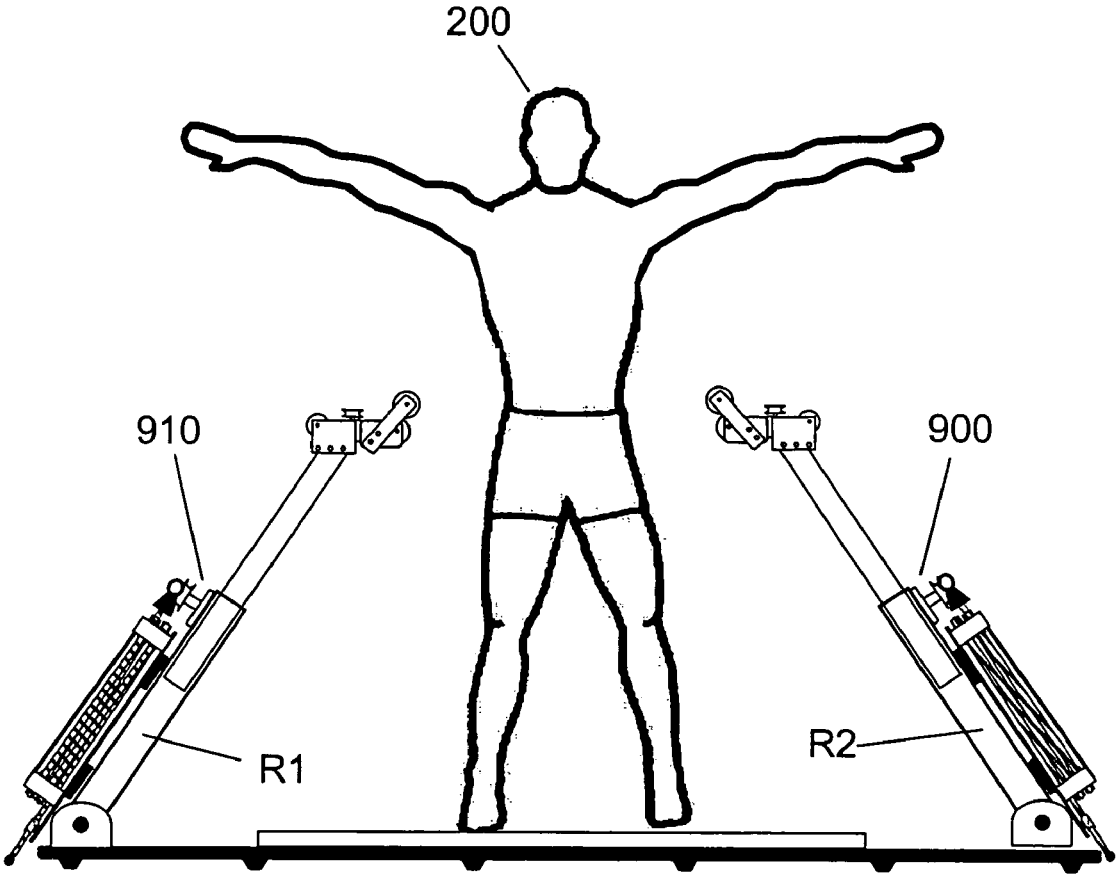
FIG. 49 is a front view of an embodiment of the present invention showing resistance training assemblies directly to the left and right of a user.
Figure 50:
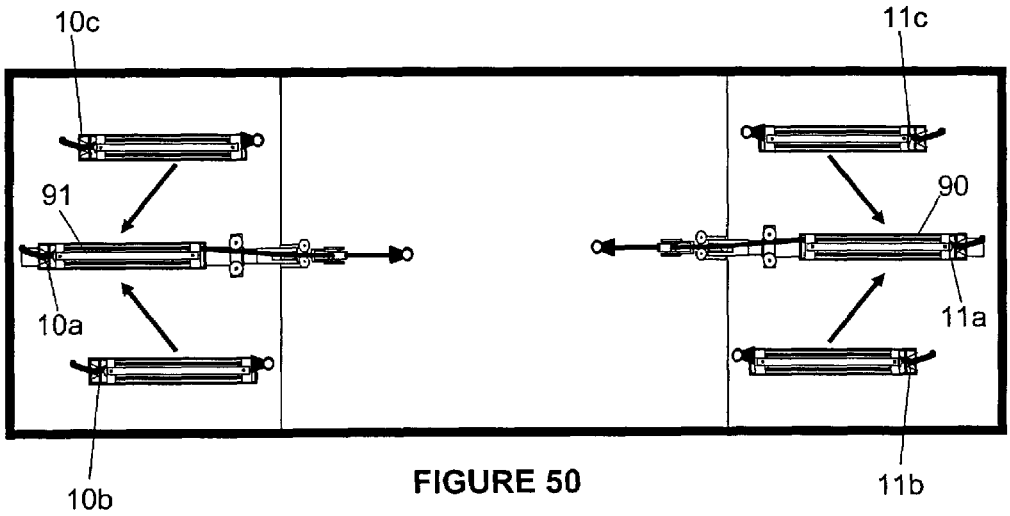
FIG. 50 is a top plan view of the embodiment of FIG. 49 showing an alternative resistance training assembly.
Figure 51:
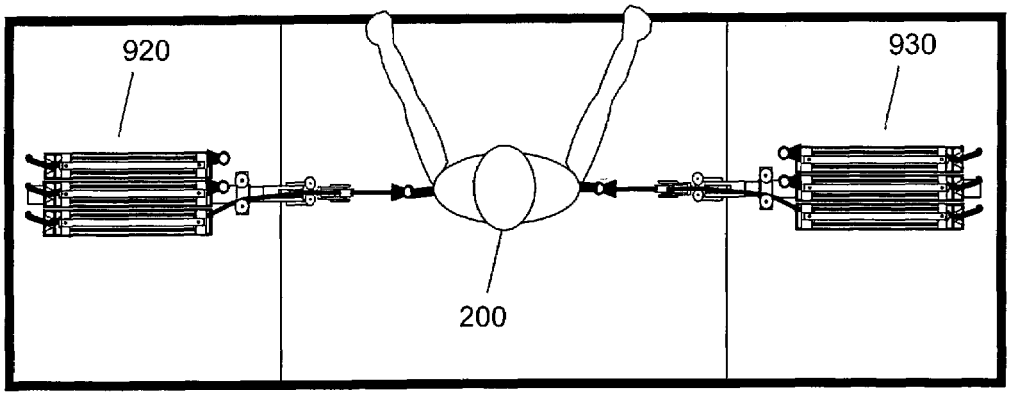
FIG. 51 is a top plan view of FIG. 50 with a user in a standing position showing a restraining means providing a specified resistance with reference to the user.

FIG. 49 illustrates an embodiment of the physical training apparatus according to the present invention wherein the resistance training assemblies 900 and 910 are mounted directly to the left and right of the trainee 200. FIGS. 50 and 51 illustrate the positioning of the resistance training assemblies 920 and 930 including the triple training module configuration.

Figure 52:
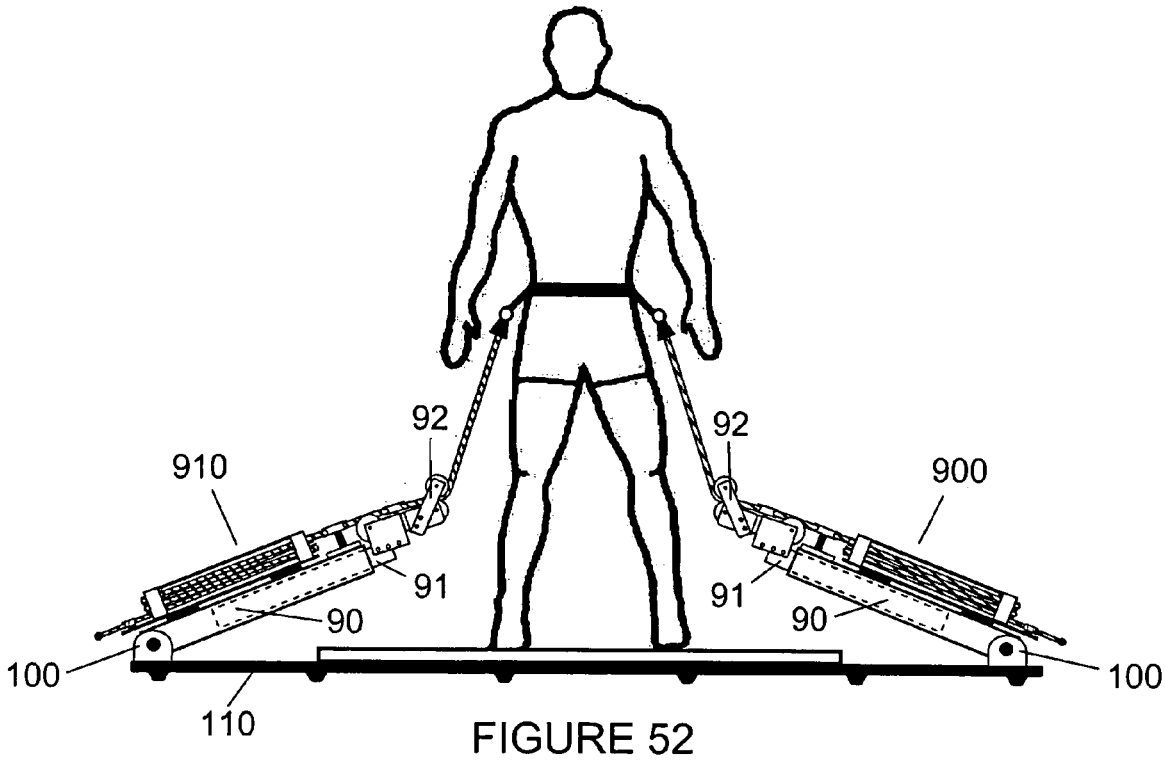
FIGS. 52-54 are front views of various embodiments of the present invention illustrating alternative positions of the resistance training assembly.
Figure 53:
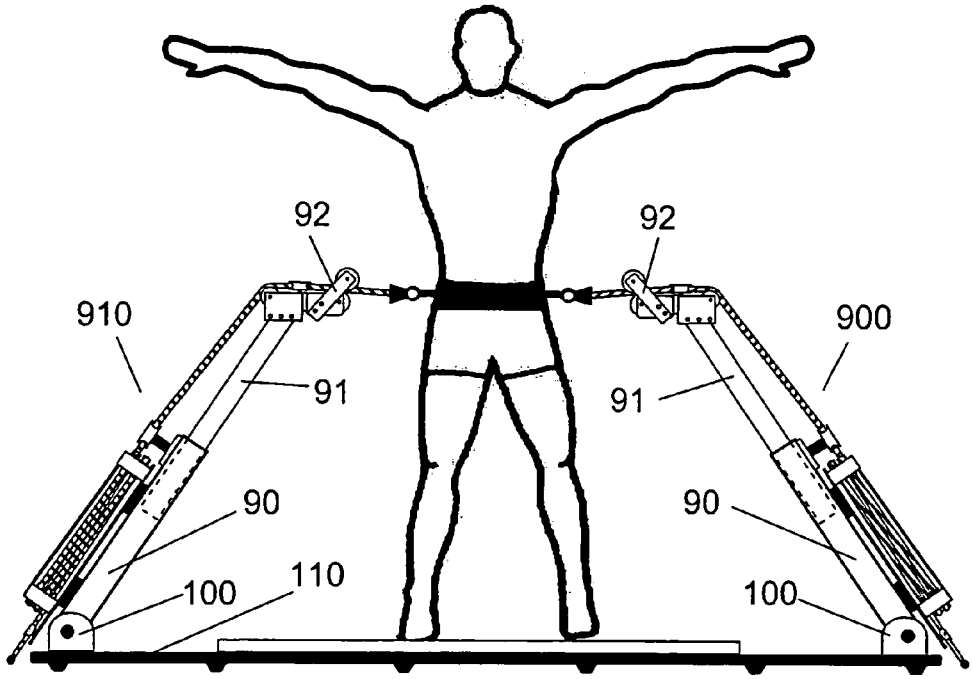

FIGS. 52 and 53 illustrate two of many positions of the resistance training assemblies 900,910. The base 100 provides an adjustment means to lock frame member 90 in various angular positions relative to the exercise surface 110, allowing the angular position of assemblies 900,910 to be set at many positions. Note also that frame member 90 has a mechanical adjustment means to fix the position of telescoping member 91 (which slides within 90) at various telescopic positions.

Figure 54:
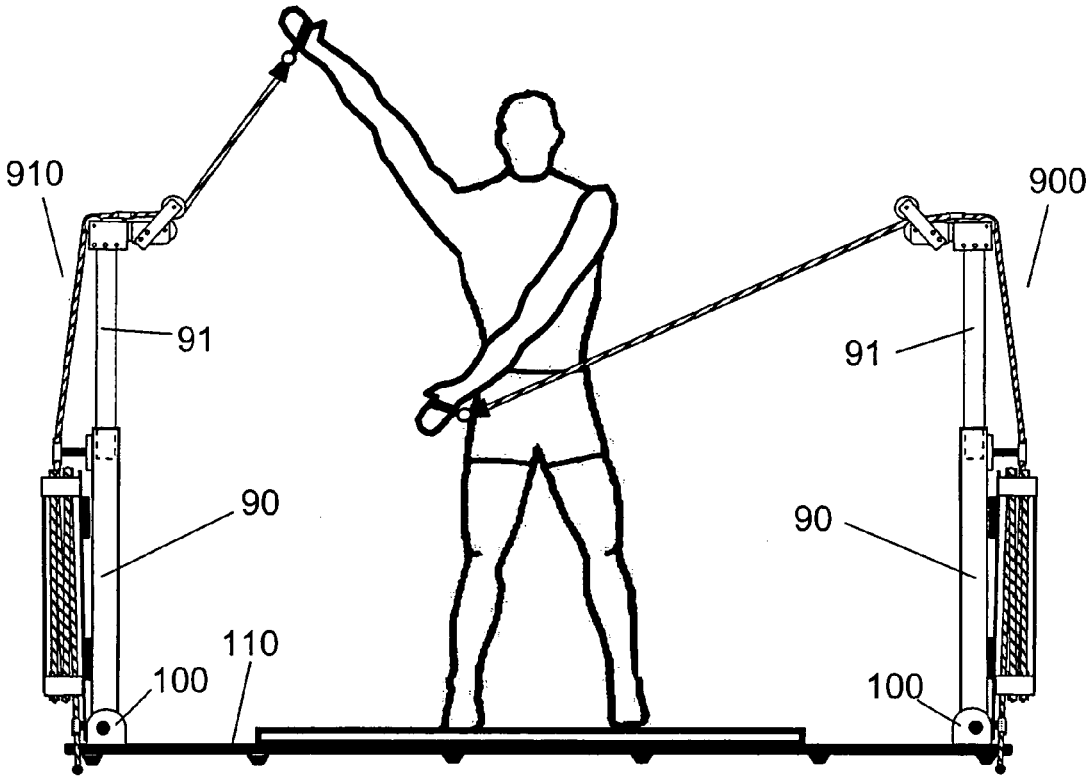
Figure 55:
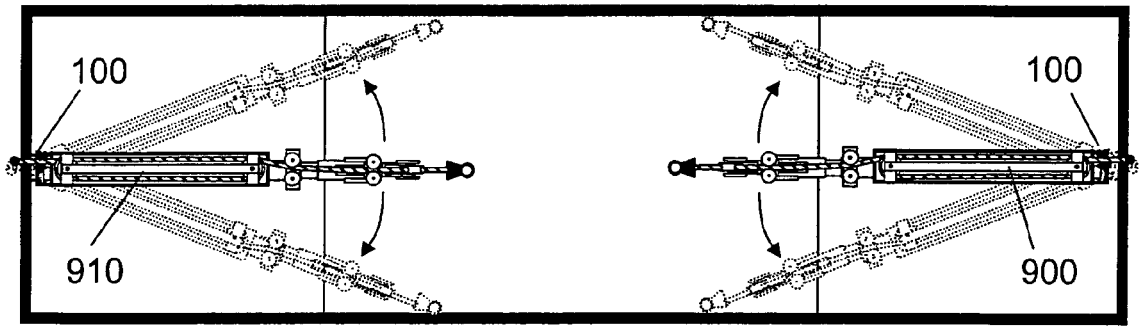
FIG. 55 is a top plan view of an embodiment of two resistance assemblies depicting the pivoting of the assemblies.

FIG. 54 illustrates the resistance training assemblies 900, 910 positioned at 90 degrees relative to exercise surface 110. FIG. 55 illustrates the pivoting of the assemblies 900,910 about the base 100 of each assembly.

Figure 56:
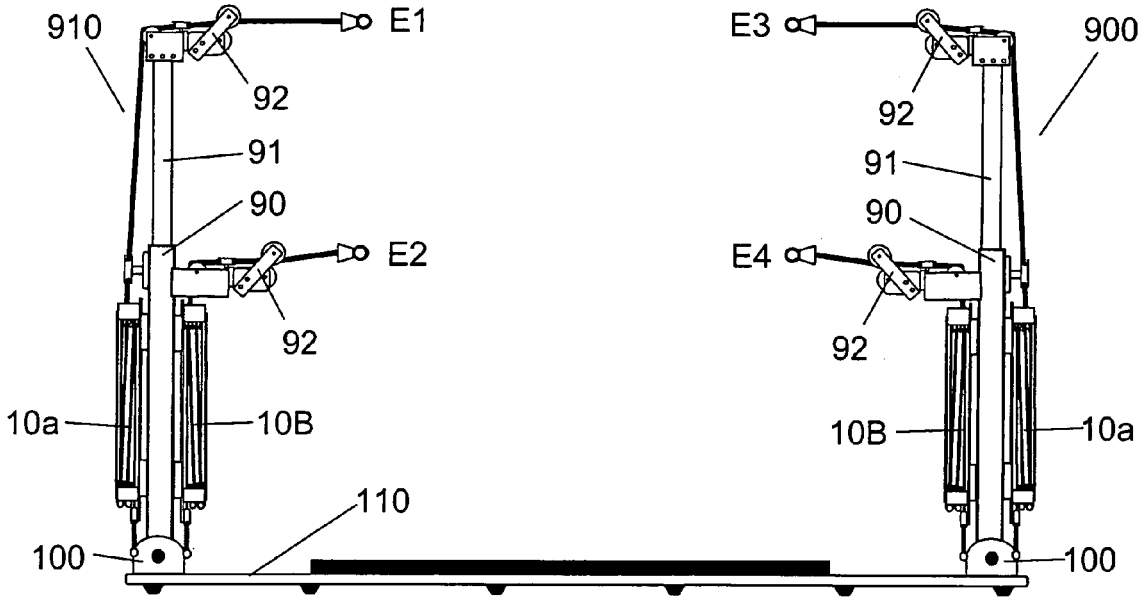
FIGS. 56 and 57 are front views of alternative embodiments of the present invention providing four training vectors to a user.

FIG. 56 illustrates a physical training apparatus providing four training vectors by attaching training modules 10A and 10B to each frame member 90 of the respective assemblies 900,910 and attaching an additional pivoting pulley assembly 92 to each frame member 90. This embodiment provides elastic members E1,E2,E3,E4 for attachment to the trainee.

Figure 57:
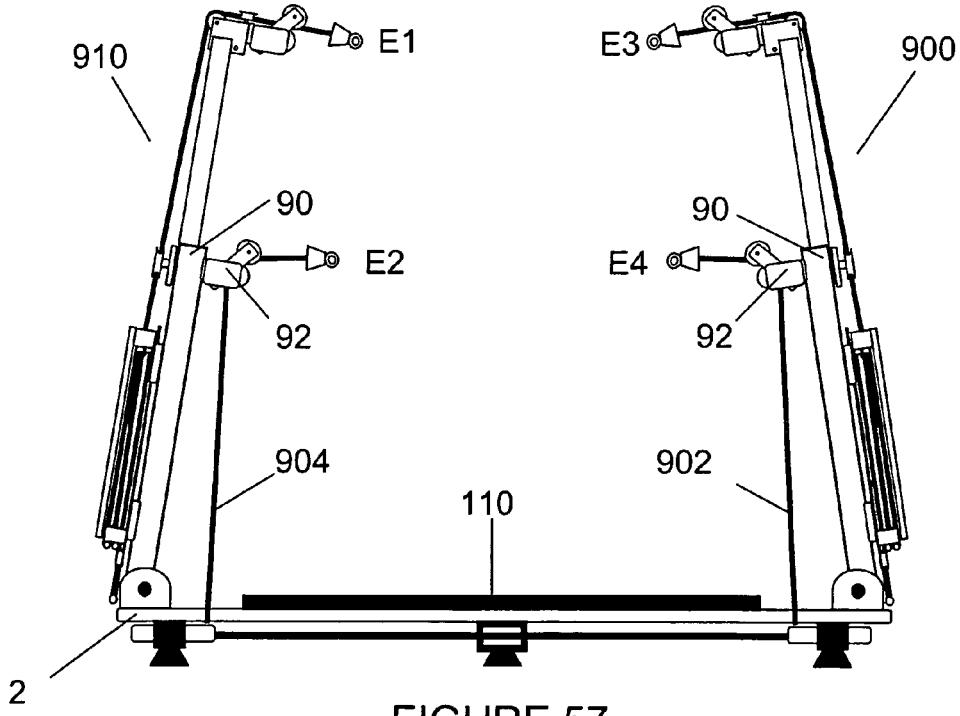
Figure 58:
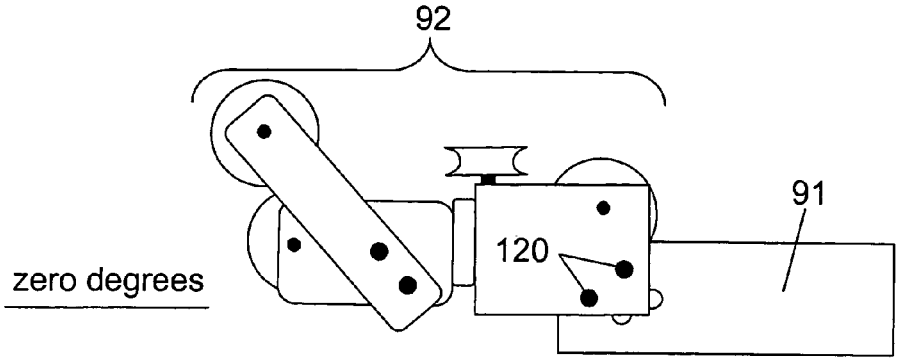
FIG. 58 is a side view of a pulley assembly of the present invention level with a member.
Figure 59:
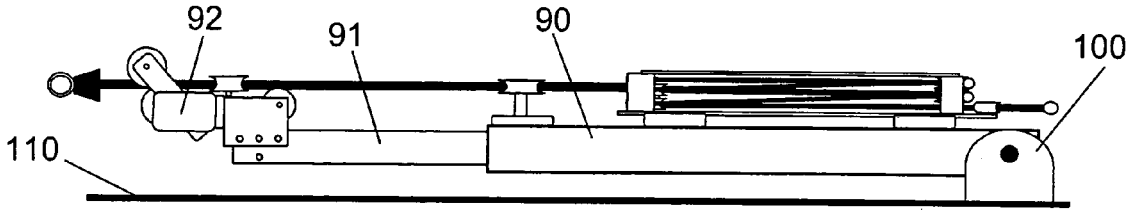
FIG. 59 is a side view of the pulley assembly of FIG. 58 attached to a resistance training assembly.
Figure 60:
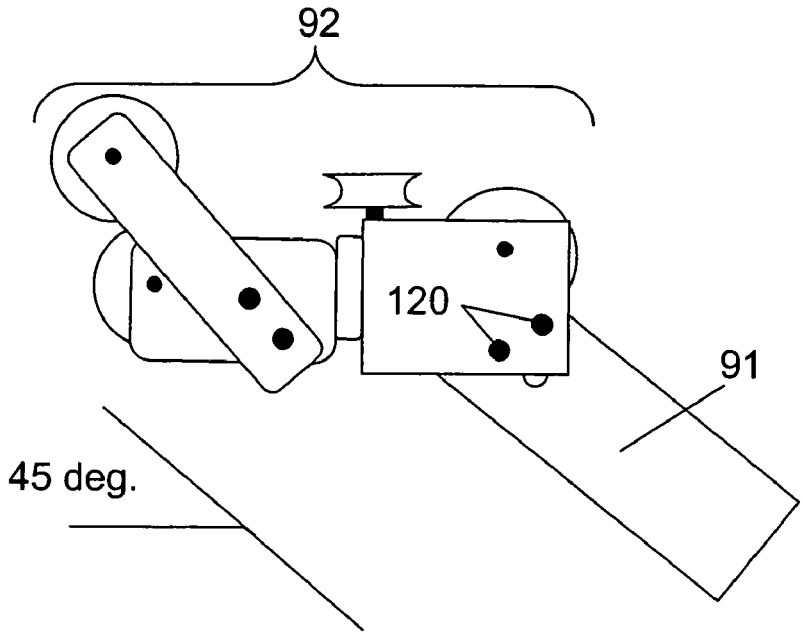
FIG. 60 is a side view of a pulley assembly of the present invention pivoted at a 45 degree angle relative to a member.
Figure 61:
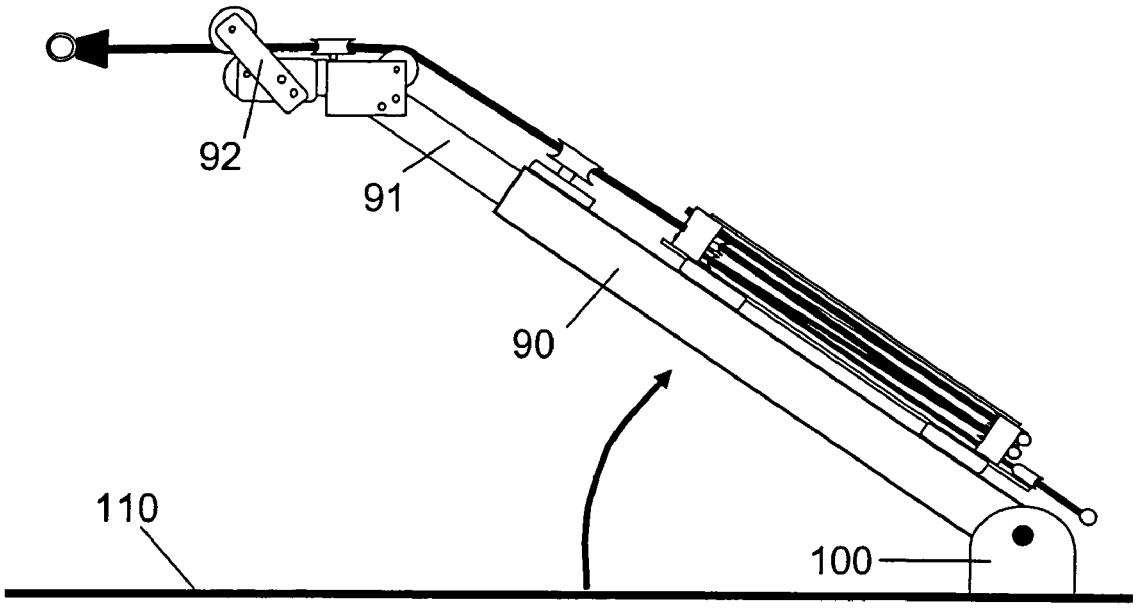
FIG. 61 is a side view of the pulley assembly of FIG. 60 attached to a resistance training assembly.
Figure 62:
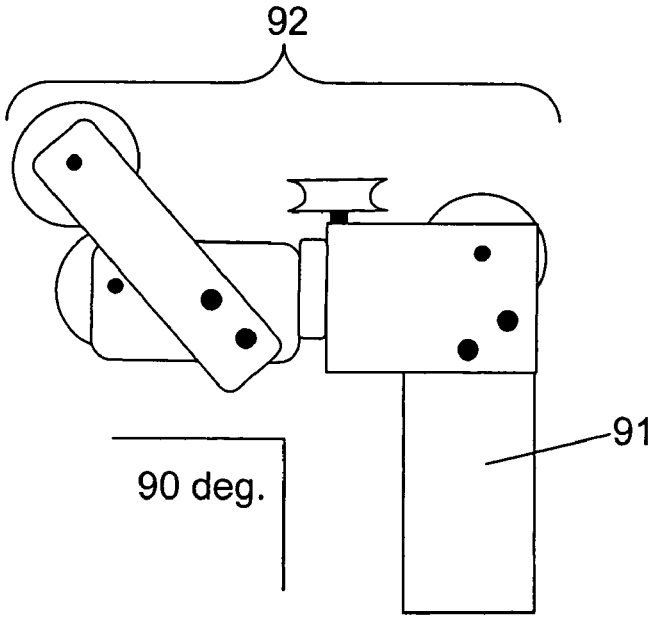
FIG. 62 is a side view of a pulley assembly of the present invention pivoted at a right angle relative to a member.
Figure 63:
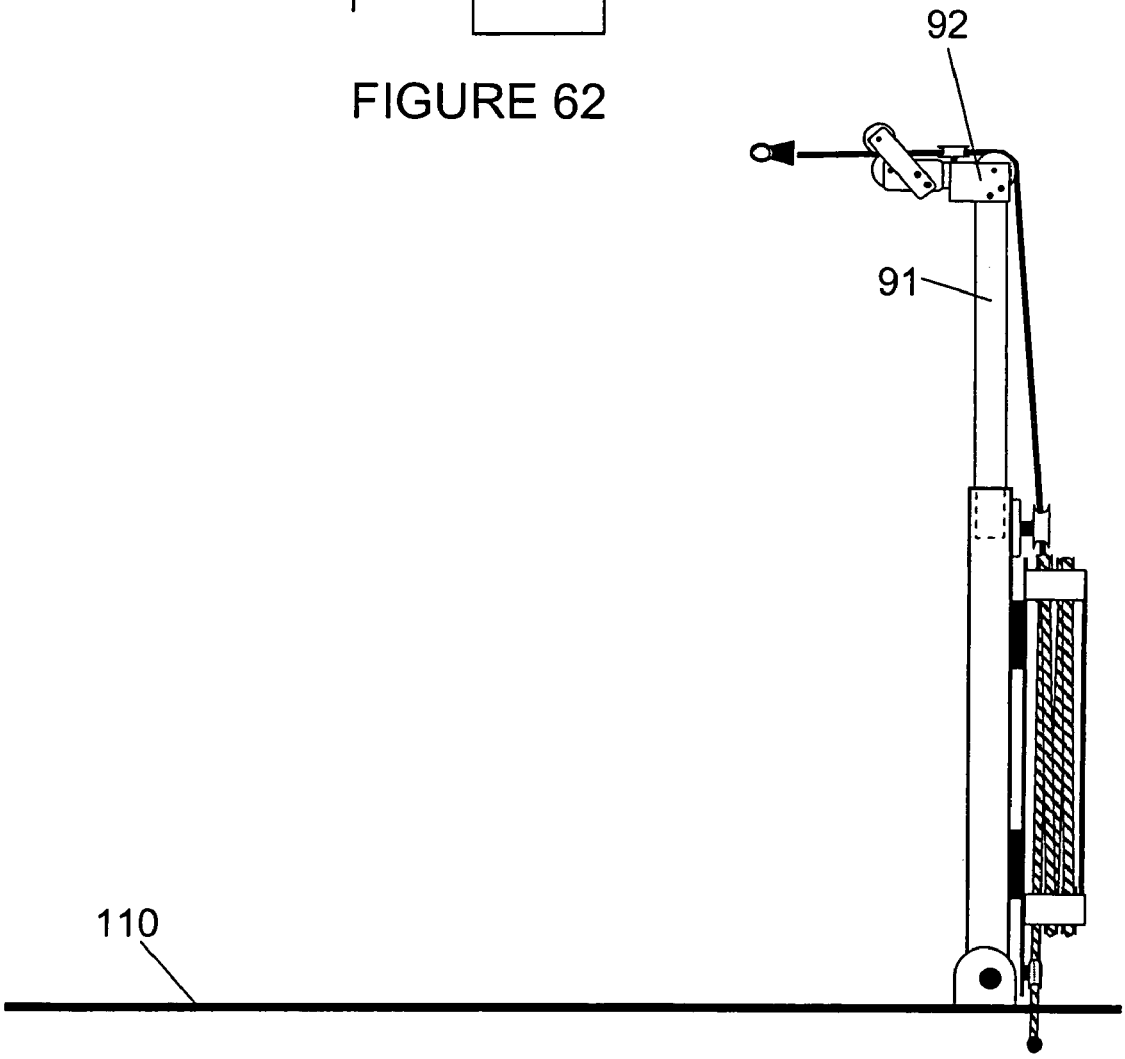
FIG. 63 is a side view of the pulley assembly of FIG. 62 attached to a resistance training assembly.

FIG. 57 illustrates another embodiment for providing four training vectors by using the elastic members 902,904 (which may be directed away from the training surface 110 as disclosed in the prior Wehrell patents) and directing the members 902,904 through the respective pivoting pulley assembly 92.

FIGS. 58-71 illustrate the pivoting capabilities of the pulley assembly 92. As the assembly 92 is elevated by pivoting the member 90 about the base 100, the position of the pivoting pulley assembly 92 relative to member 91 may be adjusted. Adjustment means 120 may be provided as necessary to position the assembly 92 at the desired angles relative to member 91.

Figure 64:
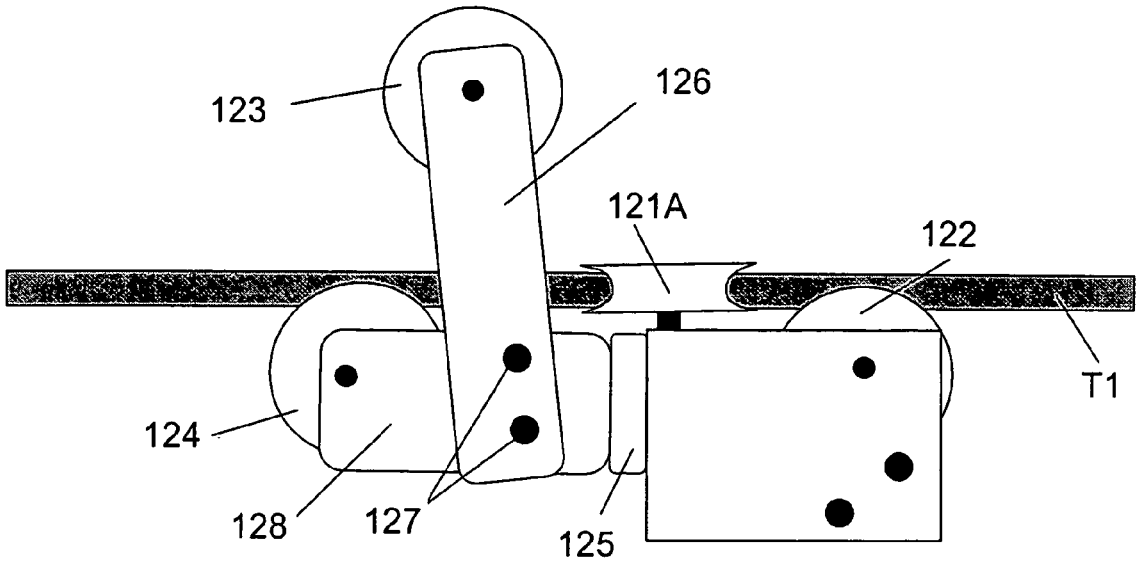
FIGS. 64-67 are illustrations of the pulley assembly of FIGS. 58, 60 and 62 depicting pivoting points of the pulley assembly.
Figure 65:
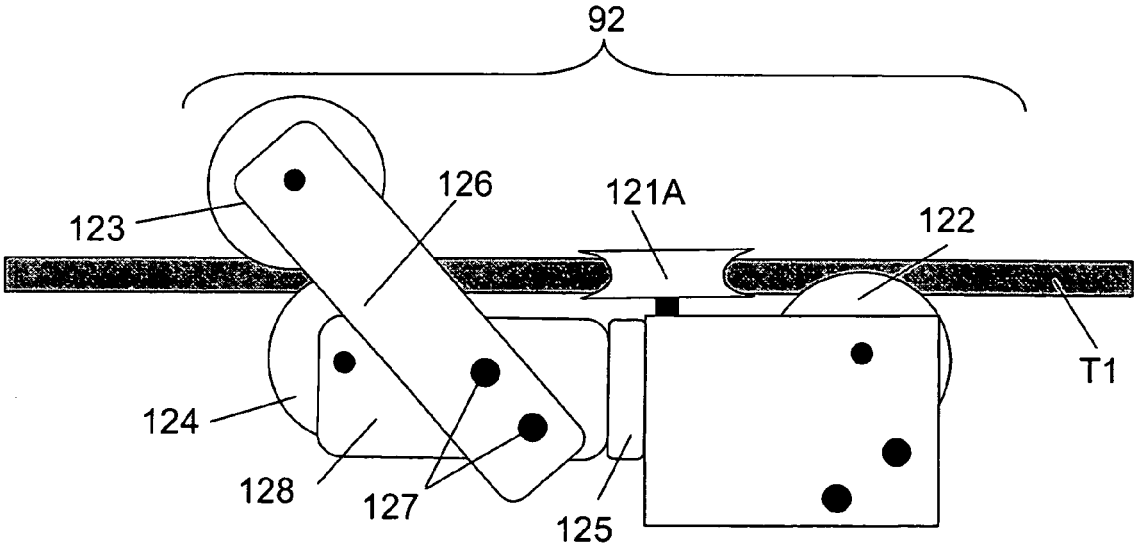

FIGS. 64-67 illustrate the operational features and pivoting point of the pulley assembly 92. With reference to FIGS. 64-65, the tether T1 is routed through the pulley 122 and between horizontal pulleys 121A and 121B. An adjustment mechanism 127 enables the support structure 126 for the pulley 123 to rotate clockwise to separate the pulley 123 from the pulley 124. This allows tether T1 to be placed over pulley 124. With reference to FIG. 65, the support structure 126 is then rotated counter clockwise until it binds tether T1 firmly within the races of the pulleys 124 and 123. Locking mechanism 127 secures 126 in place so the pulleys 123 and 124 can not separate. The tight special separation between the pulleys 123 and 124 prohibit tether T1 from derailing from the pulleys 123 and 124 during movement of the tether T1. The tether T1 may be any means for providing a training vector to a trainee such as an elastic member.

Figure 66:
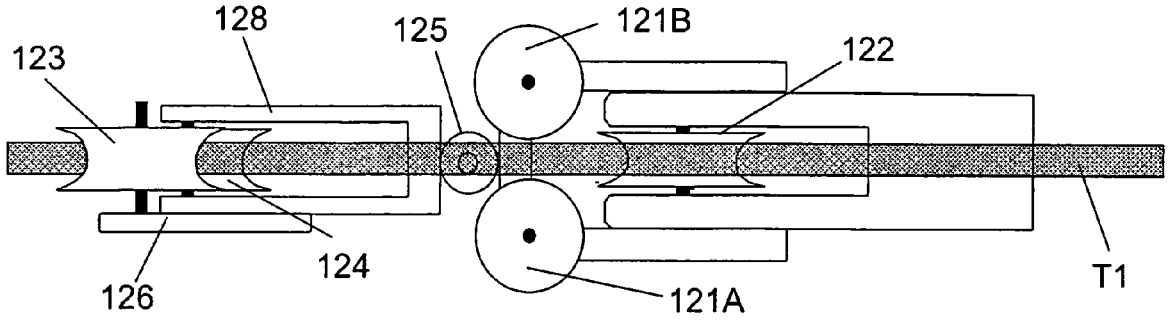
Figure 67:
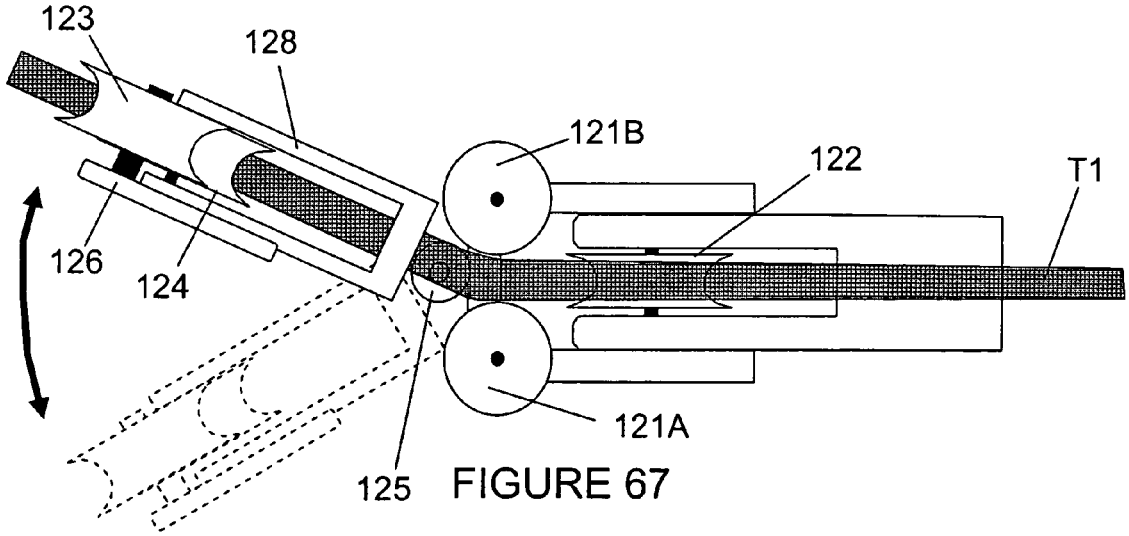
Figure 70:
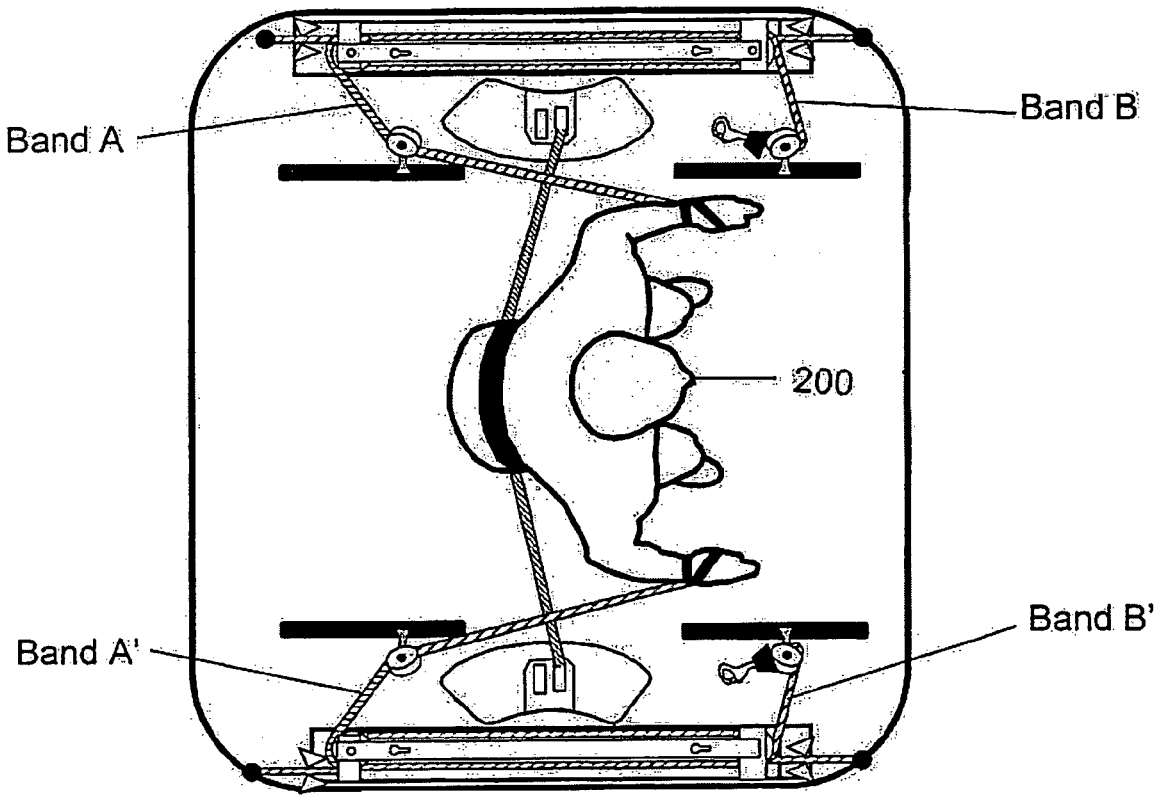
FIGS. 70-72 are top plan views of alternative embodiments of the present invention with a user in a crouched position showing a restraining means providing a specified resistance with reference to the user.
Figure 71:
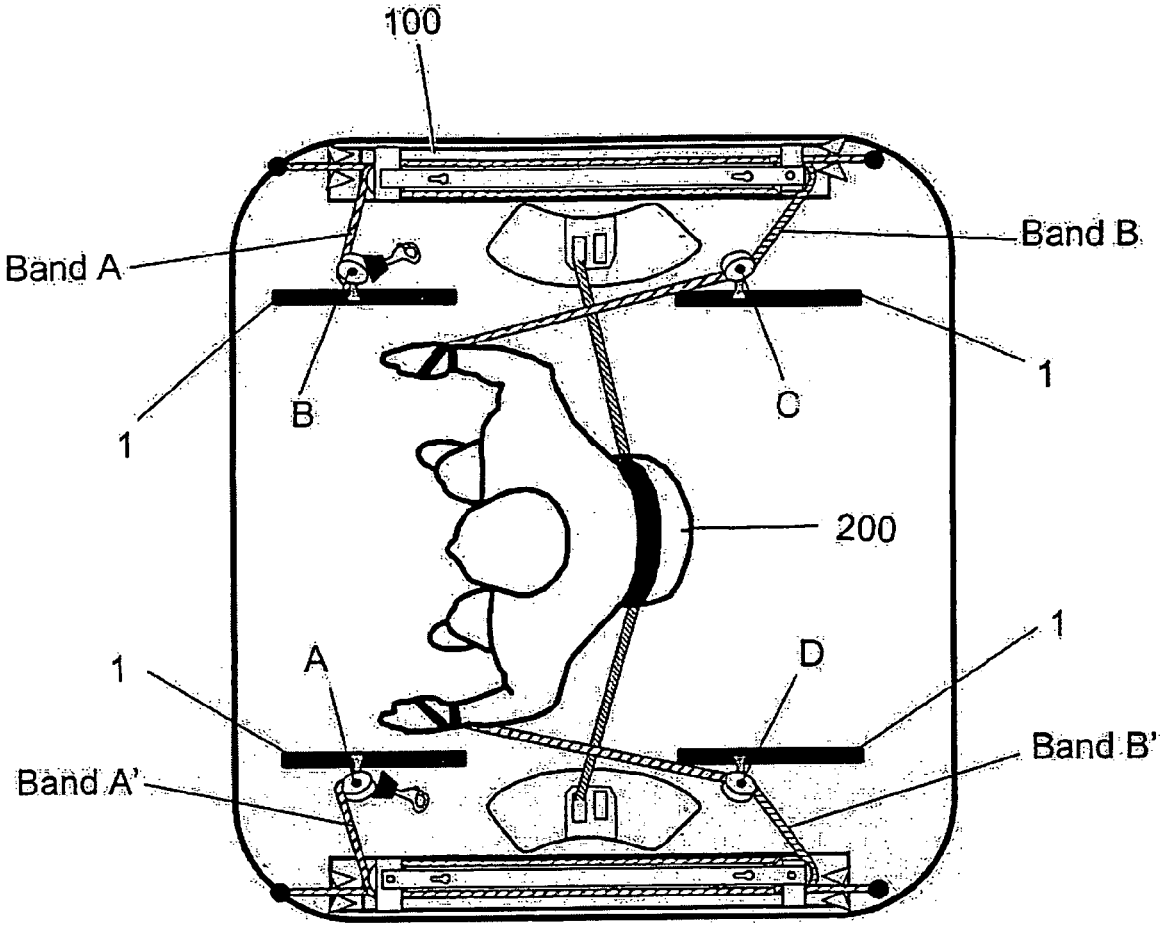
Figure 72:
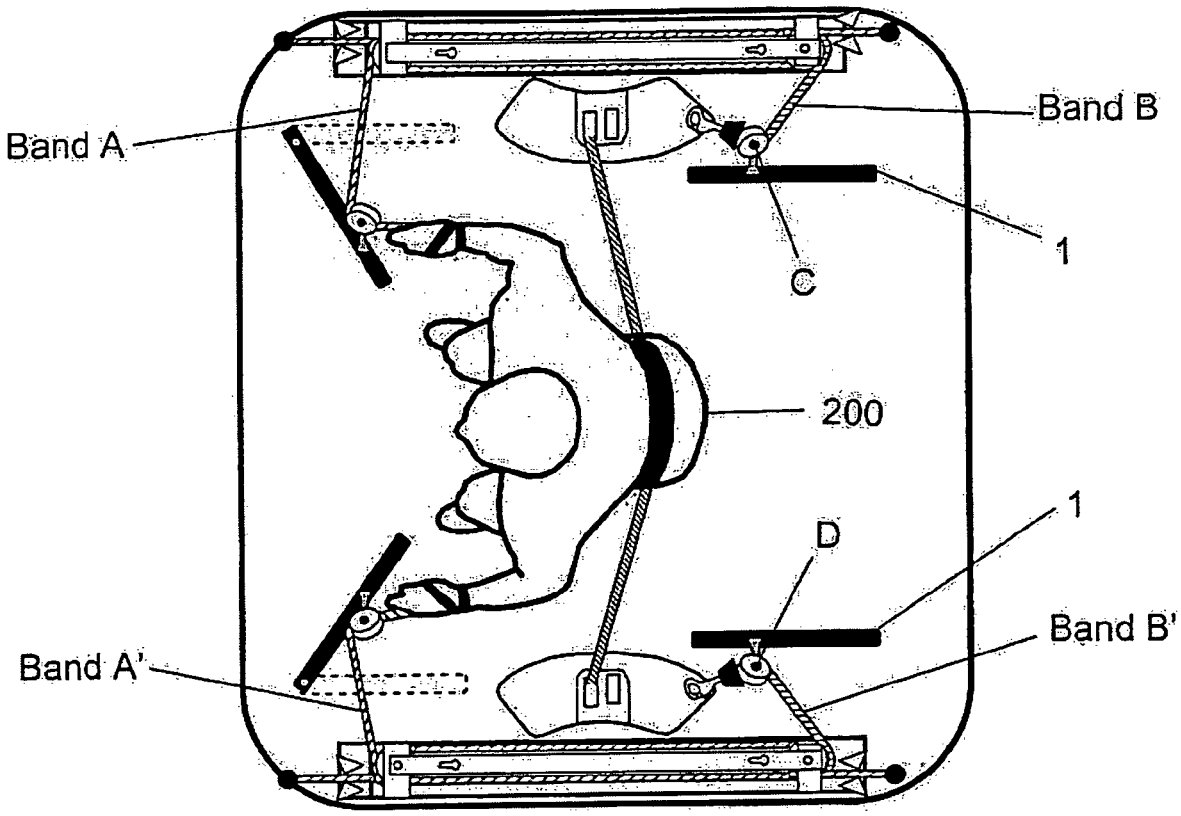
Figure 73:
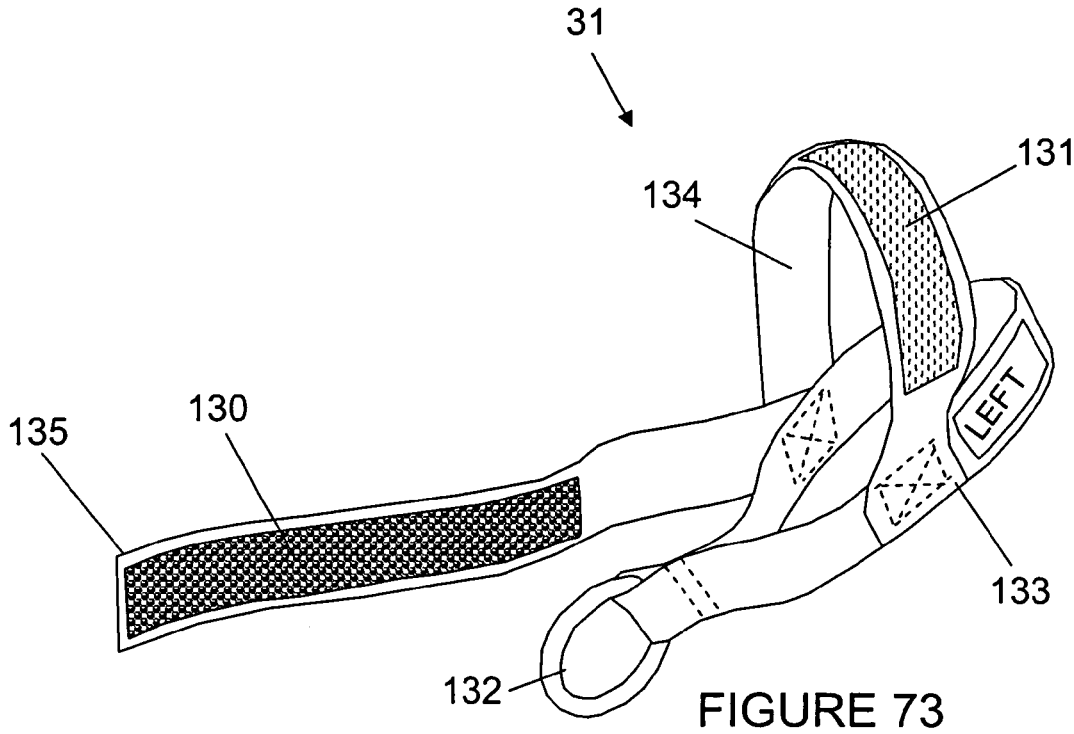
FIGS. 73-77 are pictorial views of an embodiment of a harness of the present invention adapted to be worn on the left hand of a user.
Figure 74:
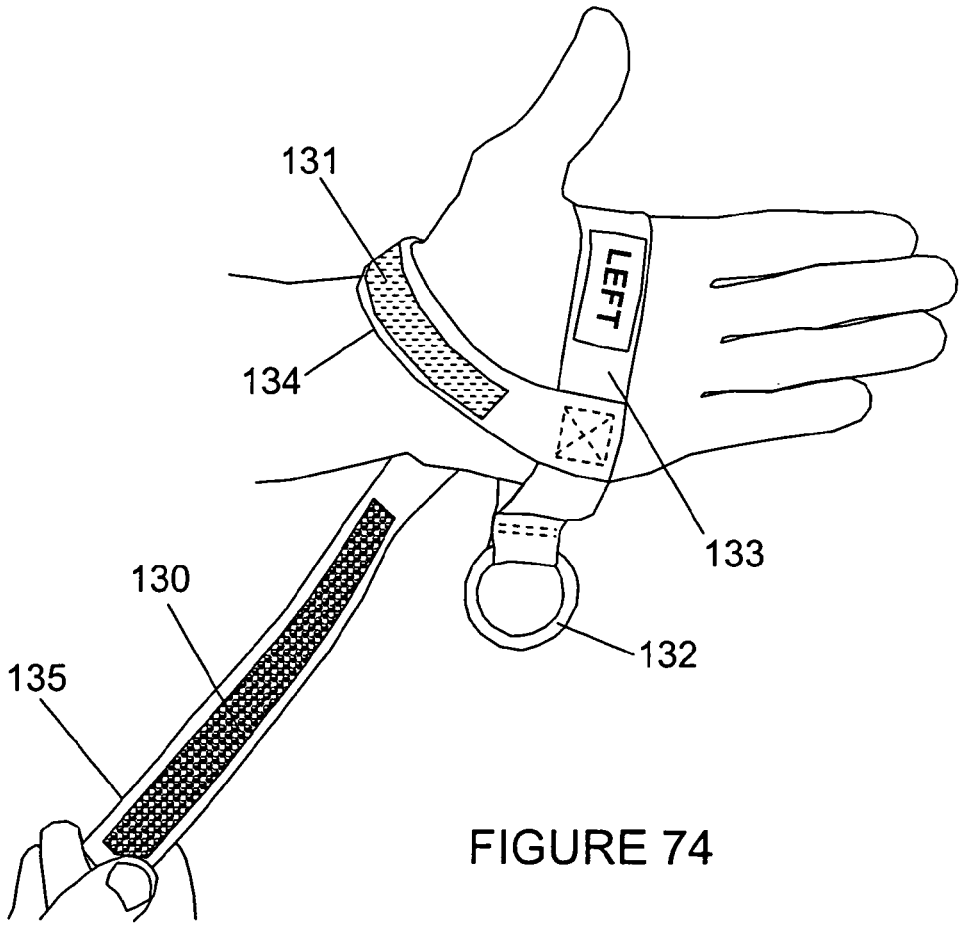
Figure 75:
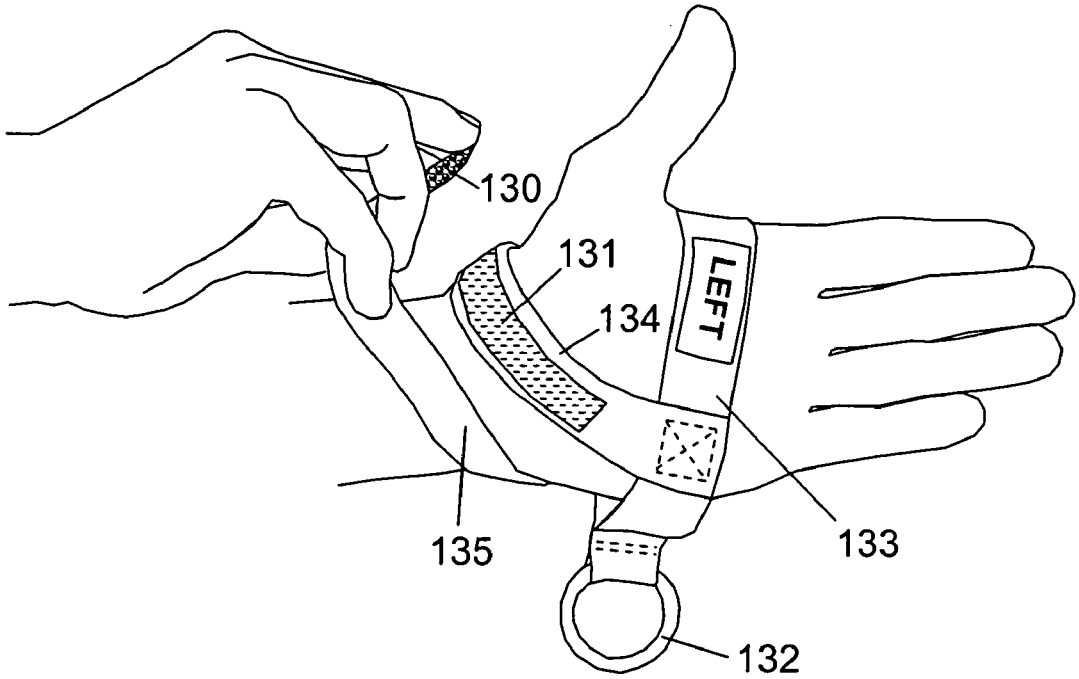
Figure 76:
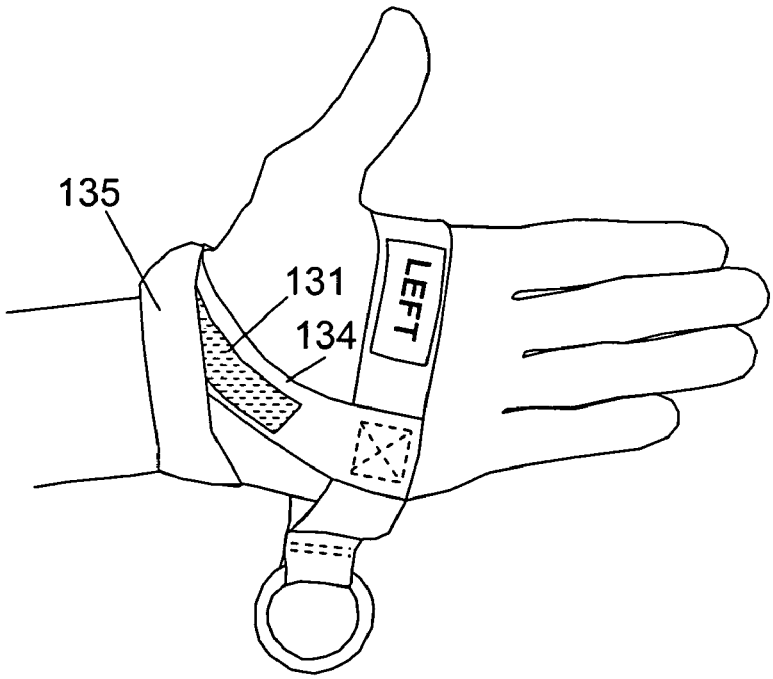
Figure 77:
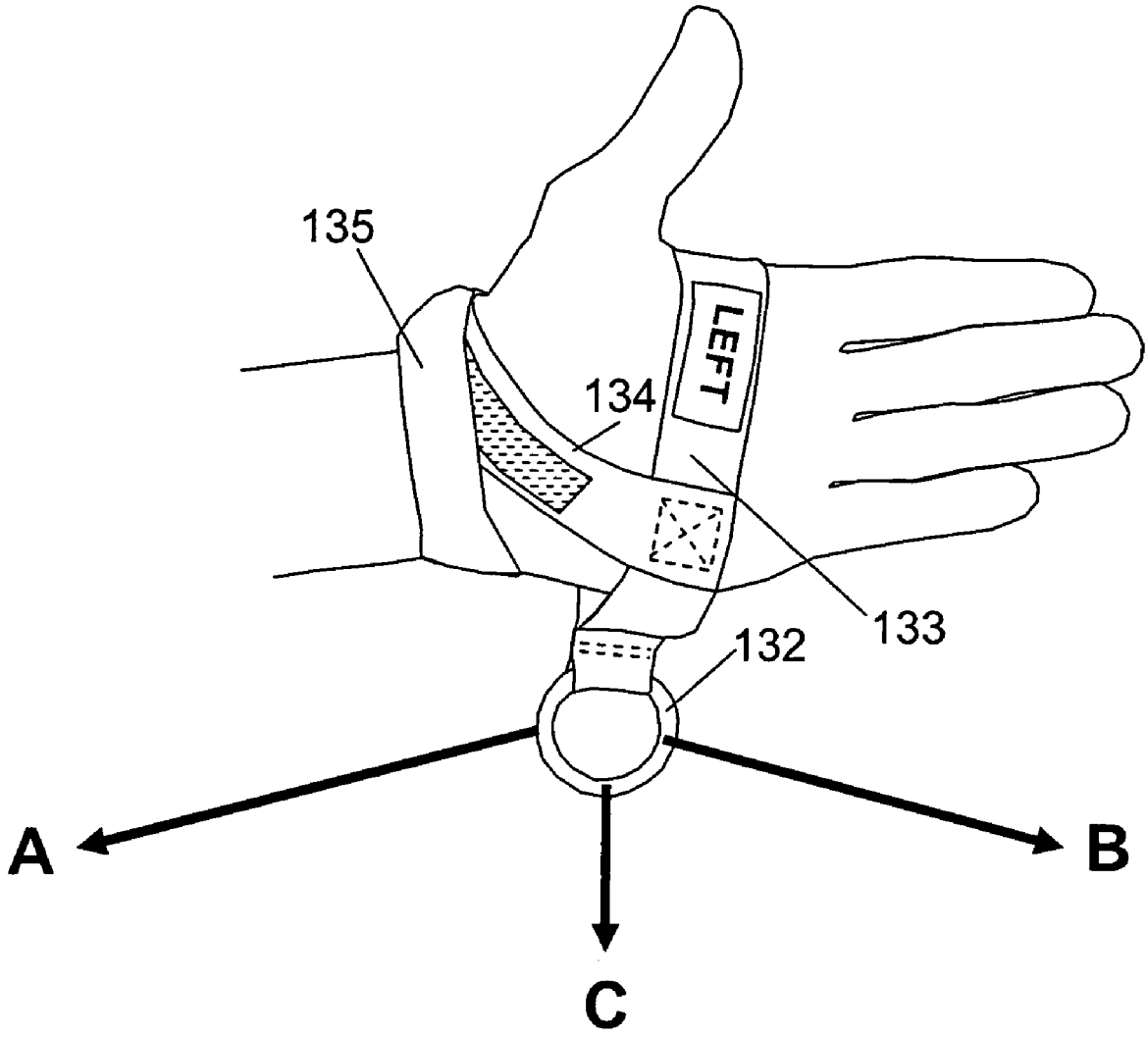
Figure 78:
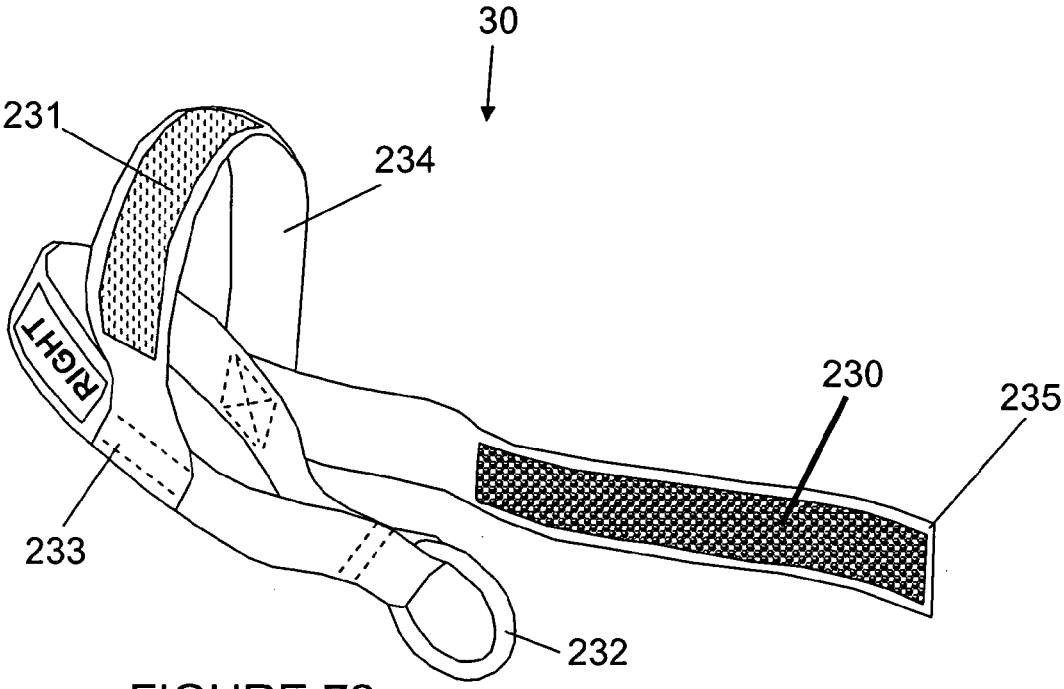
FIGS. 78-81 are pictorial views of an embodiment of a harness of the present invention adapted to be worn on the right hand of a user.
Figure 79:
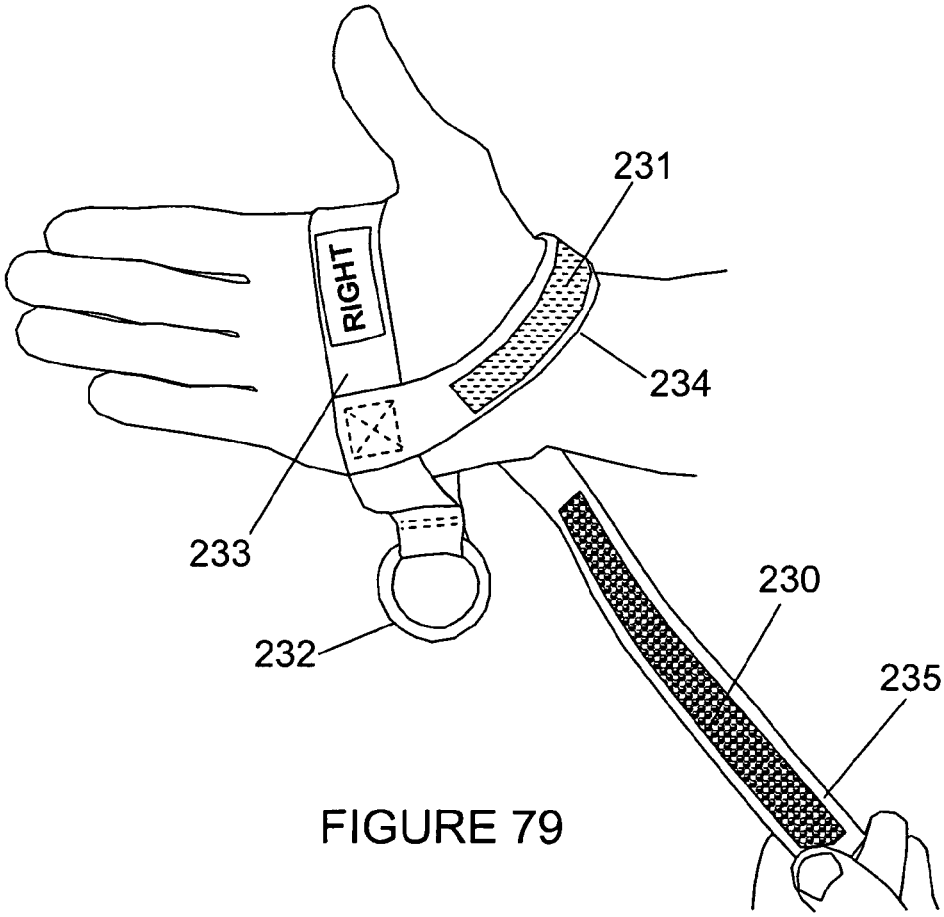
Figure 80:
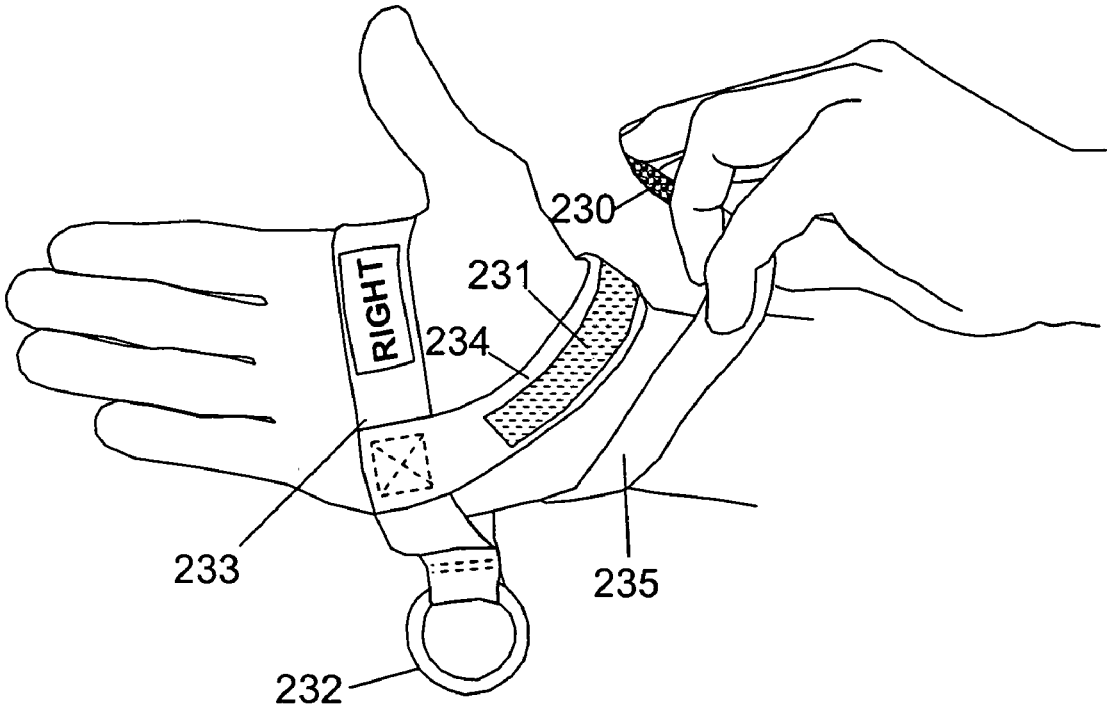
Figure 81:
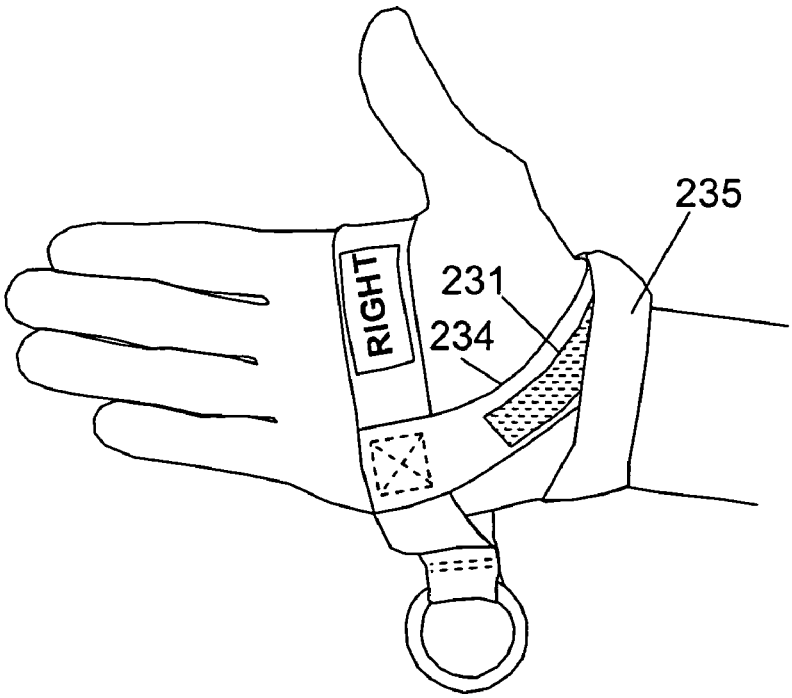
Figure 82:
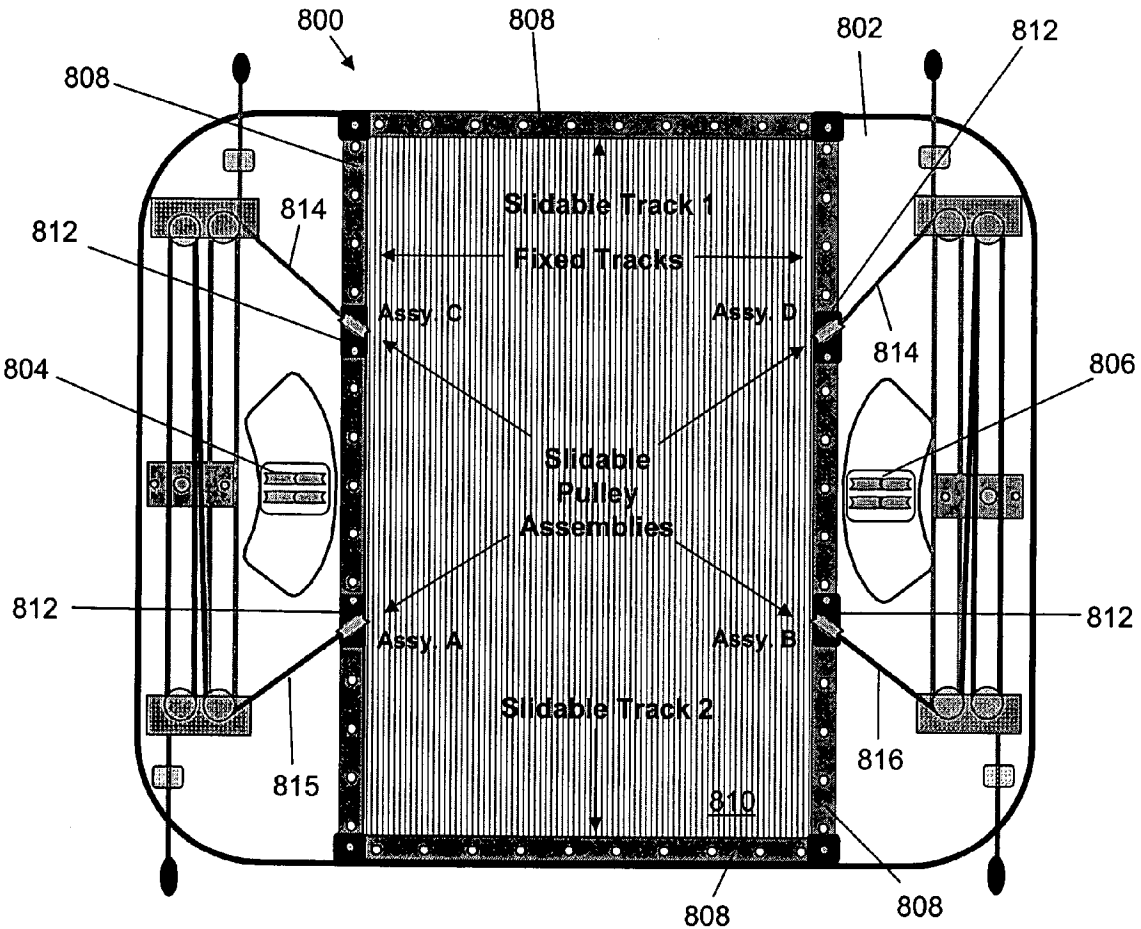
FIGS. 82-89 are top plan views of embodiments of the physical training apparatus of the present invention including up to eight or more training vectors wherein the origin of more than one of the training vectors may be varied from side to side and/or front to back on the surface supporting the trainee.
Figure 83:
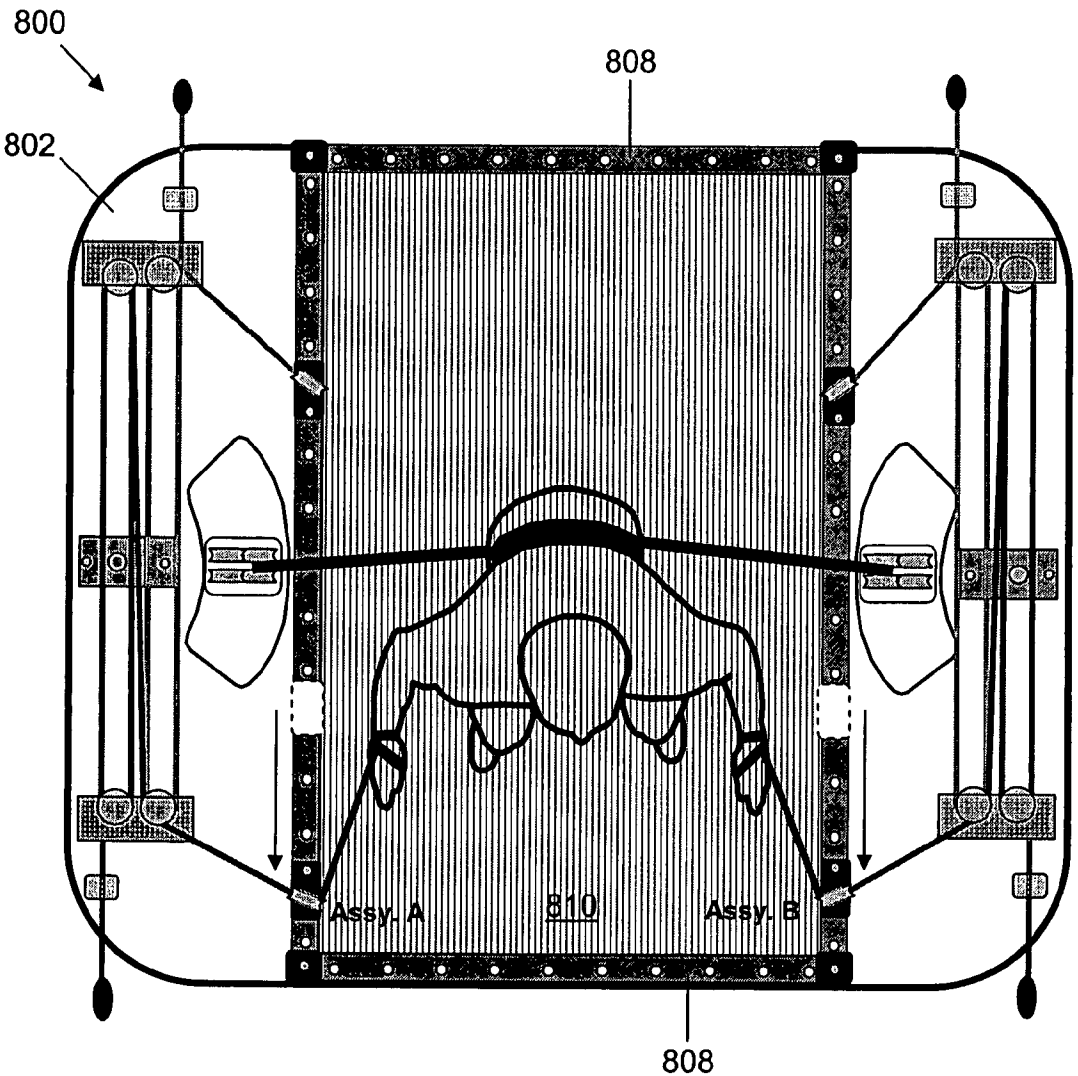
Figure 84:
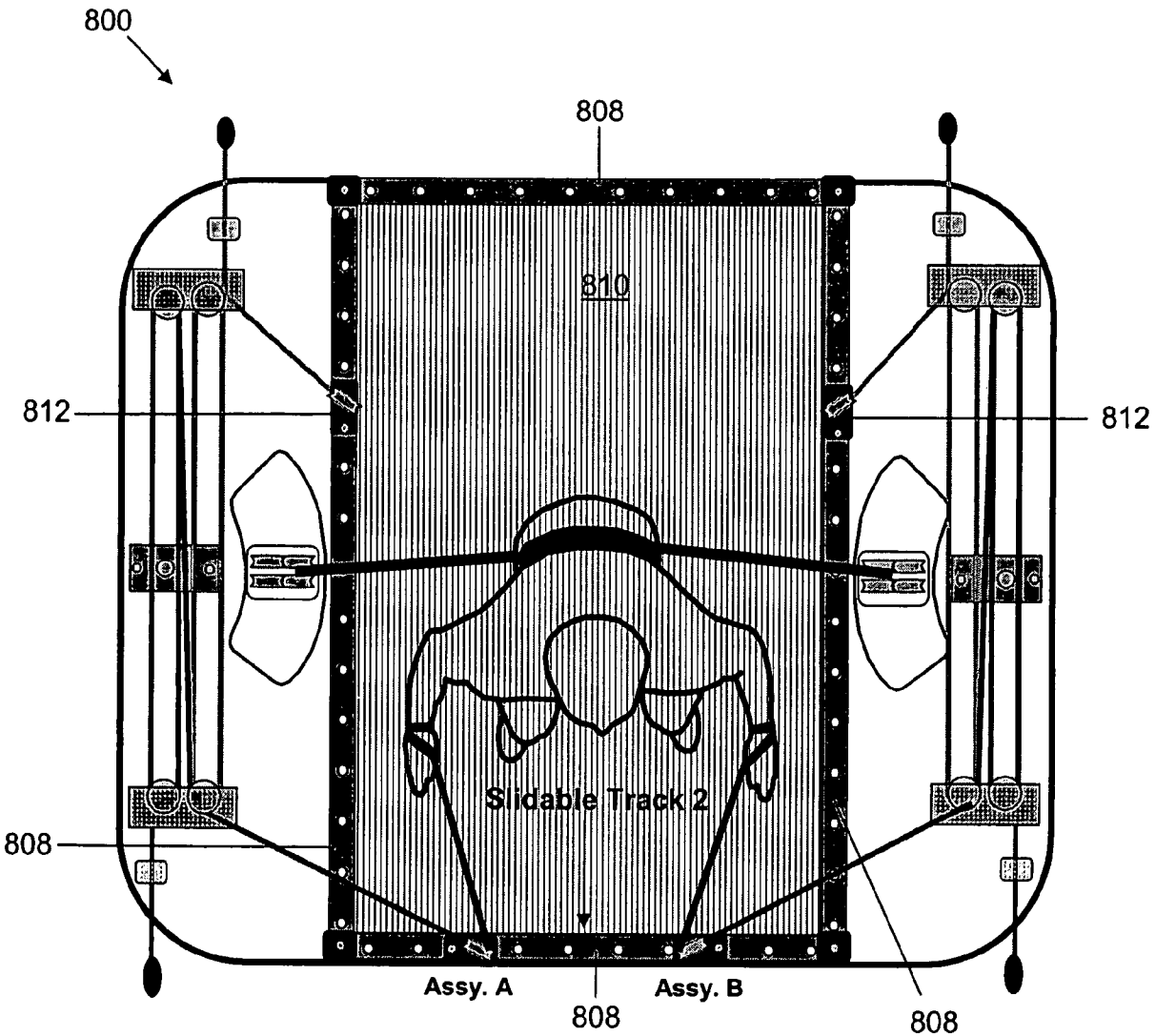
Figure 85:
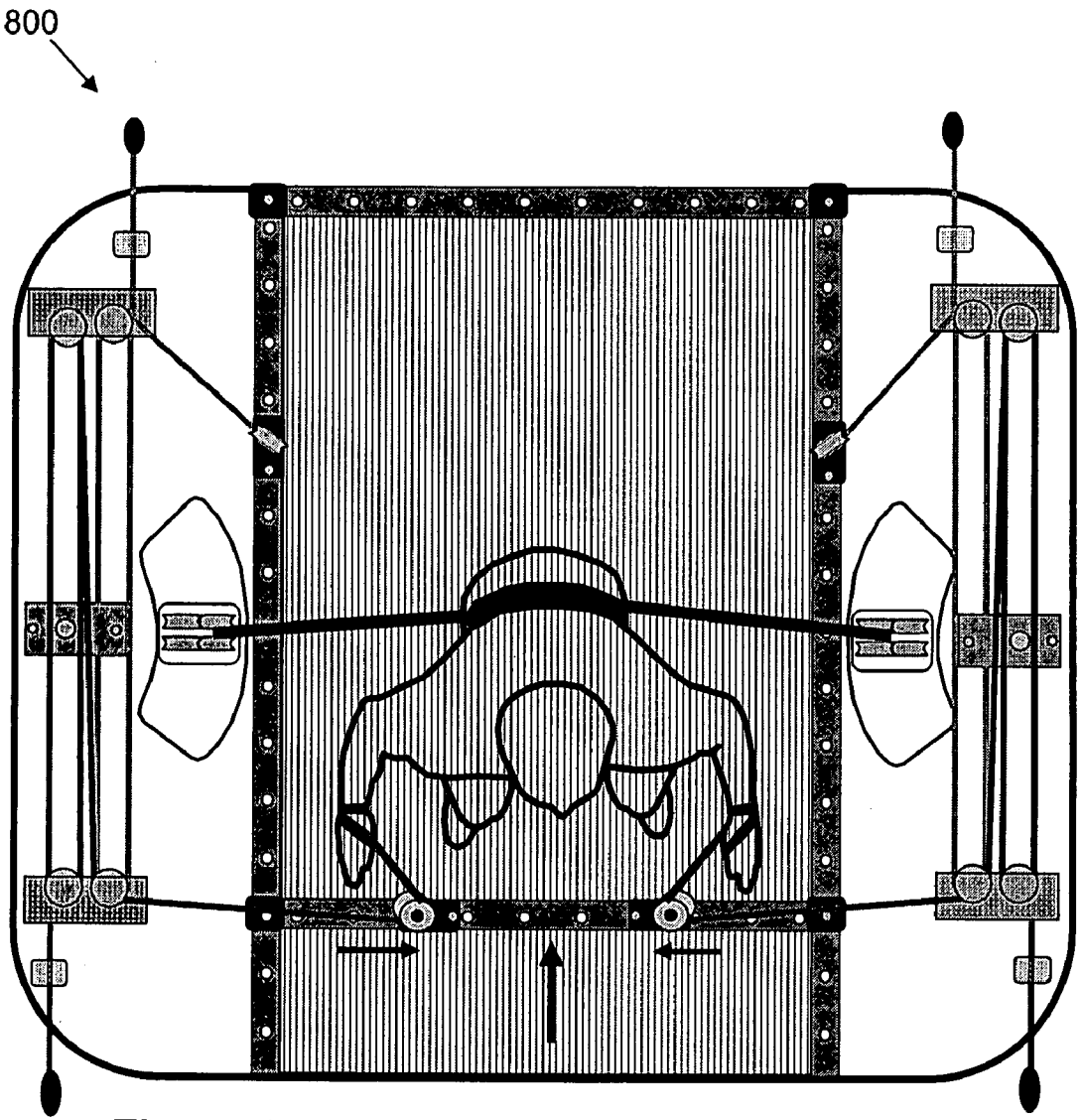
Figure 86:
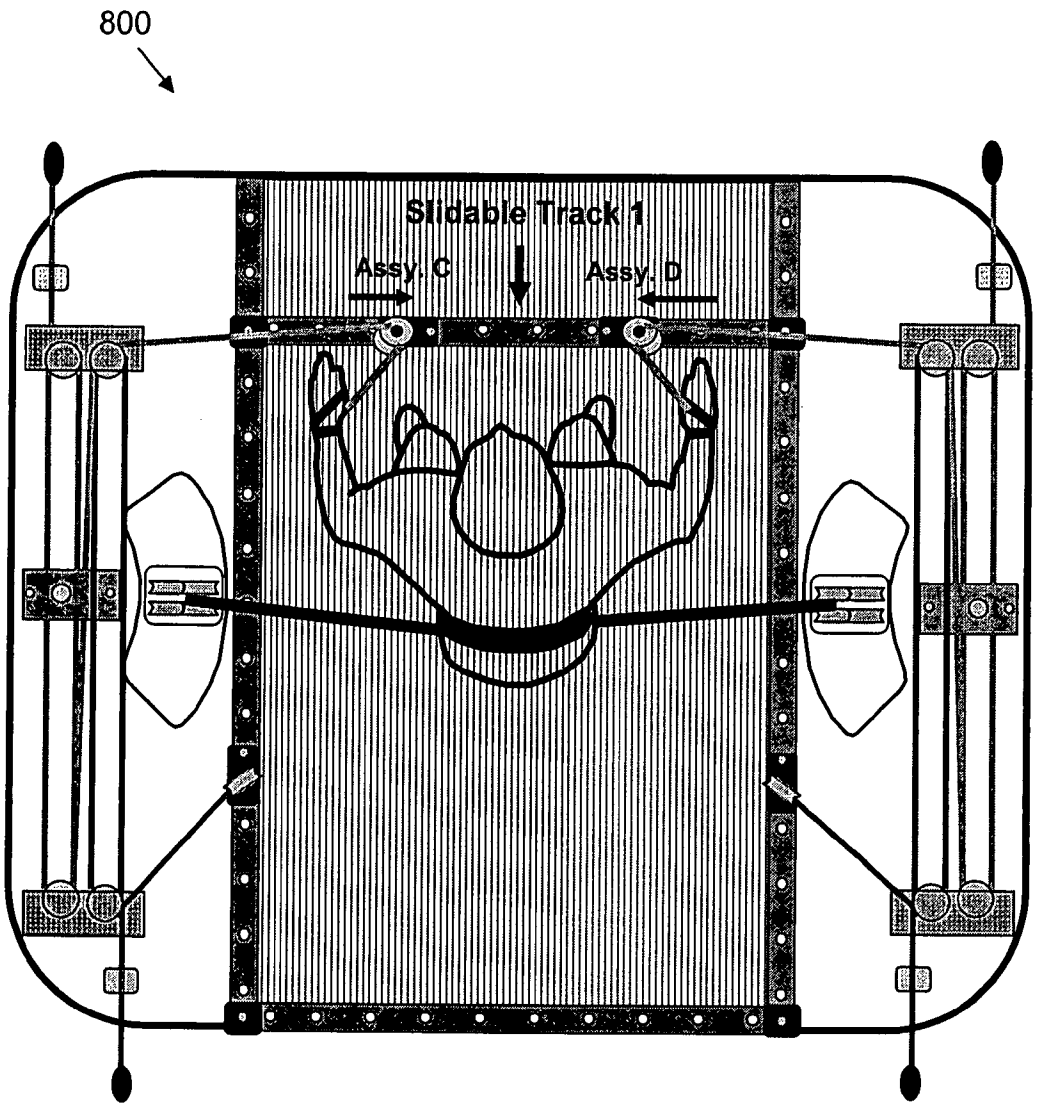
Figure 87:
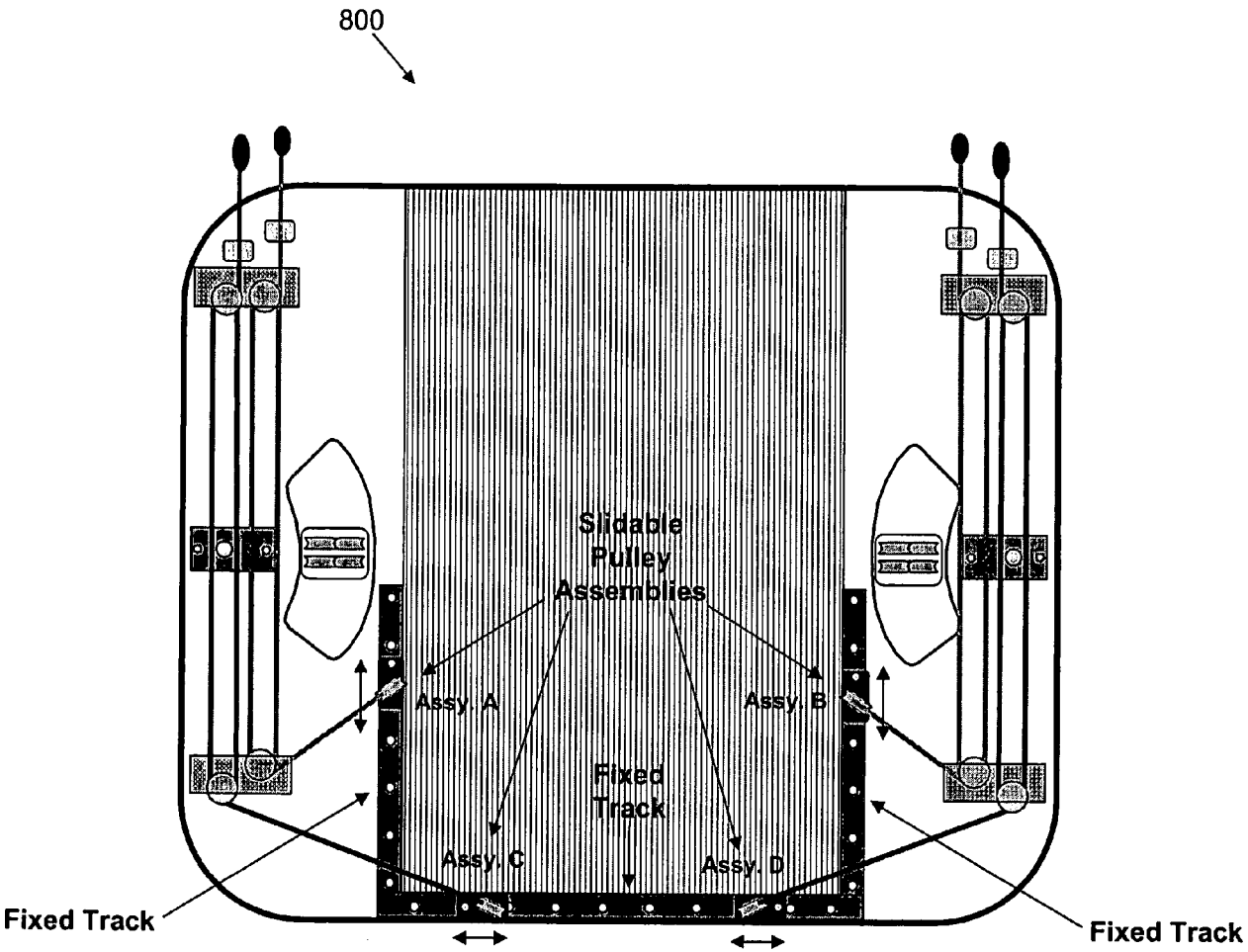
Figure 88:
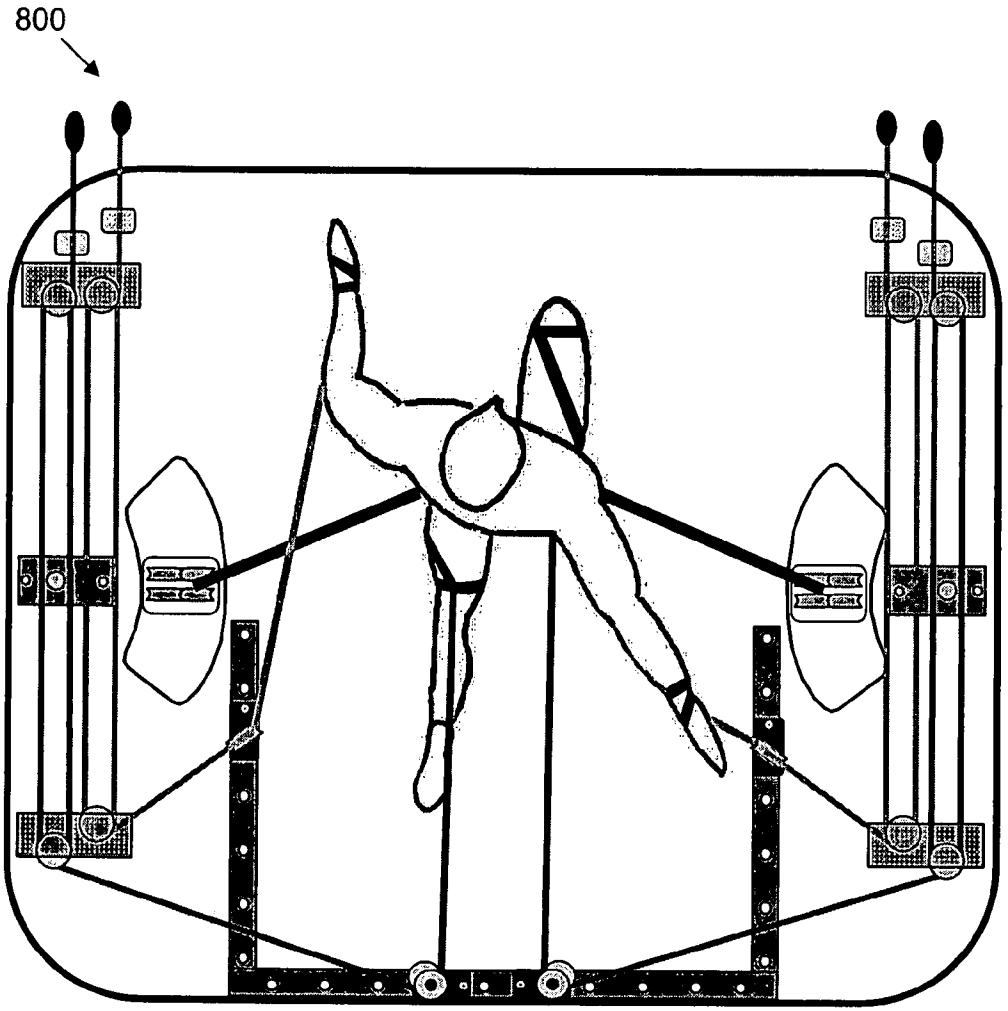
Figure 89:
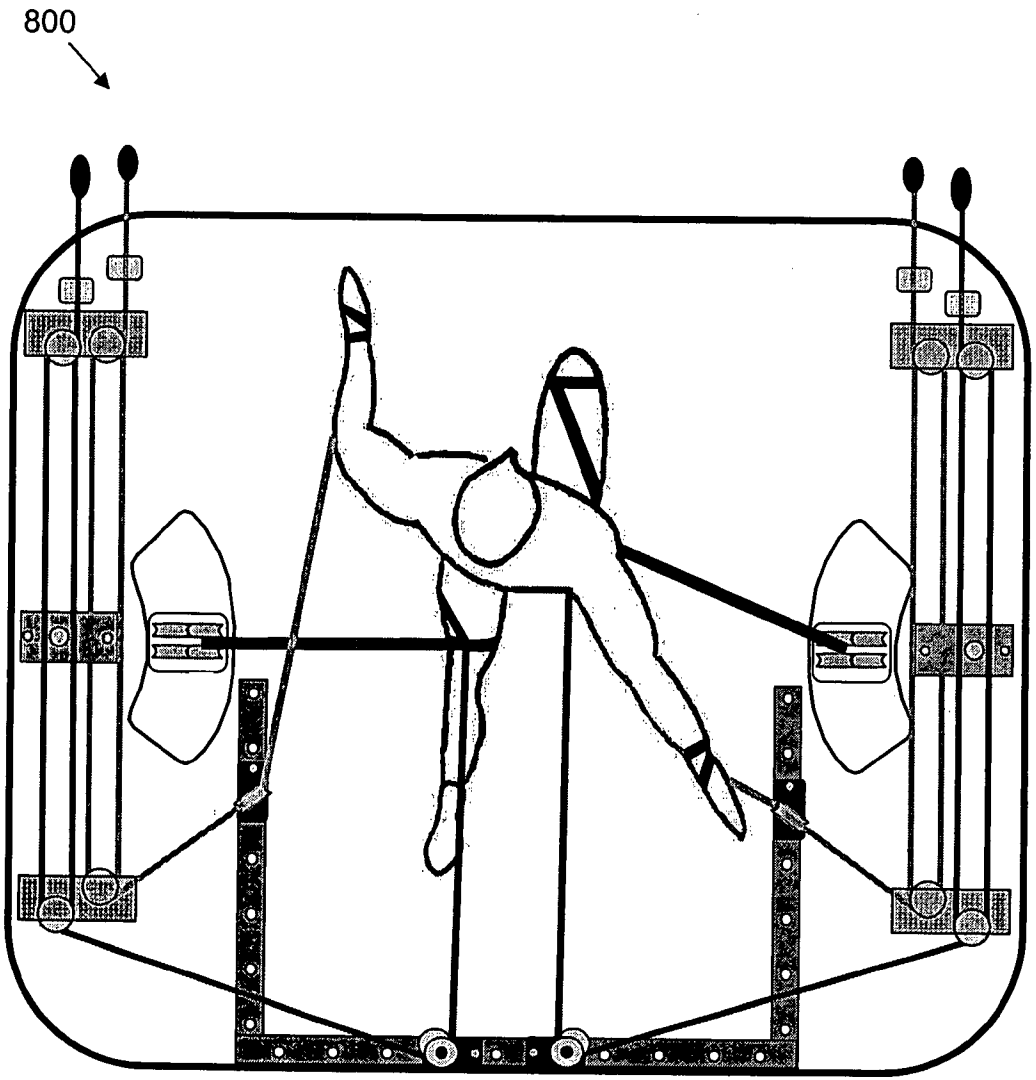

With reference FIGS. 66-67, it can be seen that the purpose of pulleys 121A and 121B are to maintain the tether T1 on pulley 122 when the rotating assembly 128 pivots about the mechanical axis 125. This assembly allows the user to move the tether over a wide range of points within the exercise area (180 degrees left and right, and 180 degrees up and down) without the tether derailing from the pulley assembly 92.

FIGS. 68-72 illustrate embodiments of the physical training apparatus according to the present invention where multiple pulley assemblies A,B,C,D are positioned about the training surface supporting the trainee 200 for providing multiple training vectors originating from in front of and behind the trainee. A single module 100 may include two elastic members A,B having different diameters for providing different ranges if resistive force. Alternatively, two or more modules may be stacked having elastic members with different diameters. The ability to provide a wide range of resistive forces is particularly important in a physical training apparatus that may be used for training or rehabilitating trainees ranging from athletes in their prime to the elderly.

FIGS. 73-81 illustrate a harness according the one aspect of the present invention. With reference to FIGS. 73-77, the harness 30 is adapted to be worn around the left hand of a trainee. The four fingers of the left hand are inserted through the loop 133 of harness 31. The strap 135 wraps around the wrist so that the left thumb is positioned between the loop 133 and the loop 134. Any suitable attachment means may be used to secure the strap 135. In the embodiment illustrated, a strip 131 of hook VELCRO and a strip 130 of loop VELCRO are provided on the strap to secure the strap in position around the wrist. The ring attachment 132 is provided for attachment to the means for providing a training vector to the hands.

FIGS. 78-81 illustrate the right hand harness 30 which is a mirror image of harness 31.

The innovative harnesses 30,31 allow the trainee to perform various tasks with the hands while wearing the harnesses such as catching balls etc. while having a force applied to the hand. Straps 133 and 134 work together in different capacities to support resistance placed on ring 132 in different directions. When a force is applied in the direction A, the strap 133 dissipates or resists force A by placing an equal and opposite force on the hand between the thumb and fore finger. When a force is applied in the direction B, the strap 134 behind the thumb places an equal and opposite force on the top wrist area to the support ring 132. When a force is applied in the direction C, both of the straps 133 and 134 behind the thumb and between the thumb and fore finger place two forces on the hand that equal the force applied to the ring 132. As a force changes from the direction A to B the force placed between the thumb and fore finger by the strap 133 to resist the force in direction A will gradually decrease while the force on the strap 134 gradually increases to resist the force in direction B as it increases. The gradual increase and decrease in resistance on the two hand straps 133 and 134 enables the two strongest support structures of the hand to support the resistance applied to the hand. This markedly improves the trainee's ability to utilize the thumb and fingers to catch objects while training. Additionally this hand strap will allow people who do not have use of their fingers (paralyzed or non-functional hands) to now comfortably perform arm exercises with resistance opposing movement of the hands.

FIGS. 82-90 illustrate embodiments of the physical training apparatus of the present invention wherein up to eight or more training vectors may be provided to the trainee and wherein the origin of more than one of the training vectors may be varied from side to side and/or front to back on the surface supporting the trainee. With reference to FIGS. 82-90, the physical training apparatus 800 includes a generally planar base 802. The pulley assemblies 804,806 provide the origin for up to four training vectors as disclosed in the prior Wehrell patents. The track members 808 may be mounted on the base 802 about the periphery of the training area 810, and one or more of the track members may be moveable relative to the other track members. A plurality of slidable pulley assemblies 812 may be mounted on the track members 808. The elastic members 814,816 may be directed through the slidable pulley assemblies 812 and then attached to the trainee. The slidable pulley assemblies thus provide the points of origin for the training vectors provided by the elastic members 814,816.

Figure 90:
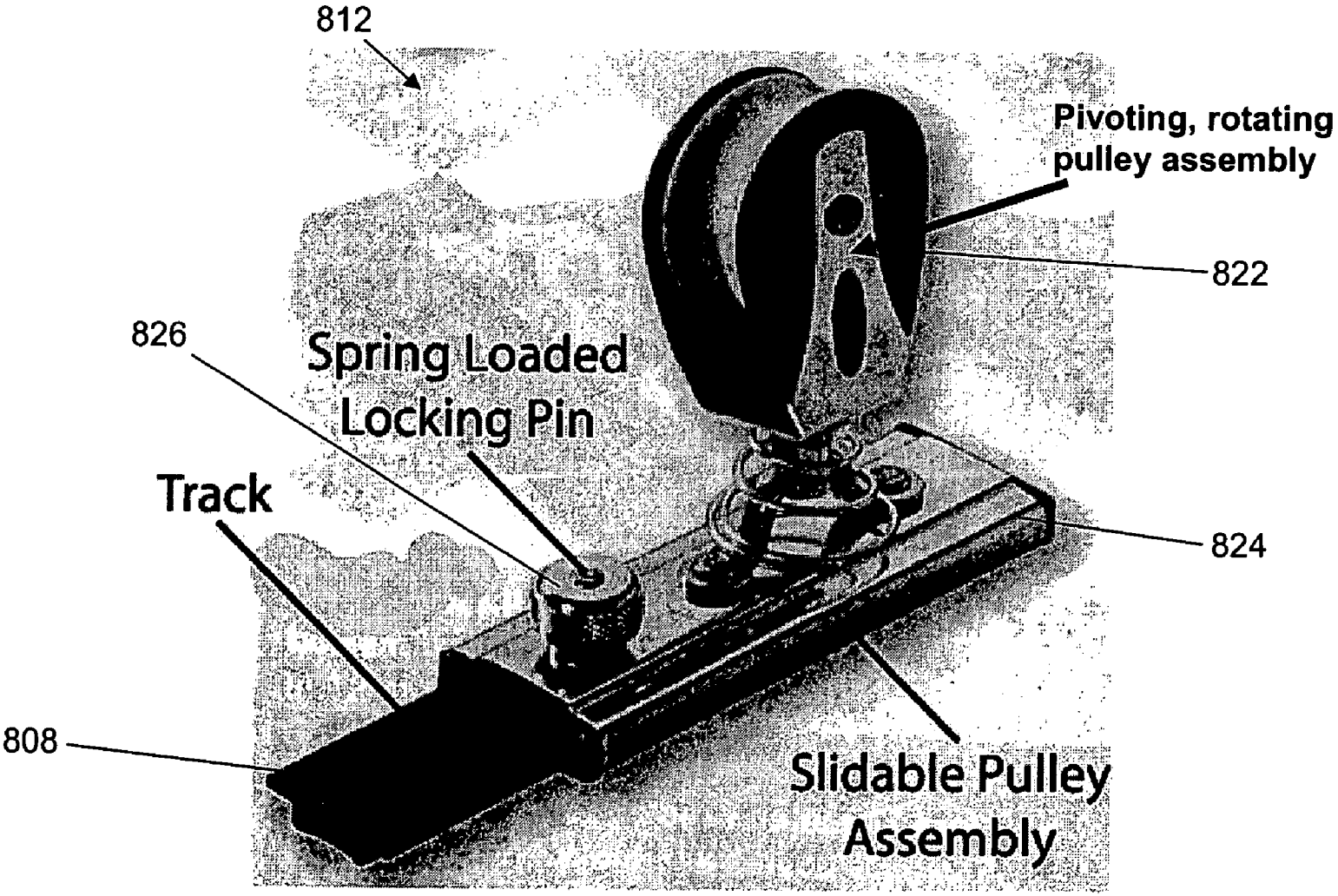
FIG. 90 is a pictorial view of a slidable pulley assembly according to one aspect of the present invention.

One embodiment of the sliding pulley assembly is shown in FIG. 90. With reference to FIG. 90, the sliding pulley assembly 812 comprises a pivoting and rotating pulley 822 mounted on a base 824 that is slidably carried by a track 808. The position of the assembly 812 may be fixed by any suitable locking means 826 such as a spring loaded locking pin.

The elastic members 814 and the elastic members 816 may have different diameters and thus provide training vectors of different magnitude. As shown by the various configurations of the physical training apparatus 800 illustrated in FIGS. 82-89, the physical training apparatus may be used for training athletes and physical therapy patients by providing training vectors to multiple muscle groups of the trainee from various angles and magnitudes.

While preferred embodiments of the present invention have been described, it is to be understood that the embodiments described are illustrative only and that the scope of the invention is to be defined solely by the appended claims-When accorded a full range of equivalence, many variations and modifications naturally occurring to those of skill in the art from a perusal hereof.

What is claimed is:

1. A physical training apparatus comprising:

a base forming a surface supporting a trainee;

a harness adapted to be worn by the trainee for providing an attachment means to a hand of the trainee;

a pair of modules carried by said base for providing a training vector of relatively constant magnitude to each hand of the trainee, each said module comprising:

an elastic member secured at one end to an anchor and attached at the other end to a connector means;

a rigid frame; and a plurality of tracking mechanisms carried by said frame for directing said elastic member from said connector means to the anchor, said connector means of one elastic member being attached to one of said attachment means and said connector means of the other elastic member being attached to the other attachment means for providing said training vector to each hand.

2. The physical training apparatus of claim 1 wherein said training vectors are provided to the hands of a trainee performing vertical jump training.

3. The physical training apparatus of claim 1 wherein said training vectors are provided to the hands of a trainee performing running or walking training.

4. The physical training apparatus of claim 1 wherein said means comprises an elastic member.

5. The physical training apparatus of claim 1 wherein said means comprises a pneumatic member.

6. The physical training apparatus of claim 1 wherein said means comprises an electric motor.

7. The physical training apparatus of claim 1 further comprising means for providing training vectors to the thighs of the trainee.

8. The physical training apparatus of claim 1 further comprising means for providing training vectors to the hips of the trainee.

9. The physical training apparatus of claim 8 further comprising means for providing training vectors to the thighs of the trainee.

10. A physical training apparatus for applying relatively constant resistance to the hands of a trainee though a predetermined range of motion, said apparatus comprising:

a base positioned at a physical training area;

a pair of harnesses each adapted to be worn on a hand of the athlete;

at least one elastic member attached to each harness for providing a force opposing motion of the harness in a predetermined range of motion, said elastic members having a length whereby the forces are relatively constant over said predetermined range of motion of said harness; and tracking means attached to said base for directing said elastic members out of said physical training area, wherein at least one of said tracking means comprises a module carried by said base, said module routing said at least one elastic member from an anchor at one end to said harness at the other end via a plurality of pulley mechanisms carried by said module.

11. The physical training apparatus of claim 10 wherein said base forms a generally planar physical training area.

12. The physical training apparatus of claim 11 wherein said tracking means direct said elastic member to a path generally parallel to the generally planar physical training area.

13. The physical training apparatus of claim 11 wherein said tracking means direct said elastic member to a path generally perpendicular to the generally planar physical training area.

14. A physical training apparatus for applying relatively constant resistance to the hands of a trainee through a predetermined range of motion, said apparatus comprising:

a pair of harnesses each adapted to be worn on a hand of an athlete;

at least one elastic member attached at one end to each harness for providing a force opposing the motion of the harness in a predetermined range of motion, said elastic member having a length whereby the force is relatively constant over said predetermined range of motion of said harness, wherein said at least one elastic member is carried by a module comprising:

an anchor adaptable to secure said elastic member secured at another end;

a rigid frame; and a plurality of tracking mechanisms carried by said frame for directing said elastic member from said anchor to the harness.

15. The physical training apparatus of claim 14 further comprising a harness adapted to be worn on the waist of the trainee and at least one elastic member attached at one end to said harness for providing a force opposing the motion of the harness in a predetermined range of motion, said elastic member having a length whereby the force is relatively constant over said predetermined range of motion of said harness.

16. The physical training apparatus of claim 15 further comprising a pair of harnesses each adapted to be worn on the thigh of the trainee and at least one elastic member attached at one end to each harness for providing a force opposing the motion of the harness in a predetermined range of motion, said elastic members having a length whereby the forces are relatively constant over said predetermined range of motion of said harness.

17. The physical training apparatus of claim 14 further comprising a pair of harnesses each adapted to be worn on the thigh of the trainee and at least one elastic member attached at one end to each harness for providing a force opposing the motion of the harness in a predetermined range of motion, said elastic members having a length whereby the forces are relatively constant over said predetermined range of motion of said harness.

18. A physical training apparatus comprising:

a first means for providing a force opposing the motion of a selected portion of the trainee though a predetermined range of motion of said portion;

a second means for providing a force opposing the motion of a selected portion of the trainee through a predetermined range of motion of said portion;

a third means for providing a force opposing the motion of a selected portion of the trainee through a predetermined range of motion of said portion;

a fourth means for providing a force opposing the motion of a selected portion of the trainee through a predetermined range of motion of said portion;

a fifth means for providing a force opposing the motion of a selected portion of the trainee through a predetermined range of motion of said portion; and a sixth means for providing a force opposing the motion of a selected portion of the trainee through a predetermined range of motion of said portion.

19. The physical training apparatus of claim 18 wherein one or more means for providing a force opposing the motion of a selected portion of the trainee through a predetermined range of motion of said portion comprises an elastic member attached at one end to a harness adapted for connection to the selected portion of the trainee.

20. The physical training apparatus of claim 18 wherein one or more means for providing a force opposing the motion of a selected portion of the trainee through a predetermined range of motion of said portion comprises a pneumatic member attached to a harness adapted for connection to the selected portion of the trainee.

21. The physical training apparatus of claim 18 comprising means for providing a force opposing the motion of the hands of the trainee through a predetermined range of motion.

22. The physical training apparatus of claim 21 comprising means for providing a force opposing the motion of the hips of the trainee through a predetermined range of motion.

23. The physical training apparatus of claim 22 comprising means for providing a force opposing the motion of the thighs of the trainee through a predetermined range of motion.

24. The physical training apparatus of claim 21 comprising means for providing a force opposing the motion of the thighs of the trainee through a predetermined range of motion.

25. The physical training apparatus of claim 18 comprising means for providing a force opposing the motion of the hips of the trainee through a predetermined range of motion.

26. The physical training apparatus of claim 18 comprising means for providing a force opposing the motion of the thighs of the trainee through a predetermined range of motion.

27. The physical training apparatus of claim 18 wherein said means are adapted for attachment to a selected portion of a trainee that is training on a treadmill.

28. The physical training apparatus of claim 18 comprising one or more means for providing a force of relatively constant magnitude opposing the motion of a selected portion of the trainee through a predetermined range of motion of said portion.

29. The physical training apparatus of claim 18 comprising one or more means for providing a force of varying magnitude opposing the motion of a selected portion of the trainee through a predetermined range of motion of said portion.

30. The physical training apparatus of claim 18 wherein one or more means for providing a force opposing the motion of a selected portion of the trainee through a predetermined range of motion of said portion comprises an electric motor attached to a harness adapted for connection to the selected portion of the trainee.

31. The physical training apparatus of claim 18 comprising eight training vectors.

32. The physical training apparatus of claim 18 wherein one or more of the training vectors originate from forward of the trainee and one or more of the training vectors originate from rearward of the trainee.

33. A physical training apparatus comprising:

a base forming a surface supporting a trainee;

a pair of modules carried on the upper surface of said base on opposing sides of said base, each module being configured to provide a pair of training vectors to the trainee, each said module comprising:

an elastic member secured at one end to an anchor and having a connector at the other end adapted to be connected to a harness;

a rigid frame; and a plurality of tracking mechanisms carried by said frame for directing said elastic member from said connector to said anchor, and a pair of elastic members having an end terminating in a connector above the top surface of said base on opposing sides of said base, each of said elastic members extending through a plurality of tracking mechanisms and being secured at the other end by an anchor attached to the lower surface of said base.

34. The physical training apparatus of claim 33 wherein each module includes an elastic member connected to a harness adapted to be worn on a hand of the trainee.

35. The physical training apparatus of claim 34 comprising means for providing a training vector to each thigh of the trainee.

36. The physical training apparatus of claim 35 comprising means for providing a training vector to each hip of the trainee.

37. The physical training apparatus of claim 34 wherein each elastic member of said pair of elastic members is connected to a harness adapted to be worn on each hip of the trainee.

38. The physical training apparatus of claim 33 wherein one or more elastic members provides a relatively constant force opposing the motion of a selected portion of the trainee through the predetermined range of motion.

39. The physical training apparatus of claim 33 wherein one or more of said elastic members is attached at one end to a harness adapted for connection to a selected portion of the trainee, said elastic member having an effective length whereby the member provides a relatively constant force to the selected portion of the trainee through a predetermined range of motion.

40. The physical training apparatus of claim 39 wherein the effective length of said elastic member is selectable to thereby select the magnitude of the force provided by the member.

41. A module for providing a training vector in a physical training apparatus, said module comprising:

an elastic member for providing a relatively constant force through a predetermined range, said member being attached at one end to a connector means and being attachable at the other end to an anchor;

an elongated frame; and one or more tracking mechanisms carried by said frame for directing said elastic member from the connector means to an anchor, wherein said module is attachable to a base for providing a training vector to a trainee supported by the base.

42. The module of claim 41 wherein said elastic member has a length whereby said module provides a training vector of relatively constant magnitude.

43. The module of claim 42 wherein the length of said elastic member between the connector means and the anchor is variable to thereby vary the magnitude of the training vector.

44. A physical training apparatus for providing a training vector to a trainee, said apparatus comprising:

a base;

a first module attached to said base, said first module comprising:

an elastic member secured at one end to an anchor and attached at the other end to a first connector means;

a rigid frame; and a plurality of tracking mechanisms carried by said frame for directing said elastic member from said first connector means to the anchor; and a second module attached to said base or said first module, said second module comprising:

an elastic member attached at one end to said first connector means and attached at the other end to a second connector means;

a rigid frame; and a plurality of tracking mechanisms carried by said frame for directing said elastic member from said second connector means to said first connector means; and a harness adapted to be worn by the trainee connected to said second connector means.

45. A physical training apparatus comprising:

a base forming a physical training area;

a harness adapted to be worn by a trainee; and one or more modules connected to said harness for providing a relatively constant force opposing the movement of said harness through a predetermined range of motion, the magnitude of said force being selectable by selecting the number of modules connected to said harness.

46. The physical training apparatus of claim 45 wherein one or more of said modules comprises an elastic member wherein the effective length of said elastic member may be varied to thereby vary the magnitude of the training vector provided by said module.

47. A physical training apparatus comprising:

a base forming a generally planar training area;

one or more track members mounted on said base about the periphery of the training area;

one or more pulley assemblies mounted on said track members, said position of said pulley members being variable along at least a portion of the track member;

one or more elastic members routed through one or more of said pulley assemblies for providing a training vector to a trainee training in the training area, whereby said one or more pulley assemblies forms the point of origin for the training vector of the elastic member routed therethrough.

48. The physical training apparatus of claim 47 wherein one or more of said pulley assemblies is positioned forward of the trainee.

49. The physical training apparatus of claim 47 wherein one or more of said pulley assemblies is positioned rearward of the trainee.

* * * * *